US009391376B2

(12) United States Patent
Kawamura et al.

(10) Patent No.: US 9,391,376 B2
(45) **Date of Patent: *Jul. 12, 2016**

(54) CRIMP TERMINAL, CONNECTION STRUCTURAL BODY AND CONNECTOR

(71) Applicants: Furukawa Electric Co., Ltd., Tokyo (JP); Furukawa Automotive Systems, Inc., Shiga (JP)

(72) Inventors: Yukihiro Kawamura, Shiga (JP); Satoshi Takamura, Shiga (JP); Takashi Tonoike, Shiga (JP); Yasushi Kihara, Tokyo (JP); Saburo Yagi, Tokyo (JP); Takashi Shigematsu, Tokyo (JP); Kengo Mitose, Tokyo (JP); Takashi Kayahara, Tokyo (JP)

(73) Assignees: Furukawa Electric Co., Ltd., Tokyo (JP); Furukawa Automotive Systems, Inc., Shiga (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/589,677

(22) Filed: Jan. 5, 2015

(65) Prior Publication Data

US 2015/0126078 A1 May 7, 2015

Related U.S. Application Data

(63) Continuation of application No. PCT/JP2013/068783, filed on Jul. 9, 2013.

(30) Foreign Application Priority Data

| | | |
|---|---|---|
| Jul. 9, 2012 | (JP) | 2012-153607 |
| Jul. 20, 2012 | (JP) | 2012-162075 |
| Oct. 4, 2012 | (JP) | 2012-222112 |
| Oct. 4, 2012 | (JP) | 2012-222113 |
| Oct. 4, 2012 | (JP) | 2012-222114 |

(51) Int. Cl.
*H01R 4/18* (2006.01)
*H01R 43/00* (2006.01)
(Continued)

(52) U.S. Cl.
CPC ..... *H01R 4/187* (2013.01); *H01R 4/20* (2013.01); *H01R 43/005* (2013.01); *H01R 43/02* (2013.01); *H01R 43/048* (2013.01); *H01R 4/62* (2013.01)

(58) Field of Classification Search
CPC ..... H01R 4/187; H01R 4/185; H01R 4/20; H01R 4/62; H01R 43/005; H01R 43/02; H01R 43/048
USPC ..... 439/877, 878, 741, 430, 442, 203, 585; 174/84 C
See application file for complete search history.

(56) References Cited

U.S. PATENT DOCUMENTS 3,955,044 A * 5/1976 Hoffman ..... H01R 4/62 174/84 C
8,974,258 B2 * 3/2015 Mitose ..... H01R 4/184 439/877

(Continued)

FOREIGN PATENT DOCUMENTS

EP 0 547 867 A1 12/1992
JP 5-290945 11/1993

(Continued)

OTHER PUBLICATIONS

Chinese Office Action issued in Application No. 201380007782.5 on Aug. 22, 2015 (w/ English Translation).

(Continued)

*Primary Examiner* — Abdullah Riyami
*Assistant Examiner* — Harshad Patel
(74) *Attorney, Agent, or Firm* — Oblon, McClelland, Maier & Neustadt, L.L.P

(57) ABSTRACT

In a female crimp terminal including a pressure-bonding section for permitting pressure-bonding and connection to an aluminum core wire of an insulated wire, the pressure-bonding section is configured in a hollow sectional shape by a plate material, and a long length direction weld portion in a long length direction is welded, a forward part in the hollow sectional shape is caused to take an almost flat plate-shaped sealing shape and a width direction weld portion in a width direction is welded.

6 Claims, 49 Drawing Sheets

(51) Int. Cl.

| | |
|---|---|
| ***H01R 4/20*** | (2006.01) |
| ***H01R 43/02*** | (2006.01) |
| ***H01R 43/048*** | (2006.01) |
| *H01R 4/62* | (2006.01) |

(56) References Cited

U.S. PATENT DOCUMENTS

| | | | | |
|---|---|---|---|---|
| 2001/0003687 | A1 | 6/2001 | Kondo | |
| 2014/0377991 | A1* | 12/2014 | Kawamura et al. | 439/604 |
| 2015/0064991 | A1* | 3/2015 | Kawamura et al. | 439/879 |

FOREIGN PATENT DOCUMENTS

| | | | |
|---|---|---|---|
| JP | 05-309476 | | 11/1993 |
| JP | 2004-71437 | | 3/2004 |
| JP | 2009-252700 | | 10/2009 |
| JP | 2011-083822 | | 4/2011 |
| JP | 2011-125928 | | 6/2011 |
| JP | 2011-210592 | | 10/2011 |
| JP | WO2011/122622 | * | 10/2011 |
| JP | 2011-233328 | | 11/2011 |
| JP | 2012-54101 | | 3/2012 |
| KR | 10-2006-0012324 | | 2/2006 |
| KR | 20-2008-0006632 | | 12/2008 |

OTHER PUBLICATIONS

Korean Office Action issued in Application No. 9-5-2015-074675797 on Oct. 28, 2015.

Korean Office Action issued in Application No. 10-2014-7022390 on Sep. 1, 2015 (w/ English Translation).

Japanese Office Action issued in Application No. 2013-544899 on Dec. 24, 2013 (w/ English Translation).

International Search Report issued in Application No. PCT/JP2013/068783 on Oct. 15, 2013 (w/ English Translation).

Grant of Patent issued in Korean Patent Application No. 10-2014-7022390 on Oct. 28, 2015 (English translation).

Notice of Decision of Granting Patent Right for Invention issued in Chinese Patent Application No. 201380007782.5 on Feb. 5, 2016 (w/ English translation).

* cited by examiner

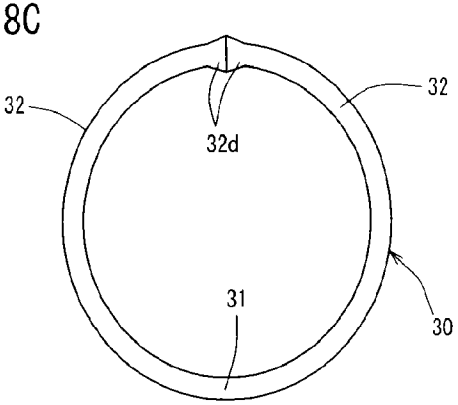
FIG. 8A
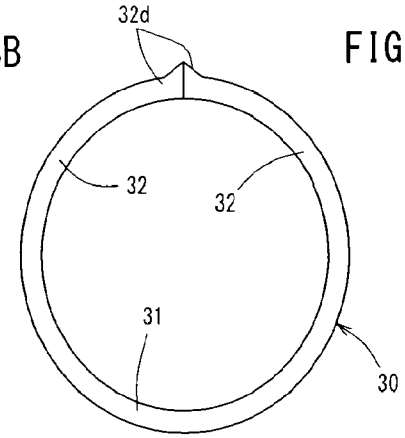
FIG. 8B
FIG. 8C
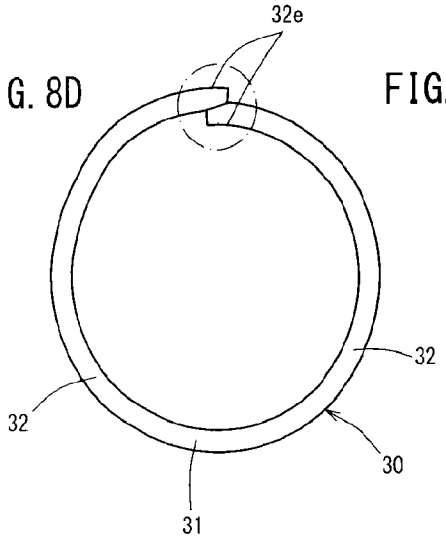
FIG. 8D
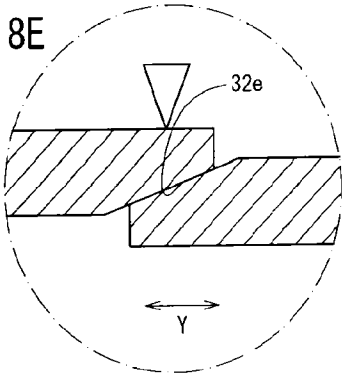
FIG. 8E
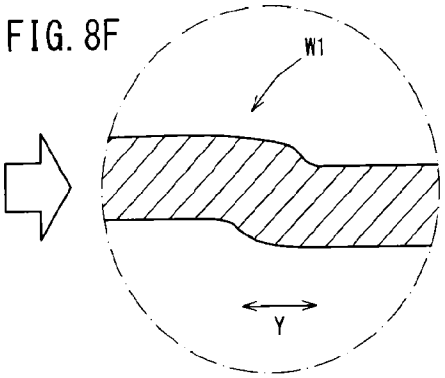
FIG. 8F FIG. 42B ENLARGED VIEW OF PART"a"

FIG. 43B ENLARGED VIEW OF PART"a"

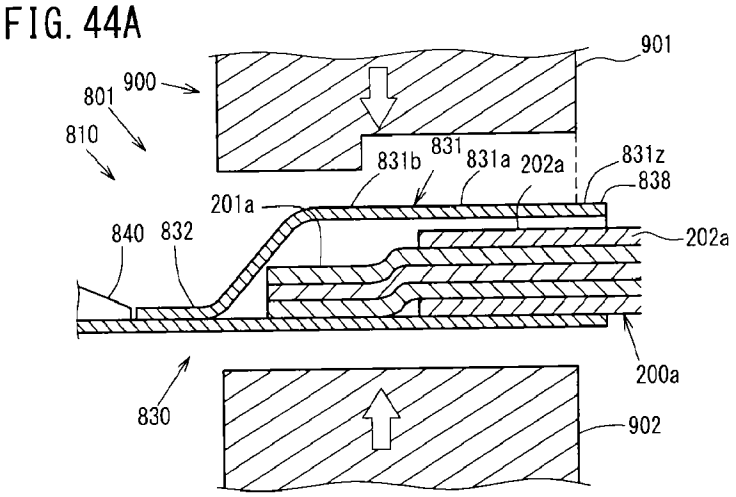
FIG. 44A
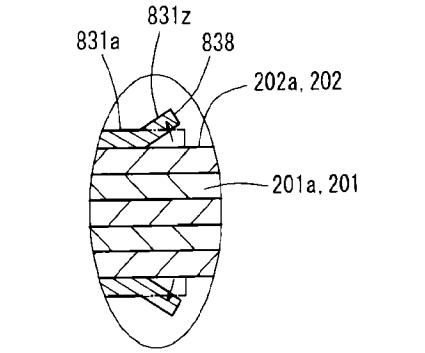
FIG. 44C
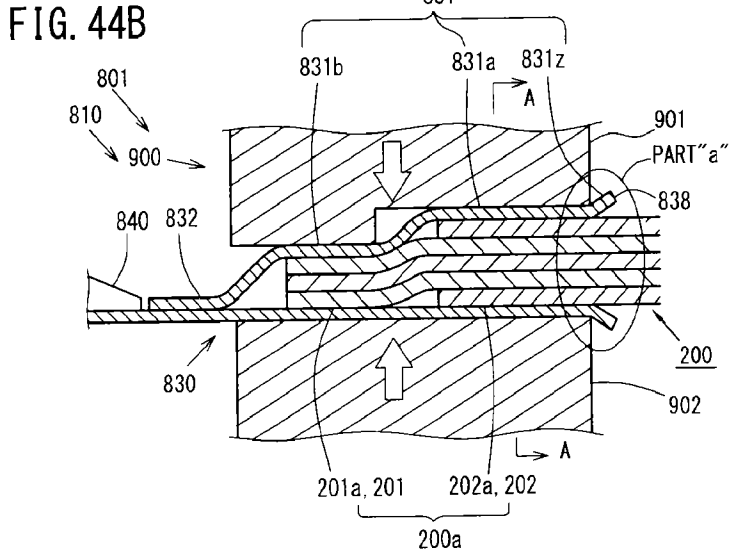
FIG. 44B
FIG. 44D

CRIMP TERMINAL, CONNECTION STRUCTURAL BODY AND CONNECTOR

CROSS-REFERENCE TO RELATED APPLICATIONS

This application is a continuation of PCT International Application Serial No. PCT/JP2013/068783 filed Jul. 9, 2013, which designates the United States, the entire contents of which is incorporated herein by reference. PCT International Application Serial No. PCT/JP2013/068783 is based upon and claims the benefit of priority to prior Japanese Patent Application Nos. 2012-153607 filed Jul. 9, 2012, 2012-162075 filed Jul. 20, 2012, 2012-222112 filed Oct. 4, 2012, 2012-222113 filed Oct. 4, 2012, and 2012-222114 filed Oct. 4, 2012.

TECHNICAL FIELD

The present invention relates to a crimp terminal attached to a connector or the like which performs connection of a wire harness for an automobile, for example, a connection structural body using the crimp terminal, and furthermore, a connector having the connection structural body attached thereto.

BACKGROUND ART

Recent automobiles are provided with various electric apparatuses and an electric circuit of each of the apparatuses tends to be complicated. Therefore, it is indispensable to ensure a stable electrical connection state. The electric circuits of the various electric apparatuses are configured by wiring, to an automobile, a wire harness obtained by bundling a plurality of insulated wires and connecting the wire harnesses to each other through a connector. Moreover, a crimp terminal having an insulated wire of the wire harness pressure-bonded and connected to a pressure-bonding section is attached to an inner part of the connector.

In the case in which the insulated wire is connected to the crimp terminal, however, a gap tends to be generated between an exposed part of a conductor portion which is exposed from a tip of an insulating cover portion of the insulated wire and the pressure-bonding section of the crimp terminal and the conductor portion is exposed in an outside air exposing state. For this reason, there is a problem in that corrosion occurs on a surface of the conductor portion which is pressure-bonded into the pressure-bonding section and conductivity is thus reduced when water intrudes the pressure-bonding section of the crimp terminal attached to the inner part of the connector.

As a method of preventing reduction in conductivity in the pressure-bonding section due to the intrusion of water, for example, there is proposed a connection structural body in which an exposed part in the conductor portion is closed with an insulating cover portion formed by a resin having high viscosity in a pressure-bonding state in which the conductor portion is pressure-bonded by the pressure-bonding section, for example (see Patent Document 1).

With the connection structural body of the Patent Document 1, however, the conductor portion of the insulated wire is pressure-bonded by the pressure-bonding section and the exposed part in the conductor portion is then covered with the insulating cover portion. Therefore, it is necessary to perform a step of covering the exposed part with the insulating cover portion after the pressure-bonding step. Consequently, it is hard to further enhance production efficiency of the connection structural body.

PRIOR ART DOCUMENT

Patent Document

Patent Document 1: Japanese Patent Laid-open Publication No. 2011-233328

SUMMARY OF THE INVENTION

Problems to be Solved by the Invention

It is an object of the present invention to provide a crimp terminal, a connection structural body and a connector which can efficiently realize a pressure-bonding state in which water can be prevented from intruding an inner part of a pressure-bonding section in a pressure-bonding state in which a conductor portion is pressure-bonded by a pressure-bonding section.

Solutions to the Problems

The present invention provides a crimp terminal including at least a pressure-bonding section for permitting pressure-bonding and connection to a conductor portion of an insulated wire, wherein the pressure-bonding section is configured from a plate material to take a hollow sectional shape and has the plate material welded in a long length direction in the hollow sectional shape, a sealing portion for sealing the plate materials to be superposed on each other in a planar shape is provided on one end side in the long length direction of the pressure-bonding section in the hollow sectional shape, and welding is carried out in a direction intersecting with the long length direction between both ends in the long length direction of the sealing portion.

According to the present invention, for example, one end side in the long length direction of the pressure-bonding section taking the hollow sectional shape is sealed. In the pressure-bonding state in which the conductor portion is pressure-bonded by the pressure-bonding section, consequently, it is possible to prevent water intrusion into an inner part, thereby ensuring reliable water-blocking performance. Moreover, the conductor portion in the pressure bonding section is not exposed to outside air but gradation or aged deterioration can be inhibited from being caused. Accordingly, corrosion does not occur in the conductor portion but electric resistance can also be prevented from being raised due to the corrosion. Therefore, it is possible to obtain stable conductivity. In other words, it is possible to ensure a stable electrical connection state.

This will be described in more detail. The pressure-bonding section is configured by the plate material to take the hollow sectional shape and the plate material is welded in the long length direction in the hollow sectional shape. When the conductor portion is to be pressure-bonded by the pressure-bonding section, therefore, the one end side in the long length direction of the pressure-bonding section taking the hollow sectional shape is sealed. Consequently, it is possible to carry out the pressure-bonding into a wrapping state with water-blocking performance without exposing the conductor portion of the insulated wire or the conductor portion to the outside of the pressure-bonding section.

Moreover, according to the present invention, by simply pressure-bonding the pressure-bonding section in which the conductor portion is inserted, it is possible to carry out the pressure-bonding into a wrapping state with water-blocking performance without exposing the conductor portion of the insulated wire or the conductor portion to the outside of the pressure-bonding section.

This will be described in more detail. The one end side in the long length direction in the hollow sectional shape is caused to take a sealing shape for sealing, and the welding is carried out in the direction intersecting with the long length direction at the one end side in the long length direction which is formed in the sealing shape for sealing. Therefore, portions other than an insertion portion for inserting the conductor portion to the pressure-bonding section taking the hollow sectional shape are sealed. By simply pressure-bonding the pressure-bonding section in which the conductor portion is inserted, it is possible to carry out the pressure-bonding in a wrapping state having water-blocking performance without exposing the conductor portion of the insulated wire or the conductor portion to the outside of the pressure-bonding section.

The one end side in the long length direction in the hollow sectional shape implies an end side to be opposite to an insertion side for inserting the conductor portion into the pressure-bonding section.

As an aspect of the present invention, moreover, a weld portion in the long length direction and a weld portion in the direction intersecting with the long length direction can be set on almost the same plane.

According to the present invention, for example, it is possible to reliably carry out the welding by readily moving a welding device such as laser welding, for example.

As an aspect of the present invention, furthermore, the weld portion in the long length direction can be changed in a height direction.

According to the present invention, it is possible to configure pressure-bonding sections having water-blocking performance which take various shapes.

As an aspect of the present invention, moreover, the pressure-bonding section can be configured from a pressure-bonding surface and an extended pressure-bonding piece extended from both sides in a width direction of the pressure-bonding surface, and the extended pressure-bonding piece can be bent and configured to have a ring-shaped section, and opposed ends of the extended pressure-bonding piece can be butted each other and a butt portion can be welded in the long length direction.

According to the present invention, the pressure-bonding section having the ring-shaped section is configured from the pressure-bonding surface and the extended pressure-bonding piece, and the butt portions through the opposed ends of the extended pressure-bonding piece are welded in the long length direction. Consequently, it is possible to configure a reliable sealed pressure-bonding section. Accordingly, the conductor portion of the insulated wire or the conductor portion is not exposed to the outside of the pressure-bonding section. Thus, it is possible to carry out the pressure-bonding into a wrapping state having water-blocking performance.

As an aspect of the present invention, furthermore, the butt portion can be obtained by butting end surfaces having larger areas than sectional areas of the other portions of the plate material.

The end surface has a concept including an end surface protruded toward a radial inward side, an end surface protruded toward a radial outward side or an end surface protruded toward the radial outward side and the radial inward side relative to the other portions, when the ring-shaped section is formed.

According to the present invention, even if the butt portion is thinned by the butt welding, the weld portion has sufficient strength. Therefore, even if the weld portion is deformed by the pressure-bonding of the conductor portion or the like, for example, it is possible to ensure sufficient welding strength, that is, sufficient water-blocking performance. In addition, in the case of the end surface protruded toward the radial inward side relative to the other portions, for example, the portion protruded toward the radial inward side relative to the other portions of the end surface bites into the conductor portion so that conductivity can be enhanced in the pressure-bonding state.

As an aspect of the present invention, moreover, the pressure-bonding section can be configured from a pressure-bonding surface on which the conductor portion is mounted and an extended pressure-bonding piece extended from both sides in a width direction of the pressure-bonding surface, and the extended pressure-bonding piece can be bent and configured to have a ring-shaped section, and opposed ends of the extended pressure-bonding piece can be superposed on each other and a superposition portion can be welded as an end of the plate material in the long length direction.

According to the present invention, the pressure-bonding section having the ring-shaped section is configured from the pressure-bonding surface and the extended pressure-bonding piece, and the superposition portions obtained by superposing the opposed ends of the extended pressure-bonding piece are welded in the long length direction. Consequently, it is possible to configure a reliable sealed pressure-bonding section. Accordingly, the conductor portion of the insulated wire or the conductor portion is not exposed to the outside of the pressure-bonding section. Thus, it is possible to carry out the pressure-bonding into a wrapping state having water-blocking performance.

As an aspect of the present invention, furthermore, the end of the plate material configuring the superposition portion can be configured more thinly than thicknesses of the other portions of the plate material.

According to the present invention, it is possible to reduce a fear that the welding cannot be sufficiently carried out due to an excessively great superposition thickness and to reliably perform welding, thereby ensuring the water-blocking performance.

As an aspect of the present invention, moreover, the superposition portion can be configured more thickly than the other portions of the plate material.

According to the present invention, even if the superposition portion is thinned by the welding, the weld portion has sufficient strength. Therefore, even if the weld portion is deformed by the pressure-bonding of the conductor portion or the like, for example, it is possible to ensure sufficient welding strength, that is, sufficient water-blocking performance.

According to an aspect of the present invention, furthermore, the welding can be carried out by fiber laser welding.

According to the present invention, a pressure-bonding section having no gap is configured. Consequently, it is possible to reliably prevent water intrusion into the inner part of the pressure-bonding section in the pressure-bonding state. As compared with another laser welding, moreover, the fiber laser welding can adjust a focal point into a minimum spot so that laser welding at a high output density can be realized and continuous irradiation can be carried out. Accordingly, it is possible to perform welding having reliable water-blocking performance.

Moreover, the fiber laser welding is performed in non-contact. Therefore, it is possible to hold strength in the pressure-bonding of the conductor portion in the pressure-bonding section. This will be described in more detail. In the case of contact welding such as ultrasonic welding or resistance welding, such mechanical pressure welding as to leave impression is required so that stress concentration occurs, resulting in reduction in material strength. Consequently, there is a fear that the pressure-bonding section might be damaged when the conductor portion is pressure-bonded. In the fiber laser welding to be the non-contact welding, however, the material strength is not reduced as compared with the mechanical pressure welding described above and the pressure-bonding section is not damaged in the pressure-bonding of the conductor portion. Consequently, water-blocking performance can be ensured and a stable pressure-bonding state can be maintained.

For example, a cost is increased when the welding is carried out as the contact welding through brazing, an anvil and a horn are required in the case of ultrasonic welding, and a space for inserting an electrode is required and facilities are also large-scaled in the case of resistance welding. In addition, there is a possibility that the mechanical strength of the weld portion might be reduced in the terminal pressure-bonding due to reduction in the thickness of a material by the pressure weld processing as described above.

On the other hand, it is supposed to propose welding through high energy density beam irradiation as the non-contact welding. A high density energy beam includes a laser, an electron beam and the like. The electron beam has a vacuum atmosphere. For this reason, a device scale is increased and a device is complicated. In the case of the laser welding, however, welding can be carried out in the atmosphere so that facilities can be made compact.

As an aspect of the present invention, furthermore, the conductor portion can be constituted by an aluminum based material, and at least the pressure-bonding section can be constituted by a copper based material.

According to the present invention, a weight can be reduced as compared with an insulated wire having a conductor portion formed by a copper wire, and so-called dissimilar metal contact corrosion (hereinafter referred to as galvanic corrosion) can be prevented by the reliable water-blocking performance.

This will be described in more detail. In the case in which a copper based material which is conventionally used in a conductor portion of an insulated wire is replaced with an aluminum based material such as aluminum or an aluminum alloy and a conductor portion formed by the aluminum based material is pressure-bonded to the crimp terminal, there is the following problem, specifically, a phenomenon in which the aluminum based material being a less noble metal is corroded by contact of a terminal material with a nobler metal material such as tin plating, gold plating or a copper alloy, that is, the galvanic corrosion.

The galvanic corrosion is a phenomenon in which corrosion electric current is generated and a less noble metal is corroded, dissolved, eliminated or the like when water sticks to a portion where a nobler metal material and the less noble metal are provided in contact with each other. By this phenomenon, a conductor portion formed by an aluminum based material pressure-bonded to the pressure-bonding section of the crimp terminal is corroded, dissolved and eliminated, and electric resistance is raised before long. As a result, there is a problem in that it is impossible to perform a sufficient conductive function.

However, it is possible to prevent so-called galvanic corrosion while reducing a weight as compared with an insulated wire having a conductor portion formed by a copper based material by the reliable water-blocking performance described above.

Moreover, the present invention provides a connection structural body wherein the insulated wire and the crimp terminal are connected to each other through the pressure-bonding section in the crimp terminal described above.

According to the present invention, it is possible to configure a connection structural body capable of ensuring the reliable water-blocking performance by simply carrying out surrounding and pressure-bonding through the pressure-bonding section of the crimp terminal. Accordingly, stable conductivity can be ensured. It is assumed that the connection structural body includes a wire harness configured from a single connection structural body having the insulated wire and the crimp terminal connected to each other or configured by bundling a plurality of connection structural bodies through the pressure-bonding section in the crimp terminal.

Furthermore, the present invention provides a connector having the crimp terminal in the connection structural body disposed in a connector housing.

According to the present invention, it is possible to connect the crimp terminal with stable conductivity ensured regardless of metal species configuring the crimp terminal and the conductor portion.

This will be described in more detail. For example, when a female connector and a male connector are fitted in each other and the crimp terminals disposed in the connector housings of the connectors are connected to each other, it is possible to connect the crimp terminals of the respective connectors to each other while ensuring the water-blocking performance.

As a result, it is possible to ensure a connection state having reliable conductivity.

Moreover, the present invention provides a method of manufacturing a crimp terminal including at least a pressure-bonding section for permitting pressure-bonding and connection to a conductor portion of an insulated wire, the method including: bending a plate material to take a hollow sectional shape; performing shape processing into a sealing shape for sealing one end side in a long length direction in the hollow sectional shape so as to superpose the plate materials on each other in a planar shape; welding an end of the plate material taking the hollow sectional shape in the long length direction; and carrying out welding in a direction intersecting with the long length direction between both ends in the long length direction in a sealing portion processed into the sealing shape, thereby configuring the pressure-bonding section.

According to the present invention, a pressing processing step of bending the plate material to take the hollow sectional shape and performing the shape processing into the sealing shape for sealing the one end side in the long length direction in the hollow sectional shape, and a welding step in the long length direction and the direction intersecting with the long length direction are carried out in this order. Therefore, the crimp terminal can be manufactured more efficiently.

Furthermore, the present invention provides a method of manufacturing a crimp terminal including at least a pressure-bonding section for permitting pressure-bonding and connection to a conductor portion of an insulated wire, the method including: bending a plate material to take a hollow sectional shape; welding an end of the plate material taking the hollow sectional shape in a long length direction; performing shape processing into a sealing shape for sealing one end side in the long length direction in the hollow sectional shape so as to superpose the plate materials on each other in a planar shape; and carrying out welding in a direction intersecting with the long length direction between both ends in the long length direction in a sealing portion processed into the sealing shape, thereby configuring the pressure-bonding section.

The superposition of plate materials, at least one of which including a hollow convex portion having one side in the long length direction sealed conceptually includes superposition of a plate material having a convex portion and a flat plate material and superposition of two plate materials each having a convex portion with hollow portions of the convex portions opposed to each other. The plate materials to be superposed conceptually include a mode in which a single plate material is bent so that a superposition portion acts as if two plate materials and superposition of two plate materials which are independent of each other.

According to the present invention, for example, a shape of a hollow concave portion can be formed into a shape corresponding to a diameter of the conductor portion. In a pressure-bonding state in which the conductor portion is inserted into the pressure-bonding section, it is possible to manufacture a crimp terminal capable of realizing a pressure-bonding state having high water-blocking performance with a small gap.

As an aspect of the present invention, furthermore, the welding can be carried out by fiber laser welding.

According to the present invention, a pressure-bonding section having no gap is configured. Consequently, it is possible to manufacture a crimp terminal capable of reliably preventing water from intruding an inner part of the pressure bonding section in the pressure-bonding state. This will be described in more detail. A fiber laser has high light condensing performance and high beam quality. As compared with a conventional laser, it is possible to quickly carry out deep penetration welding (keyhole welding) having a high aspect ratio with a lower output. Moreover, it is possible to perform processing with a small thermal effect and less deformation of a metallic material. Accordingly, welding having reliable water-blocking performance is carried out. Consequently, it is possible to manufacture a crimp terminal capable of ensuring sufficient water-blocking performance in the pressure-bonding state.

The present invention provides a crimp terminal including at least a pressure-bonding section for permitting pressure-bonding and connection to a conductor portion of an insulated wire, wherein the pressure-bonding section is configured from a plate material to take a hollow sectional shape and has the plate material welded in a long length direction in the hollow sectional shape, one end side in the long length direction in the hollow sectional shape is caused to take a sealing shape for sealing, welding is carried out in a direction intersecting with the long length direction at the one end side in the long length direction which is formed into the sealing shape for sealing, and a weld portion in the long length direction and a weld portion in the direction intersecting with the long length direction are set on almost the same plane.

According to the present invention, for example, one end side in the long length direction of the pressure-bonding section taking the hollow sectional shape is sealed. In the pressure-bonding state in which the conductor portion is pressure-bonded by the pressure-bonding section, consequently, it is possible to prevent water intrusion into an inner part, thereby ensuring reliable water-blocking performance. Moreover, the conductor portion in the pressure bonding section is not exposed to outside air but gradation or aged deterioration can be inhibited from being caused. Accordingly, corrosion does not occur in the conductor portion but electric resistance can also be prevented from being raised due to the corrosion. Therefore, it is possible to obtain stable conductivity. In other words, it is possible to ensure a stable electrical connection state.

This will be described in more detail. The pressure-bonding section is configured by the plate material to take the hollow sectional shape and the plate material is welded in the long length direction in the hollow sectional shape. When the conductor portion is to be pressure-bonded by the pressure-bonding section, therefore, the one end side in the long length direction of the pressure-bonding section taking the hollow sectional shape is sealed. Consequently, it is possible to carry out the pressure-bonding into a wrapping state with water-blocking performance without exposing the conductor portion of the insulated wire or the conductor portion to the outside of the pressure-bonding section.

The one end side in the long length direction in the hollow sectional shape implies an end side to be opposite to an insertion side for inserting the conductor portion into the pressure-bonding section.

The welding in the direction intersecting with the long length direction is welding in a width direction which is almost orthogonal to the long length direction, for example, and can be set to be welding continuous to the welding in the long length direction or welding not continuous but intersecting with the welding in the long length direction.

As described above, one end side in the long length direction in the hollow sectional shape is caused to take a sealing shape for sealing, welding is carried out in a direction intersecting with the long length direction at the one end side in the long length direction which is formed into the sealing shape for sealing, and therefore, by simply pressure-bonding the pressure-bonding section in which the conductor portion is inserted, it is possible to carry out the pressure-bonding into a wrapping state with water-blocking performance without exposing the conductor portion of the insulated wire or the conductor portion to the outside of the pressure-bonding section.

This will be described in more detail. The one end side in the long length direction in the hollow sectional shape is caused to take a sealing shape for sealing, and the welding is carried out in the direction intersecting with the long length direction at the one end side in the long length direction which is formed in the sealing shape for sealing. Therefore, portions other than an insertion portion for inserting the conductor portion to the pressure-bonding section taking the hollow sectional shape are sealed. By simply pressure-bonding the pressure-bonding section in which the conductor portion is inserted, it is possible to carry out the pressure-bonding in a wrapping state having water-blocking performance without exposing the conductor portion of the insulated wire or the conductor portion to the outside of the pressure-bonding section.

Moreover, a weld portion in the long length direction and a weld portion in the direction intersecting with the long length direction are set on almost the same plane; therefore, it is possible to reliably carry out the welding by readily moving a welding device such as laser welding, for example.

As an aspect of the present invention, furthermore, the weld portion in the long length direction can be changed in a height direction.

According to the present invention, it is possible to configure pressure-bonding sections having water-blocking performance which take various shapes.

As an aspect of the present invention, moreover, the pressure-bonding section can be configured from a pressure-bonding surface and an extended pressure-bonding piece extended from both sides in a width direction of the pressure-bonding surface, and the extended pressure-bonding piece can be bent and configured to have a ring-shaped section, and opposed ends of the extended pressure-bonding piece can be butted each other and a butt portion can be welded in the long length direction.

According to the present invention, the pressure-bonding section having the ring-shaped section is configured from the pressure-bonding surface and the extended pressure-bonding piece, and the butt portions through the opposed ends of the extended pressure-bonding piece are welded in the long length direction. Consequently, it is possible to configure a reliable sealed pressure-bonding section. Accordingly, the conductor portion of the insulated wire or the conductor portion is not exposed to the outside of the pressure-bonding section. Thus, it is possible to carry out the pressure-bonding into a wrapping state having water-blocking performance.

As an aspect of the present invention, furthermore, the butt portion can be obtained by butting end surfaces having larger areas than sectional areas of the other portions of the plate material.

The end surface has a concept including an end surface protruded toward a radial inward side, an end surface protruded toward a radial outward side or an end surface protruded toward the radial outward side and the radial inward side relative to the other portions, when the ring-shaped section is formed.

According to the present invention, even if the butt portion is thinned by the butt welding, the weld portion has sufficient strength. Therefore, even if the weld portion is deformed by the pressure-bonding of the conductor portion or the like, for example, it is possible to ensure sufficient welding strength, that is, sufficient water-blocking performance. In addition, in the case of the end surface protruded toward the radial inward side relative to the other portions, for example, the portion protruded toward the radial inward side relative to the other portions of the end surface bites into the conductor portion so that conductivity can be enhanced in the pressure-bonding state.

As an aspect of the present invention, moreover, the pressure-bonding section can be configured from a pressure-bonding surface on which the conductor portion is mounted and an extended pressure-bonding piece extended from both sides in a width direction of the pressure-bonding surface, and the extended pressure-bonding piece can be bent and configured to have a ring-shaped section, and opposed ends of the extended pressure-bonding piece can be superposed on each other and a superposition portion can be welded as an end of the plate material in the long length direction.

According to the present invention, the pressure-bonding section having the ring-shaped section is configured from the pressure-bonding surface and the extended pressure-bonding piece, and the superposition portions obtained by superposing the opposed ends of the extended pressure-bonding piece are welded in the long length direction. Consequently, it is possible to configure a reliable sealed pressure-bonding section. Accordingly, the conductor portion of the insulated wire or the conductor portion is not exposed to the outside of the pressure-bonding section. Thus, it is possible to carry out the pressure-bonding into a wrapping state having water-blocking performance.

As an aspect of the present invention, furthermore, the end of the plate material configuring the superposition portion can be configured more thinly than thicknesses of the other portions of the plate material.

According to the present invention, it is possible to reduce a fear that the welding cannot be sufficiently carried out due to an excessively great superposition thickness and to reliably perform welding, thereby ensuring the water-blocking performance.

As an aspect of the present invention, moreover, the superposition portion can be configured more thickly than the other portions of the plate material.

According to the present invention, even if the superposition portion is thinned by the welding, the weld portion has sufficient strength. Therefore, even if the weld portion is deformed by the pressure-bonding of the conductor portion or the like, for example, it is possible to ensure sufficient welding strength, that is, sufficient water-blocking performance.

According to an aspect of the present invention, furthermore, the welding can be carried out by fiber laser welding.

According to the present invention, a pressure-bonding section having no gap is configured. Consequently, it is possible to reliably prevent water intrusion into the inner part of the pressure-bonding section in the pressure-bonding state. As compared with another laser welding, moreover, the fiber laser welding can adjust a focal point into a minimum spot so that laser welding at a high output density can be realized and continuous irradiation can be carried out. Accordingly, it is possible to perform welding having reliable water-blocking performance.

Moreover, the fiber laser welding is performed in non-contact. Therefore, it is possible to hold strength in the pressure-bonding of the conductor portion in the pressure-bonding section. This will be described in more detail. In the case of contact welding such as ultrasonic welding or resistance welding, such mechanical pressure welding as to leave impression is required so that stress concentration occurs, resulting in reduction in material strength. Consequently, there is a fear that the pressure-bonding section might be damaged when the conductor portion is pressure-bonded. In the fiber laser welding to be the non-contact welding, however, the material strength is not reduced as compared with the mechanical pressure welding described above and the pressure-bonding section is not damaged in the pressure-bonding of the conductor portion. Consequently, water-blocking performance can be ensured and a stable pressure-bonding state can be maintained.

For example, a cost is increased when the welding is carried out as the contact welding through brazing, an anvil and a horn are required in the case of ultrasonic welding, and a space for inserting an electrode is required and facilities are also large-scaled in the case of resistance welding. In addition, there is a possibility that the mechanical strength of the weld portion might be reduced in the terminal pressure-bonding due to reduction in the thickness of a material by the pressure weld processing as described above.

On the other hand, it is supposed to propose welding through high energy density beam irradiation as the non-contact welding. A high density energy beam includes a laser, an electron beam and the like. The electron beam has a vacuum atmosphere. For this reason, a device scale is increased and a device is complicated. In the case of the laser welding, however, welding can be carried out in the atmosphere so that facilities can be made compact.

As an aspect of the present invention, furthermore, the conductor portion can be constituted by an aluminum based material, and at least the pressure-bonding section can be constituted by a copper based material.

According to the present invention, a weight can be reduced as compared with an insulated wire having a conductor portion formed by a copper wire, and so-called dissimilar metal contact corrosion (hereinafter referred to as galvanic corrosion) can be prevented by the reliable water-blocking performance.

This will be described in more detail. In the case in which a copper based material which is conventionally used in a conductor portion of an insulated wire is replaced with an aluminum based material such as aluminum or an aluminum alloy and a conductor portion formed by the aluminum based material is pressure-bonded to the crimp terminal, there is the following problem, specifically, a phenomenon in which the aluminum based material being a less noble metal is corroded by contact of a terminal material with a nobler metal material such as tin plating, gold plating or a copper alloy, that is, the galvanic corrosion.

The galvanic corrosion is a phenomenon in which corrosion electric current is generated and a less noble metal is corroded, dissolved, eliminated or the like when water sticks to a portion where a nobler metal material and the less noble metal are provided in contact with each other. By this phenomenon, a conductor portion formed by an aluminum based material pressure-bonded to the pressure-bonding section of the crimp terminal is corroded, dissolved and eliminated, and electric resistance is raised before long. As a result, there is a problem in that it is impossible to perform a sufficient conductive function.

However, it is possible to prevent so-called galvanic corrosion while reducing a weight as compared with an insulated wire having a conductor portion formed by a copper based material by the reliable water-blocking performance described above.

Moreover, the present invention provides a connection structural body wherein the insulated wire and the crimp terminal are connected to each other through the pressure-bonding section in the crimp terminal described above.

According to the present invention, it is possible to configure a connection structural body capable of ensuring the reliable water-blocking performance by simply carrying out surrounding and pressure-bonding through the pressure-bonding section of the crimp terminal. Accordingly, stable conductivity can be ensured. It is assumed that the connection structural body includes a wire harness configured from a single connection structural body having the insulated wire and the crimp terminal connected to each other or configured by bundling a plurality of connection structural bodies through the pressure-bonding section in the crimp terminal.

Furthermore, the present invention provides a connector having the crimp terminal in the connection structural body disposed in a connector housing.

According to the present invention, it is possible to connect the crimp terminal with stable conductivity ensured regardless of metal species configuring the crimp terminal and the conductor portion.

This will be described in more detail. For example, when a female connector and a male connector are fitted in each other and the crimp terminals disposed in the connector housings of the connectors are connected to each other, it is possible to connect the crimp terminals of the respective connectors to each other while ensuring the water-blocking performance.

As a result, it is possible to ensure a connection state having reliable conductivity.

Furthermore, the present invention provides a method of manufacturing a crimp terminal including at least a pressure-bonding section for permitting pressure-bonding and connection to a conductor portion of an insulated wire, the method including: bending a plate material to take a hollow sectional shape and performing shape processing into a sealing shape for sealing one end side in a long length direction in the hollow sectional shape; welding an end of the plate material forming the hollow sectional shape in the long length direction; and welding the one end side subjected to the shape processing into the sealing shape in a direction intersecting with the long length direction, thereby configuring the pressure-bonding section.

According to the present invention, a pressing processing step of bending the plate material to take the hollow sectional shape and performing the shape processing into the sealing shape for sealing the one end side in the long length direction in the hollow sectional shape, and a welding step in the long length direction and the direction intersecting with the long length direction are carried out in this order. Therefore, the crimp terminal can be manufactured more efficiently.

Moreover, the present invention provides a method of manufacturing a crimp terminal including at least a pressure-bonding section for permitting pressure-bonding and connection to a conductor portion of an insulated wire, the method including: bending a plate material to take a hollow sectional shape and welding an end of the plate material forming the hollow sectional shape in a long length direction; and subjecting one end side in the long length direction in the hollow sectional shape to shape processing into a sealing shape for sealing, and welding the one end side subjected to the shape processing into the sealing shape in a direction intersecting with the long length direction, thereby configuring the pressure-bonding section.

According to the present invention, the plate material is bent to take the hollow sectional shape, and the end of the plate material is welded in the long length direction and the shape processing is then carried out into the sealing shape for sealing the one end side in the long length direction, and the welding is performed in the direction intersecting with the long length direction. Therefore, it is possible to manufacture crimp terminals having various sealing shapes.

Moreover, the present invention provides a method of manufacturing a crimp terminal including at least a pressure-bonding section for permitting pressure-bonding and connection to a conductor portion of an insulated wire, the method including: superposing plate materials, at least one of which including a hollow convex portion having one side in a long length direction sealed; and carrying out welding in the long length direction and a direction intersecting with the long length direction to surround the convex portion at an outside of the convex portion, thereby configuring the pressure-bonding section.

The superposition of plate materials, at least one of which including a hollow convex portion having one side in the long length direction sealed conceptually includes superposition of a plate material having a convex portion and a flat plate material and superposition of two plate materials each having a convex portion with hollow portions of the convex portions opposed to each other. The plate materials to be superposed conceptually include a mode in which a single plate material is bent so that a superposition portion acts as if two plate materials and superposition of two plate materials which are independent of each other.

According to the present invention, for example, a shape of a hollow concave portion can be formed into a shape corresponding to a diameter of the conductor portion. In a pressure-bonding state in which the conductor portion is inserted into the pressure-bonding section, it is possible to manufacture a crimp terminal capable of realizing a pressure-bonding state having high water-blocking performance with a small gap.

As an aspect of the present invention, furthermore, the welding can be carried out by fiber laser welding.

According to the present invention, a pressure-bonding section having no gap is configured. Consequently, it is possible to manufacture a crimp terminal capable of reliably preventing water from intruding an inner part of the pressure bonding section in the pressure-bonding state. This will be described in more detail. A fiber laser has high light condensing performance and high beam quality. As compared with a conventional laser, it is possible to quickly carry out deep penetration welding (keyhole welding) having a high aspect ratio with a lower output. Moreover, it is possible to perform processing with a small thermal effect and less deformation of a metallic material. Accordingly, welding having reliable water-blocking performance is carried out. Consequently, it is possible to manufacture a crimp terminal capable of ensuring sufficient water-blocking performance in the pressure-bonding state.

The present invention provides a crimp terminal including at least a pressure-bonding section for permitting pressure-bonding and connection to a conductor portion of an insulated wire, wherein the pressure-bonding section is configured such that a plate material is bent in a width direction to take a hollow sectional shape, and ends in the width direction of the plate material are butted and a butt portion in a long length direction in which the ends are butted is welded in the long length direction, a welding bead is formed through the welding on both of surface and back face sides in, among weld portions welded in the long length direction, at least a portion that is to be pressure-bonded and deformed for pressure-bonding and connection to the conductor portion, one end side in the long length direction in the hollow sectional shape is caused to take a sealing shape for sealing, welding is carried out in a direction intersecting with the long length direction at the one end side in the long length direction which is formed into the sealing shape for sealing, and a weld portion in the long length direction and a weld portion in the direction intersecting with the long length direction are set on almost the same plane.

The crimp terminal is a closed barrel terminal having a pressure-bonding section taking a hollow sectional shape and includes a connection terminal having a connecting portion for permitting connection to a connecting portion of the other terminal of a terminal set configured in a pair or a terminal configured by only a pressure-bonding section.

The long length direction can be set to be a direction which is almost coincident with the long length direction of the insulated wire to be pressure-bonded to the pressure-bonding section.

The butt of the ends in the width direction of the plate material conceptually includes butt having a small gap in the width direction as well as butt in which contact is made in the width direction in the hollow sectional shape formed by bending the plate material in the width direction. Moreover, it is possible to butt inclined side surfaces obtained by inclining end side surfaces or side surfaces configuring surfaces having heights which are equal to or greater than the thickness of the plate material as well as the side surfaces in a plate thickness direction in the plate material.

The at least a portion that is to be pressure-bonded and deformed for pressure-bonding and connection to the conductor portion among weld portions welded in the long length direction conceptually indicates a full range in the long length direction in the case in which a whole body is pressure-bonded and deformed, and indicates only a deformed part or a full range including the deformed part in the case in which only a part of the side where the conductor portion is to be inserted is pressure-bonded and deformed.

According to the present invention, the conductor portion can be reliably pressure-bonded through the pressure-bonding section so that a crimp terminal capable of obtaining stable conductivity can be configured.

This will be described in more detail. The applicant proposes, as a method of preventing reduction in conductivity in a pressure-bonding section due to intrusion of water, a connection structural body (see Patent Document 1) in which an exposed part in a conductor portion is closed with an insulating cover formed by a resin having high viscosity in a pressure-bonding state in which the conductor portion is pressure-bonded through a pressure-bonding section, for example.

However, the connection structural body in the Patent Document 1 is a so-called open barrel type crimp terminal and an insulating cover is exposed. For this reason, there is a fear that water-blocking performance might be reduced due to aged deterioration of a resin material itself, resulting in decrease in conductivity.

Therefore, the formation of the welding bead through the welding on both of the surface and back face sides of a portion to be pressure-bonded and deformed implies that at least most of a section in a front/back direction of the weld portion is welded. Accordingly, the plate material is bent in the width direction to take the hollow sectional shape, and the weld portion of the pressure-bonding section where the ends are welded in the long length direction has sufficient proof strength to pressure-bonding force for pressure-bonding the conductor portion through the pressure-bonding section. Therefore, it is prevented from being broken by pressure-bonding and deformation. Accordingly, it is possible to reliably pressure-bond the conductor portion of the insulated wire through the pressure-bonding section, thereby obtaining stable conductivity. In other words, it is possible to ensure a stable electrical connection state.

Moreover, the one end side in the long length direction in the hollow sectional shape implies an end side to be opposite to an insertion side for inserting the conductor portion into the pressure-bonding section.

The welding in the direction intersecting with the long length direction is welding in a width direction which is almost orthogonal to the long length direction, for example, and can be set to be welding continuous to the welding in the long length direction or welding not continuous but intersecting with the welding in the long length direction. The formation of the sealing shape and the welding in the direction intersecting with the long length direction may be carried out in a state of a single crimp terminal or the sealing shape may be formed together with the pressure-bonding and deformation of the pressure-bonding section to the conductor portion and the welding intersecting with the long length direction may be then performed.

Moreover, as described above, one end side in the long length direction in the hollow sectional shape is caused to take a sealing shape for sealing, welding is carried out in a direction intersecting with the long length direction at the one end side in the long length direction which is formed into the sealing shape for sealing, thereby configuring a sealing portion; therefore, by simply pressure-bonding the pressure-bonding section in which the conductor portion is inserted, it is possible to carry out the pressure-bonding into a wrapping state with water-blocking performance without exposing the conductor portion of the insulated wire or the conductor portion to the outside of the pressure-bonding section.

This will be described in more detail. Even if the pressure-bonding section is pressure-bonded and deformed in order to pressure-bond the conductor portion, the welding bead is formed by the welding on both of the surface and back sides in, among weld portions welded in the long length direction, at least a portion which is to be pressure-bonded and deformed for the pressure-bonding and connection to the conductor portion, the weld is not broken by the pressure-bonding and deformation, the welding is carried out in the direction intersecting with the long length direction to configure the sealing portion at one end side in the long length direction of the hollow sectional shape which is formed to take a sealing shape for sealing. Therefore, portions other than the insertion portion for inserting the conductor portion into the pressure-bonding section taking the hollow sectional shape are sealed. Consequently, it is possible to prevent water intrusion into an inner part without exposing the conductor portion in the pressure-bonding section to outside air. Thus, it is possible to inhibit degradation or aged deterioration from being caused. Therefore, corrosion does not occur in the conductor portion and to prevent a rise in electric resistance from being caused by the corrosion. Consequently, stable conductivity can be obtained.

Since the sealing shape is previously formed for sealing the one end side in the long length direction in the hollow sectional shape and the welding is carried out in the direction intersecting with the long length direction, thereby configuring the sealing portion, the portions other than the insertion portion for inserting the conductor portion into the pressure-bonding section taking the hollow sectional shape are sealed. By simply pressure-bonding the pressure-bonding section in which the conductor portion is inserted, it is possible to carry out the pressure-bonding into a wrapping state with water-blocking performance without exposing the conductor portion of the insulated wire or the conductor portion to the outside of the pressure-bonding section. In order to ensure the water-blocking performance, accordingly, it is possible to reliably prevent the conductor portion pressure-bonded to the pressure-bonding section from being exposed to the outside air without using a cap configured by a separate component in the conductor portion.

Moreover, as described above, a weld portion in the long length direction and a weld portion in the direction intersecting with the long length direction are set on almost the same plane; therefore, for example, it is possible to reliably carry out the welding by readily moving a welding device such as laser welding, for example. This will be described in more detail. A distance between the welding device and the weld portion is constant. Therefore, it is possible to carry out the welding in a stable welding state. Thus, the welding can reliably be performed.

As an aspect of the present invention, moreover, the welding bead can be formed on the both of surface and back face sides by penetration welding.

According to the present invention, the welding is carried out in a whole sectional region in a front/back direction of the weld portion. Therefore, it is possible to configure a weld portion which has more sufficient proof strength to pressure-bonding force for pressure-bonding the conductor portion through the pressure-bonding section and in which stress does not concentrate. This will be described in more detail. In the case of non-penetration welding, a difference in hardness between the weld portion and the base material or a local difference in bending workability against the pressure-bonding or the like is made in the front/back direction. For this reason, stress is added to the weld portion in application of pressure-bonding force so that breakage tends to occur. However, the continuous weld portion is formed in the front/back direction through the penetration welding. Therefore, it is possible to form the long length direction weld portion which is hard to break and has sufficient proof strength. Accordingly, the conductor portion of the insulated wire is pressure-bonded more reliably through the pressure-bonding section so that more stable conductivity can be obtained.

As an aspect of the present invention, furthermore, it is possible to carry out the welding by using a high energy density beam.

The high energy density beam includes a laser beam generated by a fiber laser, a YAG laser, a semiconductor laser, a disk laser or the like, or an electron beam.

According to the present invention, it is possible to carry out welding with high precision at a high aspect ratio. Accordingly, it is possible to realize a welding state with less deformation of a terminal material.

Moreover, the welding using the high energy density beam is performed in non-contact. Therefore, it is possible to hold strength in the pressure-bonding of the conductor portion in the pressure-bonding section. This will be described in more detail. In the case of contact welding such as ultrasonic welding or resistance welding, such mechanical pressure welding as to leave impression is required so that stress concentration occurs, resulting in reduction in material strength. Consequently, there is a fear that the pressure-bonding section might be damaged when the conductor portion is to be pressure-bonded. In the welding using the high energy density beam which is the non-contact welding, however, the material strength is not reduced as compared with the mechanical pressure welding described above and the pressure-bonding section is not damaged in the pressure-bonding of the conductor portion. Consequently, water-blocking performance can be ensured so that a stable pressure-bonding state can be maintained.

As an aspect of the present invention, moreover, the high energy density beam can be configured from a fiber laser beam.

The fiber laser beam includes a fiber laser beam to be continuously oscillated, pulse oscillated, QCW oscillated or continuously oscillated through pulse control.

According to the present invention, it is possible to easily carry out deep penetration welding. This will be described in more detail. The fiber laser is excellent in beam quality and has high light condensing performance. Therefore, it is possible to realize high output density processing. Accordingly, it is possible to efficiently bring a reliable welding state without giving extra thermal effects to a material by deep penetration welding having a high aspect ratio.

For example, a cost is increased when the welding is carried out as the contact welding through brazing, an anvil and a horn are required in the case of ultrasonic welding, and a space for inserting an electrode is required and facilities are also large-scaled in the case of resistance welding. In addition, there is a fear that the mechanical strength of the weld portion might be reduced in the terminal pressure bonding due to decrease in the thickness of a material by the pressure weld processing as described above. However, the laser welding to be non-contact welding can be carried out in the atmosphere so that facilities can be made compact.

Furthermore, the present invention provides a connection structural body in which the insulated wire and the crimp terminal are connected to each other through the pressure-bonding section in the crimp terminal.

According to the present invention, it is possible to configure a connection structural body capable of ensuring the reliable water-blocking performance by simply carrying out surrounding and pressure-bonding through the pressure-bonding section of the crimp terminal. Accordingly, stable conductivity can be ensured. The connection structural body includes a wire harness configured from a single connection structural body having the insulated wire and the crimp terminal connected to each other or configured by bundling a plurality of connection structural bodies through the pressure-bonding section in the crimp terminal.

As an aspect of the present invention, the conductor portion can be constituted by an aluminum based material, and at least the pressure-bonding section can be constituted by a copper based material.

According to the present invention, a weight can be reduced as compared with an insulated wire having a conductor portion formed by a copper wire, and so-called dissimilar metal contact corrosion (hereinafter referred to as galvanic corrosion) can be prevented by the reliable water-blocking performance.

This will be described in more detail. In the case in which a copper based material which is conventionally used in a conductor portion of an insulated wire is replaced with an aluminum based material such as aluminum or an aluminum alloy, and the conductor portion formed by the aluminum based material is pressure-bonded to a crimp terminal, there is the following problem, specifically, a phenomenon in which the aluminum based material being a less noble metal is corroded by contact of a terminal material with a nobler metal material such as tin plating, gold plating or a copper alloy, that is, the galvanic corrosion.

The galvanic corrosion is a phenomenon in which corrosion electric current is generated and a less noble metal is corroded, dissolved, eliminated or the like when water sticks to a portion in which a nobler metal material and the less noble metal are provided in contact with each other. By this phenomenon, a conductor portion formed by an aluminum based material pressure-bonded to the pressure-bonding section of the crimp terminal is corroded, dissolved and eliminated, and electric resistance is raised before long. As a result, there is a problem in that it is impossible to perform a sufficient conductive function.

However, it is possible to prevent so-called galvanic corrosion while reducing a weight as compared with an insulated wire having a conductor portion formed by a copper-based material through the reliable water-blocking performance.

Furthermore, the present invention provides a connector having the crimp terminal in the connection structural body disposed in a connector housing.

According to the present invention, it is possible to connect the crimp terminal with stable conductivity ensured regardless of metal species configuring the crimp terminal and the conductor portion.

This will be described in more detail. For example, when a female connector and a male connector are fitted in each other and the crimp terminals disposed in the connector housings of the connectors are connected to each other, it is possible to connect the crimp terminals of the respective connectors to each other while ensuring the water-blocking performance.

As a result, it is possible to ensure a connection state having reliable conductivity.

The present invention provides a crimp terminal including at least a pressure-bonding section for permitting pressure-bonding and connection to a conductor portion of an insulated wire, wherein the pressure-bonding section is configured such that a plate material is bent in a width direction to take a hollow sectional shape, and ends in the width direction of the plate material are superposed on each other and a superposition portion in a long length direction in which the ends are superposed on each other is welded in the long length direction, a welding bead is formed through the welding on both of surface and back face sides in, among superposition portions welded in the long length direction, at least a portion that is to be pressure-bonded and deformed for pressure-bonding and connection to the conductor portion, one end side in the long length direction in the hollow sectional shape is caused to take a sealing shape for sealing, welding is carried out in a direction intersecting with the long length direction at the one end side in the long length direction which is formed into the sealing shape for sealing, thereby configuring a sealing portion, and a weld portion in the long length direction and a weld portion in the direction intersecting with the long length direction are set on almost the same plane.

The crimp terminal is a closed barrel terminal having a pressure-bonding section taking a hollow sectional shape and includes a connection terminal having a connecting portion for permitting connection to a connecting portion of the other terminal of a terminal set configured in a pair or a terminal configured by only a pressure-bonding section.

The long length direction can be set to be a direction which is almost coincident with the long length direction of the insulated wire to be pressure-bonded to the pressure-bonding section.

The at least a portion that is to be pressure-bonded and deformed for pressure-bonding and connection to the conductor portion among weld portions welded in the long length direction conceptually indicates a full range in the long length direction in the case in which a whole body is pressure-bonded and deformed, and indicates only a deformed part or a full range including the deformed part in the case in which only a part of the side where the conductor portion is to be inserted is pressure-bonded and deformed.

According to the present invention, the conductor portion can be reliably pressure-bonded through the pressure-bonding section so that a crimp terminal capable of obtaining stable conductivity can be configured.

This will be described in more detail. The applicant proposes, as a method of preventing reduction in conductivity in a pressure-bonding section due to intrusion of water, a connection structural body (see Patent Document 1) in which an exposed part in a conductor portion is closed with an insulating cover formed by a resin having high viscosity in a pressure-bonding state in which the conductor portion is pressure-bonded in a pressure-bonding section, for example.

However, the connection structural body in the Patent Document 1 is a so-called open barrel type crimp terminal and an insulating cover is exposed. For this reason, there is a fear that water-blocking performance might be reduced due to aged deterioration of a resin material itself, resulting in decrease in conductivity.

Therefore, the formation of the welding bead through the welding on both of the surface and back face sides of a portion to be pressure-bonded and deformed implies that the section in a front/back direction of the weld portion is welded continuously. In the weld portion of the pressure-bonding section where the plate material is bent in the width direction to take the hollow sectional shape and the ends are welded in the long length direction, accordingly, stress does not concentrate in the pressure-bonding of the conductor portion through the pressure-bonding section so that it is not broken by pressure-bonding and deformation. Therefore, it is possible to reliably pressure-bond the conductor portion of the insulated wire through the pressure-bonding section, thereby obtaining stable conductivity. In other words, it is possible to ensure a stable electrical connection state.

The one end side in the long length direction in the hollow sectional shape implies an end side to be opposite to an insertion side for inserting the conductor portion into the pressure-bonding section.

The welding in the direction intersecting with the long length direction is welding in a width direction which is almost orthogonal to the long length direction, for example, and can be set to be welding continuous to the welding in the long length direction or welding not continuous but intersecting with the welding in the long length direction. The formation of the sealing shape and the welding in the direction intersecting with the long length direction may be carried out in a state of a single crimp terminal or the sealing shape may be formed together with the pressure-bonding and deformation of the pressure-bonding section to the conductor portion and the welding intersecting with the long length direction may be then performed.

Moreover, as described above, one end side in the long length direction in the hollow sectional shape is caused to take a sealing shape for sealing, welding is carried out in a direction intersecting with the long length direction at the one end side in the long length direction which is formed into the sealing shape for sealing, thereby configuring a sealing portion, and therefore, by simply pressure-bonding the pressure-bonding section in which the conductor portion is inserted, it is possible to carry out the pressure-bonding into a wrapping state with water-blocking performance without exposing the conductor portion of the insulated wire or the conductor portion to the outside of the pressure-bonding section.

This will be described in more detail. Even if the pressure-bonding section is pressure-bonded and deformed in order to pressure-bond the conductor portion, the welding bead is formed by the welding on both of the surface and back sides in, among weld portions welded in the long length direction, at least a portion which is to be pressure-bonded and deformed for the pressure-bonding and connection to the conductor portion, the weld is not broken by the pressure-bonding and deformation, the welding is carried out in the direction intersecting with the long length direction to configure the sealing portion at one end side in the long length direction of the hollow sectional shape which is formed to take a sealing shape for sealing. Therefore, portions other than the insertion portion for inserting the conductor portion into the pressure-bonding section taking the hollow sectional shape are sealed. Consequently, it is possible to prevent water intrusion into an inner part without exposing the conductor portion in the pressure-bonding section to outside air. Thus, it is possible to inhibit degradation or aged deterioration from being caused. Therefore, corrosion does not occur in the conductor portion and to prevent a rise in electric resistance from being caused by the corrosion. Consequently, stable conductivity can be obtained.

Since the sealing shape is previously formed for sealing the one end side in the long length direction in the hollow sectional shape and the welding is carried out in the direction intersecting with the long length direction, thereby configuring the sealing portion, the portions other than the insertion portion for inserting the conductor portion into the pressure-bonding section taking the hollow sectional shape are sealed. By simply pressure-bonding the pressure-bonding section in which the conductor portion is inserted, it is possible to carry out the pressure-bonding into a wrapping state with water-blocking performance without exposing the conductor portion of the insulated wire or the conductor portion to the outside of the pressure-bonding section. In order to ensure the water-blocking performance, accordingly, it is possible to reliably prevent the conductor portion pressure-bonded to the pressure-bonding section from being exposed to the outside air without using a cap configured by a separate component in the conductor portion.

Moreover, as described above, a weld portion in the long length direction and a weld portion in the direction intersecting with the long length direction is set on almost the same plane; therefore, for example, it is possible to reliably carry out the welding by readily moving a welding device such as laser welding, for example. This will be described in more detail. A distance between the welding device and the weld portion is constant. Therefore, it is possible to carry out the welding in a stable welding state. Thus, the welding can reliably be performed.

As an aspect of the present invention, the ends of the plate material configuring the superposition portion can be configured more thinly than the other portions of the plate material.

According to the present invention, it is possible to reduce a fear that the welding cannot be sufficiently carried out due to an excessively great superposition thickness and to reliably perform welding, thereby ensuring the water-blocking performance.

As an aspect of the present invention, moreover, the superposition portion can be configured more thickly than the thicknesses of the other portions of the plate material.

According to the present invention, even if the superposition portion is thinned by the welding, the weld portion has sufficient strength. Therefore, even if the weld portion is deformed by the pressure-bonding of the conductor portion or the like, for example, it is possible to ensure sufficient welding strength, that is, sufficient water-blocking performance.

As an aspect of the present invention, moreover, the welding bead can be formed on the both of surface and back face sides by penetration welding.

According to the present invention, the welding is carried out in a whole sectional region in a front/back direction of the weld portion. Therefore, it is possible to configure a weld portion which has more sufficient proof strength to pressure-bonding force for pressure-bonding the conductor portion through the pressure-bonding section and in which stress does not concentrate. This will be described in more detail. In the case of non-penetration welding, a difference in hardness between the weld portion and the base material or a local difference in bending workability against the pressure-bonding or the like is made in the front/back direction. For this reason, stress is added to the weld portion in application of pressure-bonding force so that breakage tends to occur. However, the continuous weld portion is formed in the front/back direction through the penetration welding. Therefore, it is possible to form the long length direction weld portion which is hard to break and has sufficient proof strength. Accordingly, the conductor portion of the insulated wire is pressure-bonded more reliably through the pressure-bonding section so that more stable conductivity can be obtained.

As an aspect of the present invention, furthermore, it is possible to carry out the welding by using a high energy density beam.

The high energy density beam includes a laser beam generated by a fiber laser, a YAG laser, a semiconductor laser, a disk laser or the like, or an electron beam.

According to the present invention, it is possible to carry out welding with high precision at a high aspect ratio. Accordingly, it is possible to realize a welding state with less deformation of a terminal material.

Moreover, the welding using the high energy density beam is performed in non-contact. Therefore, it is possible to hold strength in the pressure-bonding of the conductor portion in the pressure-bonding section. This will be described in more detail. In the case of contact welding such as ultrasonic welding or resistance welding, such mechanical pressure welding as to leave impression is required so that stress concentration occurs, resulting in reduction in material strength. Consequently, there is a fear that the pressure-bonding section might be damaged when the conductor portion is to be pressure-bonded. In the welding using the high energy density beam which is the non-contact welding, however, the material strength is not reduced as compared with the mechanical pressure welding described above and the pressure-bonding section is not damaged in the pressure-bonding of the conductor portion. Consequently, water-blocking performance can be ensured so that a stable pressure-bonding state can be maintained.

As an aspect of the present invention, moreover, the high energy density beam can be configured from a fiber laser beam.

The fiber laser beam includes a fiber laser beam to be continuously oscillated, pulse oscillated, QCW oscillated or continuously oscillated through pulse control.

According to the present invention, it is possible to easily carry out deep penetration welding. This will be described in more detail. The fiber laser is excellent in beam quality and has high light condensing performance. Therefore, it is possible to realize high output density processing. Accordingly, it is possible to efficiently bring a reliable welding state without giving extra thermal effects to a material by deep penetration welding having a high aspect ratio.

For example, a cost is increased when the welding is carried out as the contact welding through brazing, an anvil and a horn are required in the case of ultrasonic welding, and a space for inserting an electrode is required and facilities are also large-scaled in the case of resistance welding. In addition, there is a fear that the mechanical strength of the weld portion might be reduced in the terminal pressure-bonding due to decrease in the thickness of a material by the pressure weld processing as described above. However, the laser welding to be non-contact welding can be carried out in the atmosphere so that facilities can be made compact.

Moreover, the present invention provides a connection structural body in which the insulated wire and the crimp terminal are connected to each other through the pressure-bonding section in the crimp terminal.

According to the present invention, it is possible to configure a connection structural body capable of ensuring the reliable water-blocking performance by simply carrying out surrounding and pressure-bonding through the pressure-bonding section of the crimp terminal. Accordingly, stable conductivity can be ensured. It is assumed that the connection structural body includes a wire harness configured from a single connection structural body having the insulated wire and the crimp terminal connected to each other or configured by bundling a plurality of connection structural bodies through the pressure-bonding section in the crimp terminal.

As an aspect of the present invention, the conductor portion can be constituted by an aluminum based material, and at least the pressure-bonding section can be constituted by a copper based material.

According to the present invention, a weight can be reduced as compared with an insulated wire having a conductor portion formed by a copper wire, and so-called dissimilar metal contact corrosion (hereinafter referred to as galvanic corrosion) can be prevented by the reliable water-blocking performance.

This will be described in more detail. In the case in which a copper based material which is conventionally used in a conductor portion of an insulated wire is replaced with an aluminum based material such as aluminum or an aluminum alloy, and the conductor portion formed by the aluminum based material is pressure-bonded to a crimp terminal, there is the following problem, specifically, a phenomenon in which the aluminum based material being a less noble metal is corroded by contact of a terminal material with a nobler metal material such as tin plating, gold plating or a copper alloy, that is galvanic corrosion.

The galvanic corrosion is a phenomenon in which corrosion electric current is generated and a less noble metal is corroded, dissolved, eliminated or the like when water sticks to a portion in which a nobler metal material and the less noble metal are provided in contact with each other. By this phenomenon, a conductor portion formed by an aluminum based material pressure-bonded to the pressure-bonding section of the crimp terminal is corroded, dissolved and eliminated, and electric resistance is raised before long. As a result, there is a problem in that it is impossible to perform a sufficient conductive function.

However, it is possible to prevent so-called galvanic corrosion while reducing a weight as compared with an insulated wire having a conductor portion formed by a copper-based material by the reliable water-blocking performance.

Furthermore, the present invention provides a connector having the crimp terminal in the connection structural body disposed in a connector housing.

According to the present invention, it is possible to connect the crimp terminal with stable conductivity ensured regardless of metal species configuring the crimp terminal and the conductor portion.

This will be described in more detail. For example, when a female connector and a male connector are fitted in each other and the crimp terminals disposed in the connector housings of the connectors are connected to each other, it is possible to connect the crimp terminals of the respective connectors to each other while ensuring the water-blocking performance.

As a result, it is possible to ensure a connection state having reliable conductivity.

The present invention provides a method of manufacturing a crimp terminal including at least a pressure-bonding section for permitting pressure-bonding and connection to a conductor portion of an insulated wire, the method including: bending a plate material to take a hollow sectional shape; and welding an end of the plate material taking the hollow sectional shape in a long length direction and forming the pressure-bonding section having a welding bead through the welding formed on both of surface and back face sides in, among weld portions welded in the long length direction, at least a portion that is to be pressure-bonded and deformed for pressure-bonding and connection to the conductor portion, wherein the welding in the long length direction is carried out by setting, as a sweeping direction, a direction from one end side toward the other end side in the long length direction, one end side in the long length direction in the hollow sectional shape is subjected to shape processing into a sealing shape for sealing, and the one end side subjected to the shape processing into the sealing shape is welded in a direction intersecting with the long length direction, thereby configuring a sealing portion, and a weld portion in the long length direction and a weld portion in the direction intersecting with the long length direction are set on almost the same plane.

The crimp terminal is a closed barrel terminal having a pressure-bonding section taking a hollow sectional shape and includes a connection terminal having a connecting portion for permitting connection to a connecting portion of the other terminal of a terminal set configured in a pair or a terminal configured by only a pressure-bonding section.

The long length direction can be set to be a direction which is almost coincident with the long length direction of the insulated wire to be pressure-bonded to the pressure-bonding section.

The at least a portion that is to be pressure-bonded and deformed for pressure-bonding and connection to the conductor portion among weld portions welded in the long length direction conceptually indicates a full range in the long length direction in the case in which a whole body is pressure-bonded and deformed, and indicates only a deformed part or a full range including the deformed part in the case in which only a part of the side where the conductor portion is to be inserted is pressure-bonded and deformed.

A sweeping direction from one end side toward the other end side in the long length direction includes a simple linear direction, and furthermore, a direction from the one end side toward the other end side in the long length direction as a whole during movement in the width direction and the long length direction.

According to the present invention, the conductor portion can be reliably pressure-bonded through the pressure-bonding section so that a crimp terminal capable of obtaining stable conductivity can be configured.

This will be described in more detail. The applicant proposes, as a method of preventing reduction in conductivity in a pressure-bonding section due to intrusion of water, a connection structural body (see Patent Document 1) in which an exposed part in a conductor portion is closed with an insulating cover formed by a resin having high viscosity in a pressure-bonding state in which the conductor portion is pressure-bonded through a pressure-bonding section, for example.

However, the connection structural body in the Patent Document 1 is a so-called open barrel type crimp terminal and an insulating cover is exposed. Therefore, there is a fear that water-blocking performance might be reduced due to aged deterioration of a resin material itself, resulting in decrease in conductivity.

Therefore, the formation of the welding bead through the welding on both of the surface and back face sides of a portion to be pressure-bonded and deformed implies that a section in a front/back direction of the weld portion is welded continuously. Accordingly, the plate material is bent in the width direction to take a hollow sectional shape, the ends are butted each other or superposed on each other, and the weld portion of the pressure-bonding section welded in the long length direction is not broken by the pressure-bonding and deformation without concentration of stress in the pressure-bonding of the conductor portion through the pressure-bonding section. Accordingly, it is possible to reliably pressure-bond the conductor portion of the insulated wire through the pressure-bonding section, thereby obtaining stable conductivity. In other words, it is possible to ensure a stable electrical connection state.

Referring to the welding in the long length direction, moreover, the direction from the one end side toward the other end side in the long length direction is set to be the sweeping direction. Consequently, a weld starting portion and a weld ending portion which have a higher possibility of welding defects serve as ends in the long length direction. For this reason, as compared with the case in which the welding is carried out from a center in the long length direction toward each end in the long length direction, for example, it is possible to efficiently carry out reliable welding.

As described above, one end side in the long length direction in the hollow sectional shape is caused to take a sealing shape for sealing, welding is carried out in a direction intersecting with the long length direction at the one end side in the long length direction which is formed into the sealing shape for sealing, thereby configuring a sealing portion, and therefore, by simply pressure-bonding the pressure-bonding section in which the conductor portion is inserted, it is possible to carry out the pressure-bonding into a wrapping state with water-blocking performance without exposing the conductor portion of the insulated wire or the conductor portion to the outside of the pressure-bonding section.

This will be described in more detail. Even if the pressure-bonding section is pressure-bonded and deformed in order to pressure-bond the conductor portion, the welding bead is formed by the welding on both of the surface and back sides in, among weld portions welded in the long length direction, at least a portion which is to be pressure-bonded and deformed for the pressure-bonding and connection to the conductor portion, the weld is not broken by the pressure-bonding and deformation, the welding is carried out in the direction intersecting with the long length direction to configure the sealing portion at one end side in the long length direction of the hollow sectional shape which is formed to take a sealing shape for sealing. Therefore, portions other than the insertion portion for inserting the conductor portion into the pressure-bonding section taking the hollow sectional shape are sealed. Consequently, it is possible to prevent water intrusion into an inner part without exposing the conductor portion in the pressure-bonding section to outside air. Thus, it is possible to inhibit degradation or aged deterioration from being caused. Therefore, corrosion does not occur in the conductor portion and to prevent a rise in electric resistance from being caused by the corrosion. Consequently, stable conductivity can be obtained.

Since the sealing shape is previously formed for sealing the one end side in the long length direction in the hollow sectional shape and the welding is carried out in the direction intersecting with the long length direction, thereby configuring the sealing portion, the portions other than the insertion portion for inserting the conductor portion into the pressure-bonding section taking the hollow sectional shape are sealed. By simply pressure-bonding the pressure-bonding section in which the conductor portion is inserted, it is possible to carry out the pressure-bonding into a wrapping state with water-blocking performance without exposing the conductor portion of the insulated wire or the conductor portion to the outside of the pressure-bonding section. In order to ensure the water-blocking performance, accordingly, it is possible to reliably prevent the conductor portion pressure-bonded to the pressure-bonding section from being exposed to the outside air without using a cap configured by a separate component in the conductor portion.

Moreover, as described above, a weld portion in the long length direction and a weld portion in the direction intersecting with the long length direction are set on almost the same plane; therefore, for example, it is possible to reliably carry out the welding by readily moving a welding device such as laser welding, for example. This will be described in more detail. A distance between the welding device and the weld portion is constant. Therefore, it is possible to carry out the welding in a stable welding state. Thus, the welding can reliably be performed.

As an aspect of the present invention, the welding bead can be formed on the both of surface and back face sides by penetration welding.

According to the present invention, the welding is carried out in a whole sectional region in a front/back direction of the weld portion. Therefore, it is possible to configure a weld portion which has more sufficient proof strength to pressure-bonding force for pressure-bonding the conductor portion through the pressure-bonding section and has no crack starting point, or is not broken even if stress concentrates.

This will be described in more detail. In the case in which the weld portion obtained by butting the ends of the plate material taking the hollow sectional shape and welding them in the long length direction is subjected to non-penetration welding, stress concentrates in the pressure-bonding so that the weld portion tends to be a crack starting point from a lower part toward an upper part in a vertical direction at the center of the weld portion in the long length direction. By penetration welding, however, the section of the weld portion is welded continuously and the crack starting point is not generated so that welding having sufficient proof strength can be carried out.

In the case in which the weld portion obtained by superposing the ends of the plate material taking the hollow sectional shape and carrying out welding in the long length direction is subjected to the non-penetration welding, moreover, a difference in a hardness between the weld portion and the base material or a local difference in bending workability against the pressure-bonding or the like is made in the front/back direction. For this reason, stress is added to the weld portion in application of pressure-bonding force so that breakage tends to occur. However, the continuous weld portion is formed in the front/back direction through the penetration welding. Therefore, it is possible to form the weld portion which is hard to break and has sufficient proof strength.

Accordingly, it is possible to reliably ensure hermetic sealing performance in the weld portion obtained by superposing the ends of the plate material taking the hollow sectional shape and carrying out welding in the long length direction.

Thus, it is possible to form a welding bead with sufficient proof strength and hermetic sealing performance which has no crack starting point or is not broken even if stress concentrates in pressure-bonding. Accordingly, the conductor portion of the insulated wire is more reliably pressure-bonded through the pressure-bonding section so that more stable conductivity can be obtained.

As an aspect of the present invention, moreover, it is possible to form a welding bead having a predetermined width in a width direction intersecting with the long length direction through welding in the long length direction.

The predetermined width conceptually includes that it is greater than a diameter of a laser light condensing spot in laser welding and is greater than the welding bead of the welding swept straight in the sweeping direction. It is possible to obtain the predetermined width by moving the laser light condensing spot to be welded.

According to the present invention, it is possible to form the welding bead having the predetermined width.

This will be described in more detail. For example, in the case in which the welding bead is shifted by a half width of a welding bead in the width direction from the weld portion in the long length direction in which the ends of the plate material taking the hollow sectional shape are butted, there is a fear of non-welding. However, the welding bead having the predetermined width can be formed continuously in the width direction. For this reason, even in the case in which the central axis of the welding bead is shifted slightly from the welding portion in the long length direction where the ends are butted, there is no fear that non-welding might be caused.

Even in the case in which a local gap is generated between the superposed ends in the weld portion in which the ends of the plate material taking the hollow sectional shape are superposed on each other and are welded in the long length direction, it is possible to continuously form a welding bead having a predetermined width in the width direction. Therefore, it is possible to increase a welding area in the width direction. Thus, it is possible to reliably perform welding with hermetic sealing performance Accordingly, it is possible to form a welding bead having such sufficient proof strength and hermetic sealing performance as not to be broken even if stress concentrates in the pressure-bonding, for example.

As an aspect of the present invention, moreover, the welding having the predetermined width can be set to be spiral sweep welding for carrying out sweeping and welding in the long length direction with rotation in the width direction.

According to the present invention, it is possible to form a welding bead having a predetermined width and having such sufficient proof strength and hermetic sealing performance as not to be broken even if stress concentrates in the pressure-bonding while advancing in the long length direction.

As an aspect of the present invention, furthermore, the welding having the predetermined width can be set to be rectangular sweep welding for alternately repeating sweep in the width direction and sweep in the long length direction to carry out welding in the sweeping direction.

According to the present invention, it is possible to form a welding bead having a predetermined width and having such sufficient proof strength and hermetic sealing performance as not to be broken even if stress concentrates in the pressure-bonding while advancing in the long length direction.

As an aspect of the present invention, moreover, the welding having the predetermined width can be set to be triangular sweep welding for carrying out sweeping in oblique directions to the width direction and the long length direction to carry out welding zigzag.

According to the present invention, it is possible to form a welding bead having a predetermined width and having such sufficient proof strength and hermetic sealing performance as not to be broken even if stress concentrates in the pressure-bonding while advancing in the long length direction.

As an aspect of the present invention, furthermore, it is possible to carry out the welding by using a high energy density beam.

The high energy density beam includes a laser beam generated by a fiber laser, a YAG laser, a semiconductor layer, a disk laser or the like, or an electron beam.

According to the present invention, it is possible to carry out welding with high precision at a high aspect ratio. Accordingly, it is possible to realize a welding state with less deformation of a terminal material.

Moreover, the welding using the high energy density beam is performed in non-contact. Therefore, it is possible to hold strength in the pressure-bonding of the conductor portion in the pressure-bonding section. This will be described in more detail. In the case of contact welding such as ultrasonic welding or resistance welding, such mechanical pressure welding as to leave impression is required so that stress concentration occurs, resulting in reduction in material strength. Consequently, there is a fear that the pressure-bonding section might be damaged when the conductor portion is to be pressure-bonded. In the welding using the high energy density beam which is the non-contact welding, however, the material strength is not reduced as compared with the mechanical pressure welding described above and the pressure-bonding section is not damaged in the pressure-bonding of the conductor portion. Consequently, water-blocking performance can be ensured so that a stable pressure-bonding state can be maintained.

As an aspect of the present invention, moreover, the high energy density beam can be configured from a fiber laser beam.

The fiber laser beam includes a fiber laser beam to be continuously oscillated, pulse oscillated, QCW oscillated or continuously oscillated through pulse control.

According to the present invention, it is possible to easily carry out deep penetration welding. This will be described in more detail. The fiber laser is excellent in beam quality and has high light condensing performance. Therefore, it is possible to realize high output density processing. Accordingly, it is possible to efficiently bring a reliable welding state without giving extra thermal effects to a material by deep penetration welding having a high aspect ratio.

For example, a cost is increased when the welding is carried out as the contact welding through brazing, an anvil and a horn are required in the case of ultrasonic welding, and a space for inserting an electrode is required and facilities are also large-scaled in the case of resistance welding. In addition, there is a fear that the mechanical strength of the weld portion might be reduced in the terminal pressure bonding due to decrease in the thickness of a material by the pressure weld processing as described above. However, the laser welding to be non-contact welding can be carried out in the atmosphere so that facilities can be made compact.

As an aspect of the present invention, there is provided a connection structural body in which the insulated wire and the crimp terminal are connected to each other through the pressure-bonding section in the crimp terminal manufactured by the method of manufacturing a crimp terminal.

Furthermore, the present invention provides a connection structural body in which the insulated wire and the crimp terminal are connected to each other through the pressure-bonding section in the crimp terminal.

According to the present invention, it is possible to configure a connection structural body capable of ensuring the reliable water-blocking performance by simply carrying out surrounding and pressure-bonding through the pressure-bonding section of the crimp terminal. Accordingly, stable conductivity can be ensured. The connection structural body includes a wire harness configured from a single connection structural body having the insulated wire and the crimp terminal connected to each other or configured by bundling a plurality of connection structural bodies through the pressure-bonding section in the crimp terminal.

As an aspect of the present invention, the conductor portion can be constituted by an aluminum based material, and at least the pressure-bonding section can be constituted by a copper based material.

According to the present invention, a weight can be reduced as compared with an insulated wire having a conductor portion formed by a copper wire, and so-called dissimilar metal contact corrosion (hereinafter referred to as galvanic corrosion) can be prevented by the reliable water-blocking performance.

This will be described in more detail. In the case in which a copper based material which is conventionally used in a conductor portion of an insulated wire is replaced with an aluminum based material such as aluminum or an aluminum alloy, and the conductor portion formed by the aluminum based material is pressure-bonded to a crimp terminal, there is the following problem, specifically, a phenomenon in which the aluminum based material being a less noble metal is corroded by contact of a terminal material with a nobler metal material such as tin plating, gold plating or a copper alloy, that is, the galvanic corrosion.

The galvanic corrosion is a phenomenon in which corrosion electric current is generated and a less noble metal is corroded, dissolved, eliminated or the like when water sticks to a portion in which a nobler metal material and the less noble metal are provided in contact with each other. By this phenomenon, a conductor portion formed by an aluminum based material pressure-bonded to the pressure-bonding section of the crimp terminal is corroded, dissolved and eliminated, and electric resistance is raised before long. As a result, there is a problem in that it is impossible to perform a sufficient conductive function.

However, it is possible to prevent so-called galvanic corrosion while reducing a weight as compared with an insulated wire having a conductor portion formed by a copper-based material through the reliable water-blocking performance.

Furthermore, the present invention provides a connector having the crimp terminal in the connection structural body disposed in a connector housing.

According to the present invention, it is possible to connect the crimp terminal with stable conductivity ensured regardless of metal species configuring the crimp terminal and the conductor portion.

This will be described in more detail. For example, when a female connector and a male connector are fitted in each other and the crimp terminals disposed in the connector housings of the connectors are connected to each other, it is possible to connect the crimp terminals of the respective connectors to each other while ensuring the water-blocking performance.

As a result, it is possible to ensure a connection state having reliable conductivity.

The present invention provides a crimp terminal including a pressure-bonding section for permitting pressure-bonding and connection of a wire tip in an insulated wire obtained by covering a conductor with an insulating cover, wherein the wire tip is configured from a conductor tip having the conductor exposed by peeling off the insulating cover at a tip side in the insulated wire and an insulated tip provided in a tip portion of the insulating cover, the pressure-bonding section is configured in a hollow sectional shape, and provided with a conductor pressure-bonding section for pressure-bonding the conductor tip and a cover pressure-bonding section for pressure-bonding the insulated tip in this order from the tip side toward a base end side in a long length direction, the cover pressure-bonding section is provided with pressure-bonding force relieving means for relieving pressure-bonding force to be applied to the insulating cover with the pressure-bonding of the insulating cover, at least an inner peripheral part of the base end in the long length direction of the pressure-bonding section is formed by a base end side large diameter inner peripheral part having a larger inside diameter than inside diameters of portions other than at least the base end in the long length direction of the pressure-bonding section, and the pressure-bonding force relieving means is set into the base end side large diameter inner peripheral part.

As described above, it is possible to prevent the insulating cover from being broken by strongly pressure-bonding the insulating cover through the cover pressure-bonding section. Thus, it is possible to ensure excellent water-blocking performance in the wire tip.

This will be described in more detail. An electric apparatus provided in an automobile or the like is connected to another electric apparatus or a power supply device through a wire harness obtained by bundling insulated wires, thereby configuring an electric circuit. In this case, the wire harness and the electric apparatus or the power supply device are connected through connectors attached thereto, respectively.

Various crimp terminals provided in the connector are proposed and the conductor member disclosed in the Patent Document 1 is one of the crimp terminals.

The "conductor member" disclosed in the Patent Document 1 is configured from a wire connecting portion to be a base material where a connection surface to be connected to another member is provided and a fastening portion, protruded toward the wire connecting portion, for fastening a tip part of a wire.

The fastening portion has an insertion hole capable of inserting the tip part of the wire and is formed like a cylinder in which a tip side in a protruding direction is opened. Referring to the connection of the wire to the "conductive member" in the Patent Document 1, the tip part of the wire is inserted into the insertion hole of the fastening portion and the fastening portion is caulked in that state so that pressure-bonding and connection can be carried out.

The connector described above is used in various environments. In some cases, therefore, unintended water sticks to the surface of the insulated wire by condensation or the like due to change in ambient temperature. There is a problem in that the surface of the wire conductor exposed from the tip of the insulated wire is corroded when water intrudes the inner part of the connector along the surface of the insulated wire. In the case of a wire conductor configured by dissimilar metals having different ionization tendencies and the crimp terminal, particularly, there is also a problem in that water sticks to cause galvanic corrosion when they are provided as a part of the connector.

For this reason, in the case in which the wire to be connected to the crimp terminal is an insulated wire obtained by covering a conductor with an insulating cover, generally, the caulking portion is caulked in the insertion state where not only the conductor tip having the conductor exposed by peeling off the insulating cover at the tip side in the insulated wire, but also the insulated tip that is in a rearward side portion from the conductor tip and in a tip part of the insulating cover are inserted together into the insertion hole of the caulking portion. Consequently, there is taken such a countermeasure as to prevent the conductor tip from being exposed to the outside at the base end side of the caulking portion after the caulking.

However, the base end of the cover pressure-bonding section, that is, an open edge portion at the base end side of the insertion hole is a free end which is protruded toward the base end direction. In the case in which the pressure-bonding force for pressure-bonding the insulated tip in the wire tip by the pressure-bonding section is excessively great when the pressure-bonding section is to be pressure-bonded to the wire tip, there is a fear that the insulating cover in the insulated tip might be extended or cut into by the base end of the cover pressure-bonding section, resulting in breakage.

Consequently, there is a problem in that water intrudes the inner part of the insulating cover through the broken part of the insulating cover and the intruding water sticks to the conductor in the inner part and the conductor is thus corroded.

According to the structure described above, the cover pressure-bonding section is provided with the pressure-bonding force relieving means. In the state in which the pressure-bonding section is pressure-bonded to the wire tip, therefore, the pressure-bonding force for pressure-bonding the insulating cover by the cover pressure-bonding section is relieved. Consequently, the base end of the cover pressure-bonding section, that is, the open edge portion on the base end side of the insertion hole can be prevented from intruding the insulating cover, resulting in the breakage of the insulating cover.

Accordingly, it is possible to prevent water from intruding the inside of the insulating cover via the broken part of the insulating cover to corrode the conductor at the inside of the insulating cover.

As described above, at least an inner peripheral part of the base end in the long length direction of the pressure-bonding section can be formed by a base end side large diameter inner peripheral part having a greater inside diameter than an inside diameter of a portion other than at least the base end in the long length direction of the pressure-bonding section, and the pressure-bonding force relieving means is set into the base end side large diameter inner peripheral part; therefore, with the simple structure in which at least the inner peripheral part of the base end in the long length direction of the pressure-bonding section is set to be a base end side large diameter inner peripheral part, there is no fear that the base end of the cover pressure-bonding section in the contact portion where the insulating cover comes in contact with the cover pressure-bonding section might intrude the insulating cover, resulting in breakage when the pressure-bonding section is to be pressure-bonded to the wire tip. Consequently, the pressure-bonding can be firmly carried out.

Accordingly, it is possible to prevent water from intruding the inside of the insulating cover via the broken part of the insulating cover to corrode the conductor at the inside of the insulating cover.

As an aspect of the present invention, moreover, a base end side diameter enlarging portion having a diameter enlarged with respect to a tip side portion than at least a base end in the long length direction of the pressure-bonding section can be formed on at least the base end, and the base end side large diameter inner peripheral part can be set to be the base end side diameter enlarging portion.

According to the structure described above, the base end side large diameter inner peripheral part is set to be the base end side diameter enlarging portion. Consequently, the diameter of the inner peripheral part on the base end side can be reliably set to be a larger inside diameter than the inside diameters of portions other than the base end in the cover pressure-bonding section.

In the state in which the pressure-bonding section can be pressure-bonded to the wire tip, consequently, the base end side of the cover pressure-bonding section can relieve the pressure-bonding force for pressure-bonding the insulating cover. Thus, it is possible to prevent the insulating cover from being broken.

Accordingly, it is possible to prevent water from intruding the inside of the insulating cover via the broken part of the insulating cover to corrode the conductor at the inside of the insulating cover.

The base end side diameter enlarging portion may be formed in any of stages, that is, before the pressure-bonding of the wire tip through the pressure-bonding section, simultaneously with the pressure-bonding and after the pressure-bonding with respect to at least the base end in the long length direction of the pressure-bonding section.

As an aspect of the present invention, moreover, a base end side thinned portion which is thinned to cause an inner peripheral surface to approach an outer peripheral surface of the base end in the long length direction of the pressure-bonding section can be formed on at least the base end, and the base end side large diameter inner peripheral part can be set to be the base end side thinned portion.

As described above, the base end side large diameter inner peripheral part is set to be the base end side thinned portion. Consequently, the diameter of the inner peripheral part on the base end side can be reliably set to be a larger inside diameter than the inside diameters of portions other than the base end in the cover pressure-bonding section.

In the state in which the pressure-bonding section is pressure-bonded to the wire tip, consequently, the base end side of the cover pressure-bonding section can relieve the pressure-bonding force for pressure-bonding the insulating cover. Thus, it is possible to prevent the insulating cover from being broken.

Accordingly, it is possible to prevent water from intruding the inside of the insulating cover via the broken part of the insulating cover to corrode the conductor at the inside of the insulating cover.

By setting the base end side large diameter inner peripheral part to be the base end side thinned portion, furthermore, it is possible to form the outer peripheral part including at least the base end pressure-bonding section in the long length direction of the pressure-bonding section so as not to be protruded in a radial direction. Therefore, in the insertion to the terminal insertion hole of the connector, for example, it is possible to realize space saving of the connector as well as the crimp terminal without interference.

The present invention provides a crimp terminal including a pressure-bonding section for permitting pressure-bonding and connection of a wire tip in an insulated wire obtained by covering a conductor with an insulating cover, wherein the wire tip is configured from a conductor tip having the conductor exposed by peeling off the insulating cover at a tip side in the insulated wire and an insulated tip provided in a tip portion of the insulating cover, the pressure-bonding section is configured in a hollow sectional shape, and provided with a conductor pressure-bonding section for pressure-bonding the conductor tip and a cover pressure-bonding section for pressure-bonding the insulated tip in this order from the tip side toward a base end side in a long length direction, the cover pressure-bonding section is provided with pressure-bonding force relieving means for relieving pressure-bonding force to be applied to the insulating cover with the pressure-bonding of the insulating cover, the cover pressure-bonding section can be configured from a closed barrel type pressure-bonding section formed in a hollow sectional shape and an open barrel type pressure-bonding section having a part in a circumferential direction opened, the closed barrel type pressure-bonding section can be integrally formed in the long length direction with a whole body in a circumferential direction linked to the conductor pressure-bonding section, the open barrel type pressure-bonding section can be disposed at a predetermined interval toward a base portion side with respect to the closed barrel type pressure-bonding section and can be formed integrally with the closed barrel type pressure-bonding section in the long length direction, and the pressure-bonding force relieving means can be set to the open barrel type pressure-bonding section.

The cover pressure-bonding section can be brought into a pressure-bonding state in which the closed barrel type pressure-bonding section and the open barrel type pressure-bonding section disposed on a rear side from the closed barrel type pressure bonding section are pressure-bonded to the insulating cover by separate pressure bonding force, respectively.

In the case in which the wire is bent at the rearward side from the wire tip in the wire, consequently, the base end of the pressure-bonding section for pressure-bonding the wire tip particularly intrudes the insulating cover and thus tends to be broken. By carrying out the pressure-bonding with smaller pressure-bonding force to the insulating cover than the pressure-bonding force of the open barrel type pressure-bonding section disposed at the rearward side than the closed barrel type pressure-bonding section, it is possible to prevent the insulating cover from intruding the base end of the open barrel type pressure-bonding section.

In the state in which the wire tip is pressure-bonded by the pressure-bonding section, furthermore, it is also possible to distribute the pressure-bonding force to be applied to the closed barrel type pressure-bonding section into the open barrel type pressure-bonding section.

Accordingly, stress generated by the pressure-bonding does not concentrate on the closed barrel type pressure-bonding section. Even if the base end to be the free end in the long length direction of the closed barrel type pressure-bonding section pressure-bonds the insulating cover, therefore, the insulating cover is prevented from being broken by the pressure-bonding.

As an aspect of the present invention, furthermore, the conductor can be constituted by an aluminum based material, and at least the pressure-bonding section can be constituted by a copper based material.

The present invention provides a connection structural body for pressure-bonding and connecting an insulated wire and a crimp terminal through a pressure-bonding section in the crimp terminal, the insulated wire obtained by covering a conductor with an insulating cover, the pressure-bonding section for permitting pressure-bonding and connection of a wire tip in the insulated wire, wherein the wire tip is configured from a conductor tip having the conductor exposed by peeling off the insulating cover at a tip side in the insulated wire and an insulated tip provided in a tip portion of the insulating cover, the pressure-bonding section is configured in a hollow sectional shape, and configured by providing a conductor pressure-bonding section for pressure-bonding the conductor tip and a cover pressure-bonding section for pressure-bonding the insulated tip in this order from the tip side toward a base end side in a long length direction, the base end side of the pressure-bonding section in a pressure-bonding state with the wire tip disposed in an inner part is formed by pressure-bonding force relieving means for relieving pressure-bonding force with the pressure-bonding of the insulating cover, at least an inner peripheral part of the base end in the long length direction of the pressure-bonding section is formed by a base end side large diameter inner peripheral part having a larger inside diameter than inside diameters of portions other than at least the base end in the long length direction of the pressure-bonding section, and the pressure-bonding force relieving means is set into the base end side large diameter inner peripheral part.

The base end side of the pressure-bonding section in the pressure-bonding state is formed to take the pressure-bonding force relieving shape. Consequently, the base end side of the pressure-bonding section in the pressure bonding state does not cut into the insulating cover but can be firmly pressure-bonded.

In the case in which the crimp terminal including the pressure-bonding force relieving means is used as the crimp terminal to configure the connection structural body at the base end side of the cover pressure-bonding section as described above, particularly, the pressure-bonding force relieving shape can be reliably formed on the base end side of the cover pressure-bonding section in the pressure-bonding state.

It is assumed that the connection structural body includes a wire harness configured from a single connection structural body having the insulated wire and the crimp terminal connected to each other or configured by bundling a plurality of connection structural bodies through the pressure-bonding section in the crimp terminal.

The present invention provides a connector having the crimp terminal in the connection structural body disposed in a connector housing.

According to the present invention, it is possible to provide a connector including a crimp terminal capable of preventing water from intruding the inside of the insulating cover via the broken part of the insulating cover to corrode the conductor at the inside of the insulating cover.

Moreover, the present invention provides a method of manufacturing a connection structural body for pressure-bonding and connecting an insulated wire and a crimp terminal through a pressure-bonding section in the crimp terminal, the insulated wire obtained by covering a conductor with an insulating cover, the pressure-bonding section for permitting pressure-bonding and connection of a wire tip in the insulated wire, the connection structural body in which the wire tip is configured from a conductor tip having the conductor exposed by peeling off the insulating cover at a tip side in the insulated wire and an insulated tip provided in a tip portion of the insulating cover, the pressure-bonding section is configured in a hollow sectional shape and is configured by disposing a conductor pressure-bonding section for pressure-bonding the conductor tip and a cover pressure-bonding section for pressure-bonding the insulated tip in this order from the tip side toward a base end side in a long length direction, and an inner peripheral part of at least the base end in the long length direction of the pressure-bonding section is formed by a base end side large diameter inner peripheral part having a larger inside diameter than inside diameters of portions other than at least the base end in the long length direction of the pressure-bonding section, the method including: in a pressure-bonding and connecting step of pressure-bonding and connecting the wire tip through the pressure-bonding section, disposing the wire tip in the pressure-bonding section; and pressure-bonding a tip side part including the cover pressure-bonding section from at least a base end in the pressure-bonding section.

According to the structure described above, in the pressure-bonding and connecting step, it is possible to carry out plastic deformation in order to enlarge the diameter of at least the base end in the pressure-bonding section by utilizing reaction force generated by pressure-bonding the tip side part from at least the base end in the pressure bonding section. Therefore, the base end side large diameter inner peripheral part can be reliably formed on at least the base end in the pressure-bonding section.

According to the structure described above, the inner peripheral part of at least the base end in the long length direction of the pressure-bonding section is formed by a base end side large diameter inner peripheral part having a greater inside diameter than inside diameters of portions other than at least the base end in the long length direction of the pressure-bonding section. In the pressure-bonding and connecting step, therefore, the tip side portion from at least the base end in the pressure-bonding section is pressure-bonded. Consequently, it is possible to reliably form the base end side large diameter inner peripheral part having a larger inside diameter than the inside diameters of the portions other than the base end in the pressure-bonding section in at least the base end in the pressure-bonding section.

Effect of the Invention

According to the present invention, it is possible to provide a crimp terminal, a connection structural body and a connector which can efficiently realize a pressure-bonding state in which water can be prevented from intruding an inner part of a pressure-bonding section in a pressure-bonding state in which a conductor portion is pressure-bonded by a pressure-bonding section.

FIGS. 1(*a*) to 1(*c*) are views for explaining a female crimp terminal for pressure-bonding and connecting an insulated wire.

FIGS. 2(*a*) to 2(*c*) are views for explaining welding in a pressure-bonding section.

FIG. 3 is a perspective view showing a welding situation.

FIGS. 4(*a*) and 4(*b*) are views for explaining opposed ends of a barrel component piece.

FIGS. 5(*a*) and 5(*b*) are views for explaining a welding method.

FIGS. 6(*a*) to 6(*c*) are views for explaining welding according to another embodiment in the pressure-bonding section.

FIGS. 7(*a*) to 7(*c*) are views for explaining welding according to a further embodiment in the pressure-bonding section.

FIGS. 8(*a*) to 8(*f*) are views for explaining another welding method.

FIGS. 9(*a*) and 9(*b*) are views for explaining end surfaces of another barrel component piece.

FIGS. 10(*a*) to 10(*c*) are views for explaining a pressure-bonding section according to a further embodiment.

FIGS. 11(*a*) to 11(*c*) are views for explaining a further welding method in a barrel portion.

FIGS. 12(*a*) to 12(*d*) are views for explaining a female crimp terminal having a butt pressure-bonding section for pressure-bonding and connecting an insulated wire.

FIGS. 13(*a*) and 13(*b*) are views for explaining butt welding in the butt pressure-bonding section.

FIG. 14 is a perspective view showing a butt welding situation.

FIGS. 15(*a*) to 15(*c*) are views for explaining opposed ends of the barrel component piece configuring the butt pressure-bonding section.

FIGS. 16(*a*) to 16(*f*) are views for explaining a sweeping method in the butt welding.

FIG. 17 is a perspective view showing a connector.

FIGS. 18(*a*) to 18(*d*) are views for explaining a further embodiment in the butt pressure-bonding section.

FIGS. 19(*a*) to 19(*c*) are views for explaining a further welding method in the barrel portion.

FIGS. 20(*a*) to 20(*d*) are views for explaining a female crimp terminal having a superposition pressure-bonding section for pressure-bonding and connecting an insulated wire.

FIGS. 21(*a*) and 21(*b*) are views for explaining superposition welding in the superposition pressure-bonding section.

FIG. 22 is a perspective view showing a superposition welding situation.

FIGS. 23(*a*) to 23(*c*) are views for explaining component piece ends of the barrel component piece configuring the superposition pressure-bonding section.

FIGS. 24(*a*) to 24(*f*) are views for explaining a sweeping method in the superposition welding.

Figures 27A, 27B, 27C:
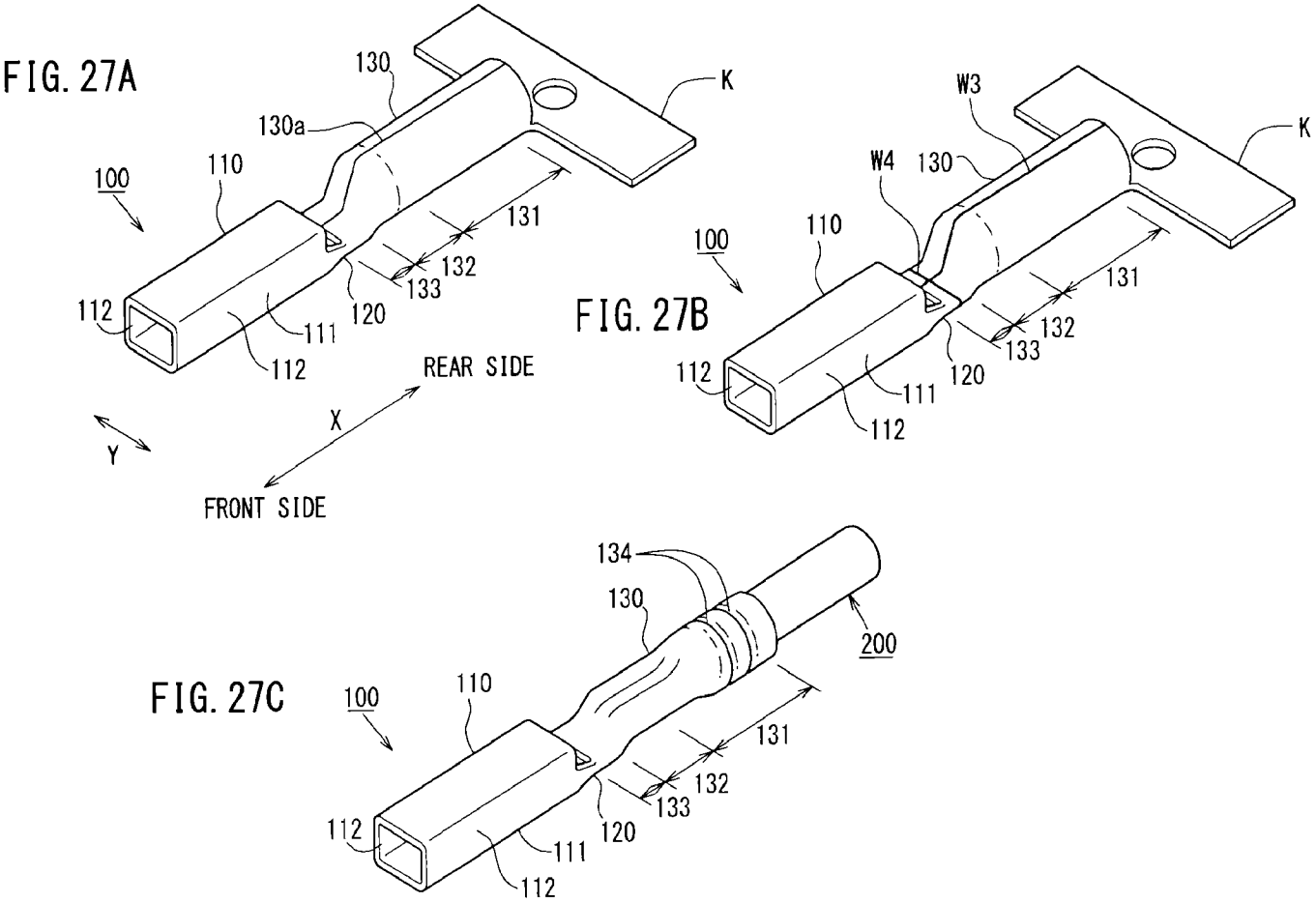
Figure 28A:
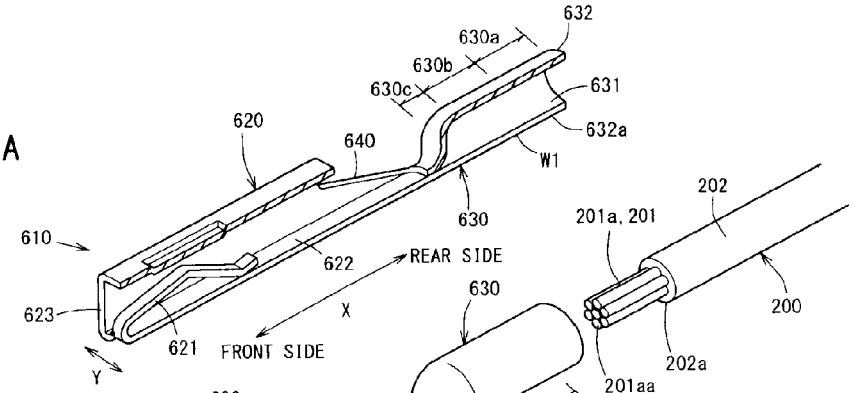
Figure 28B:
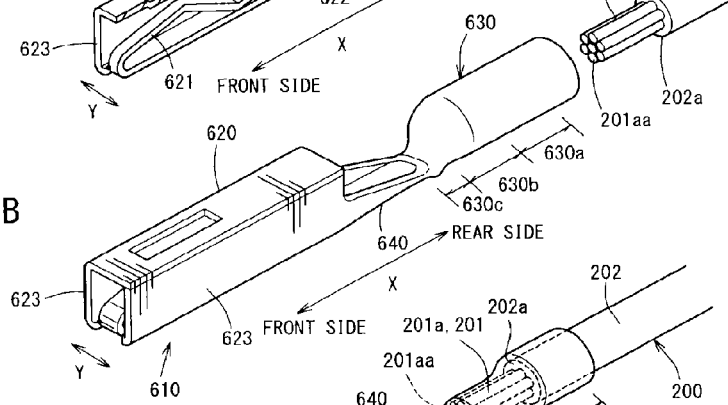
Figure 28C:
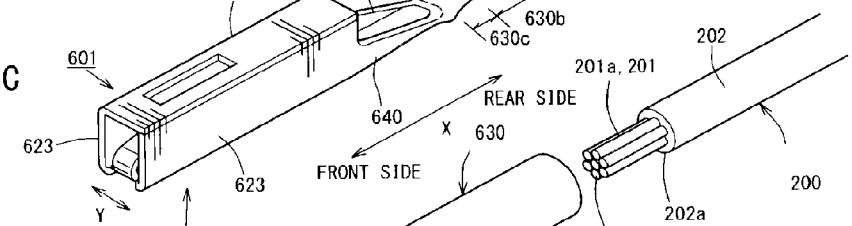
Figure 28D:
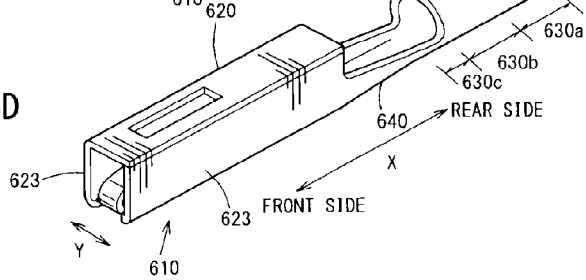

FIGS. 27(*a*) to 27(*c*) are views for explaining a further welding method in the barrel portion.

FIGS. 28(*a*) to 28(*d*) are views for explaining a female crimp terminal having a butt pressure-bonding section for pressure-bonding and connecting an insulated wire.

Figure 29A:
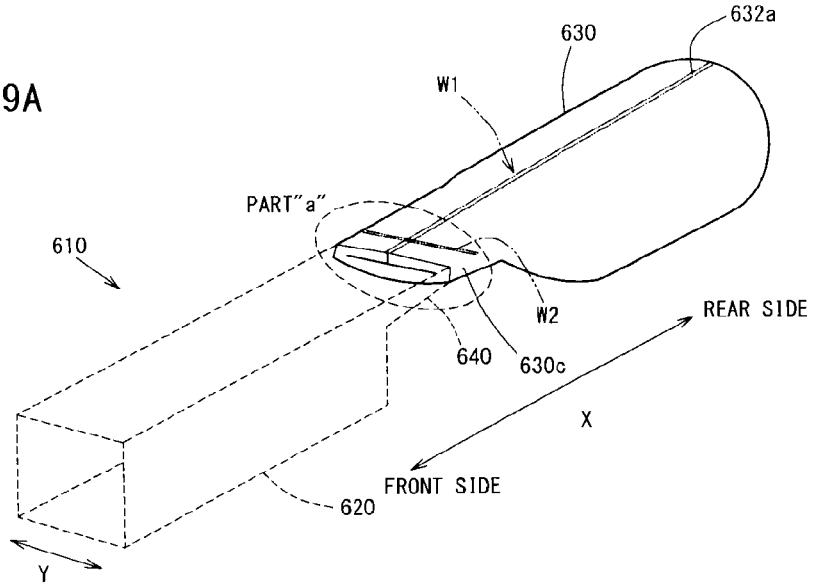
Figure 29B:
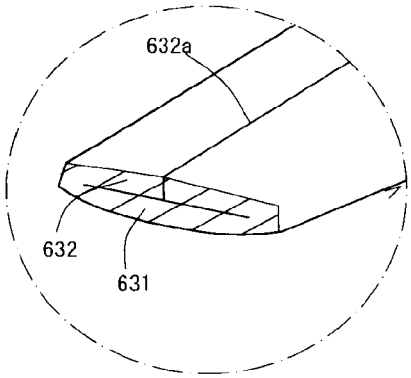

FIGS. 29(*a*) and 29(*b*) are views for explaining butt welding in the butt pressure-bonding section.

Figure 30:
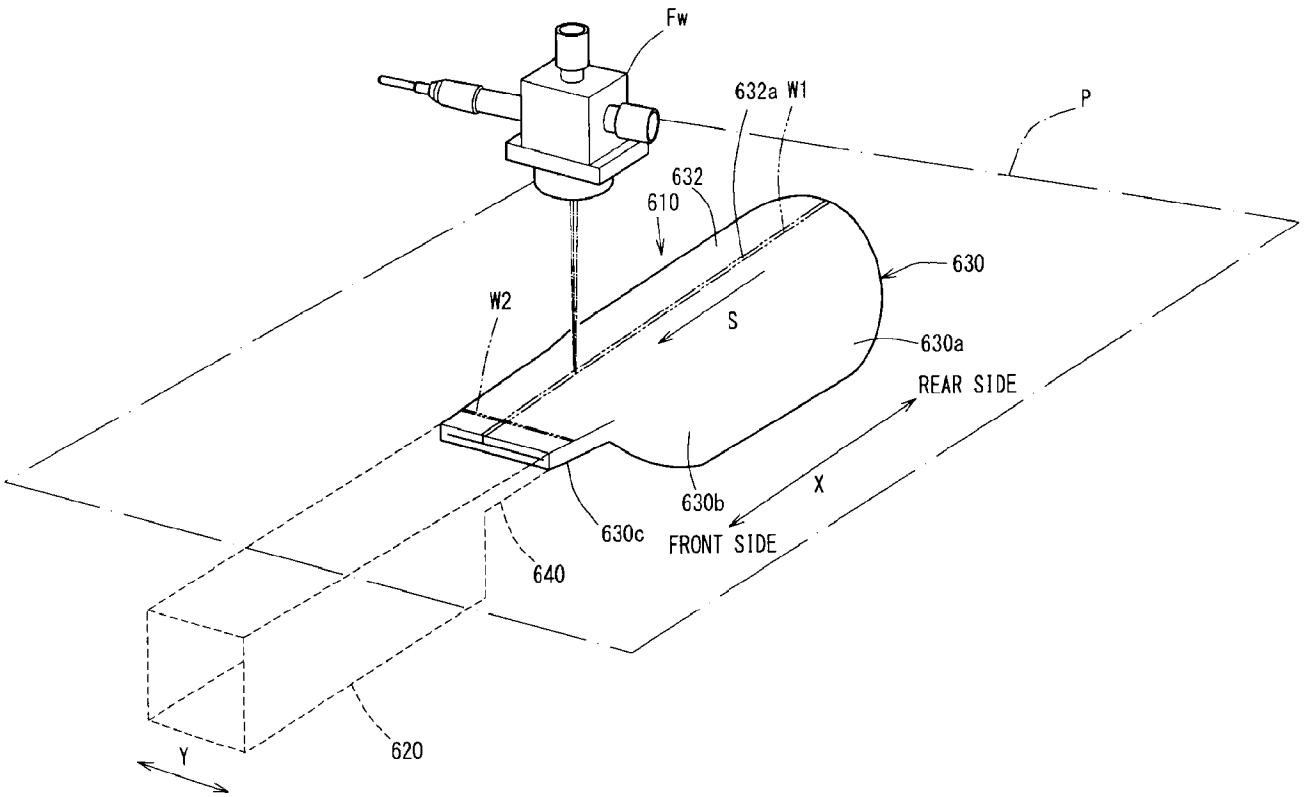

FIG. 30 is a perspective view showing a butt welding situation.

Figure 31A:
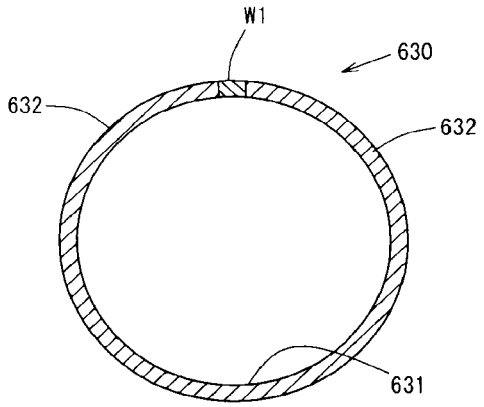
Figure 31B:
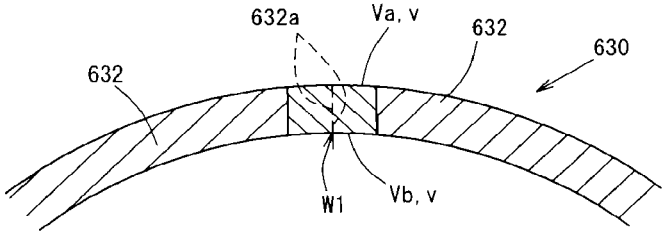
Figure 31C:
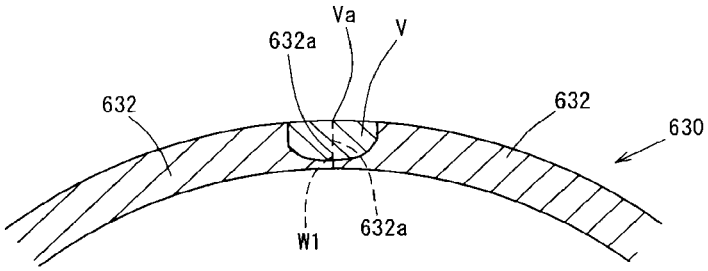
Figure 32A:
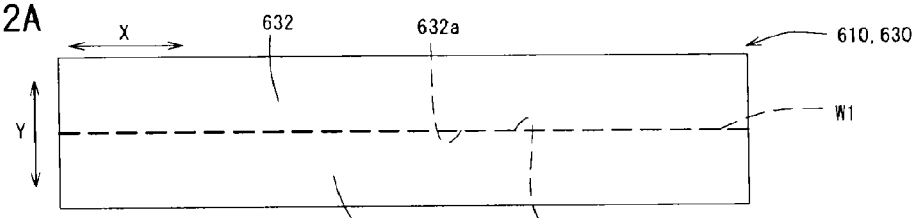
Figure 32B:
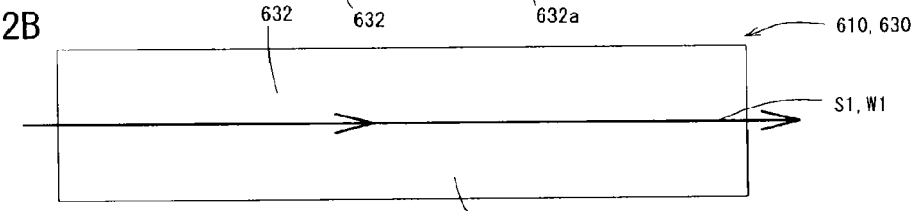
Figure 32C:
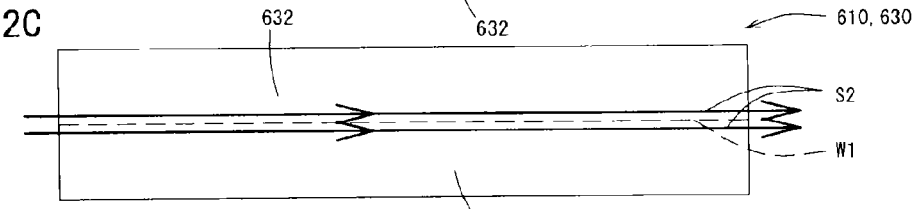
Figure 32D:
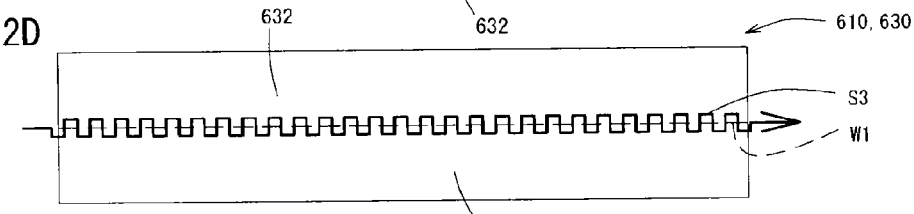
Figure 32E:
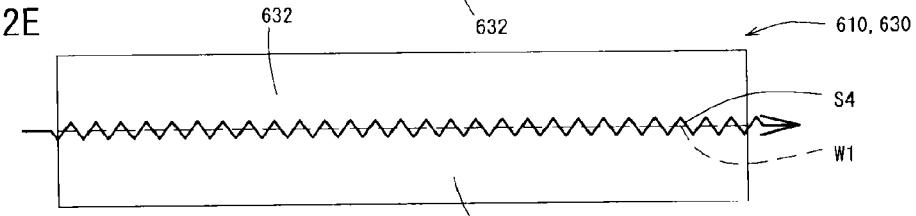
Figure 32F:
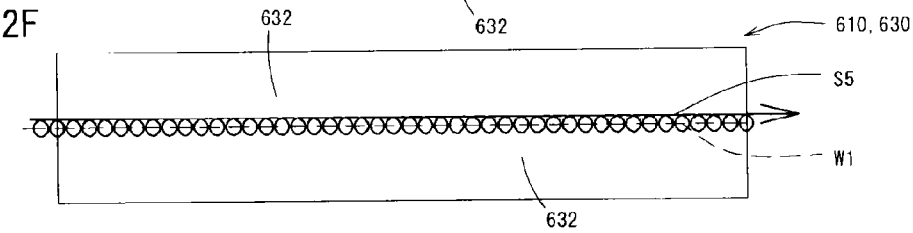
Figure 33A:
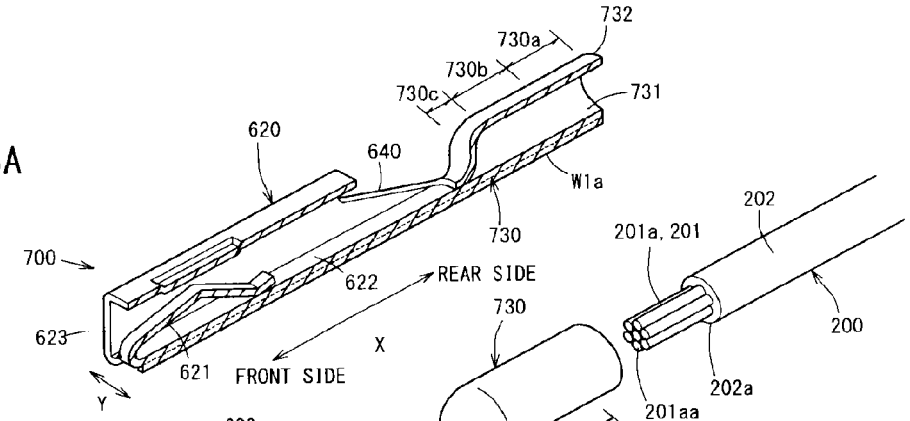
Figure 33B:
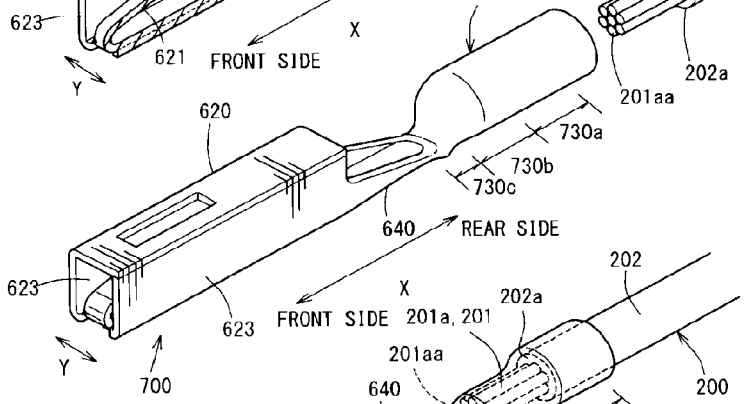
Figure 33C:
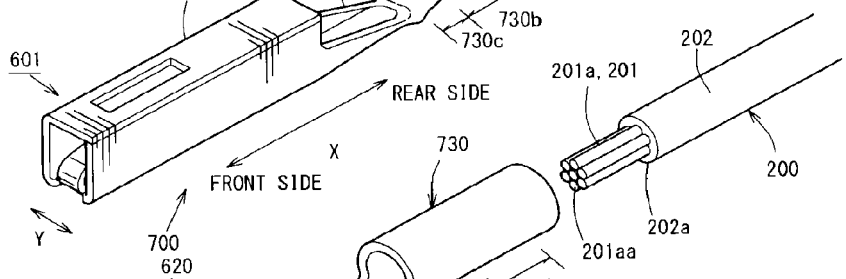
Figure 33D:
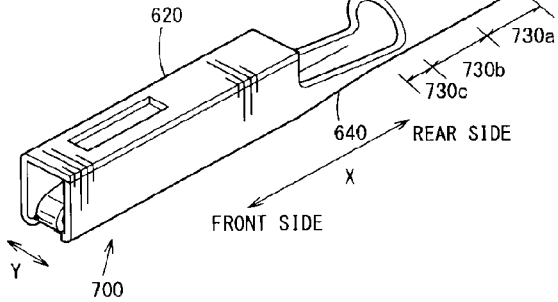

FIGS. 31(*a*) to 31(*c*) are views for explaining opposed ends of the barrel component piece configuring the butt pressure-bonding section.

FIGS. 32(*a*) to 32(*f*) are views for explaining a sweeping method in the butt welding.

FIGS. 33(*a*) to 33(*d*) are views for explaining a female crimp terminal having a superposition pressure-bonding section for pressure-bonding and connecting an insulated wire.

Figure 34A:
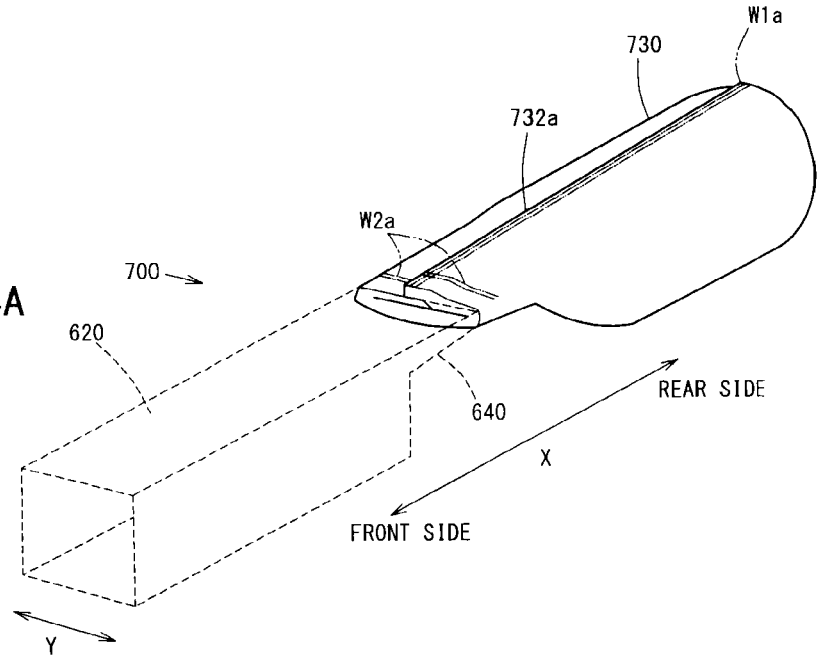
Figure 34B:
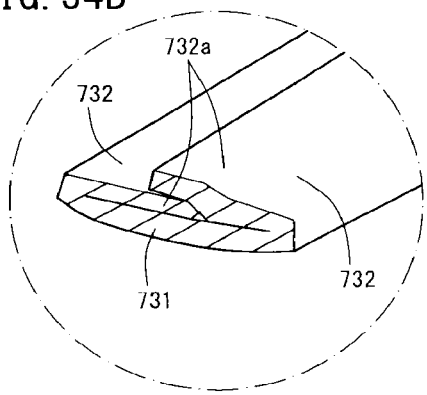

FIGS. 34(*a*) and 34(*b*) are views for explaining superposition welding in the superposition pressure-bonding section.

Figure 35:
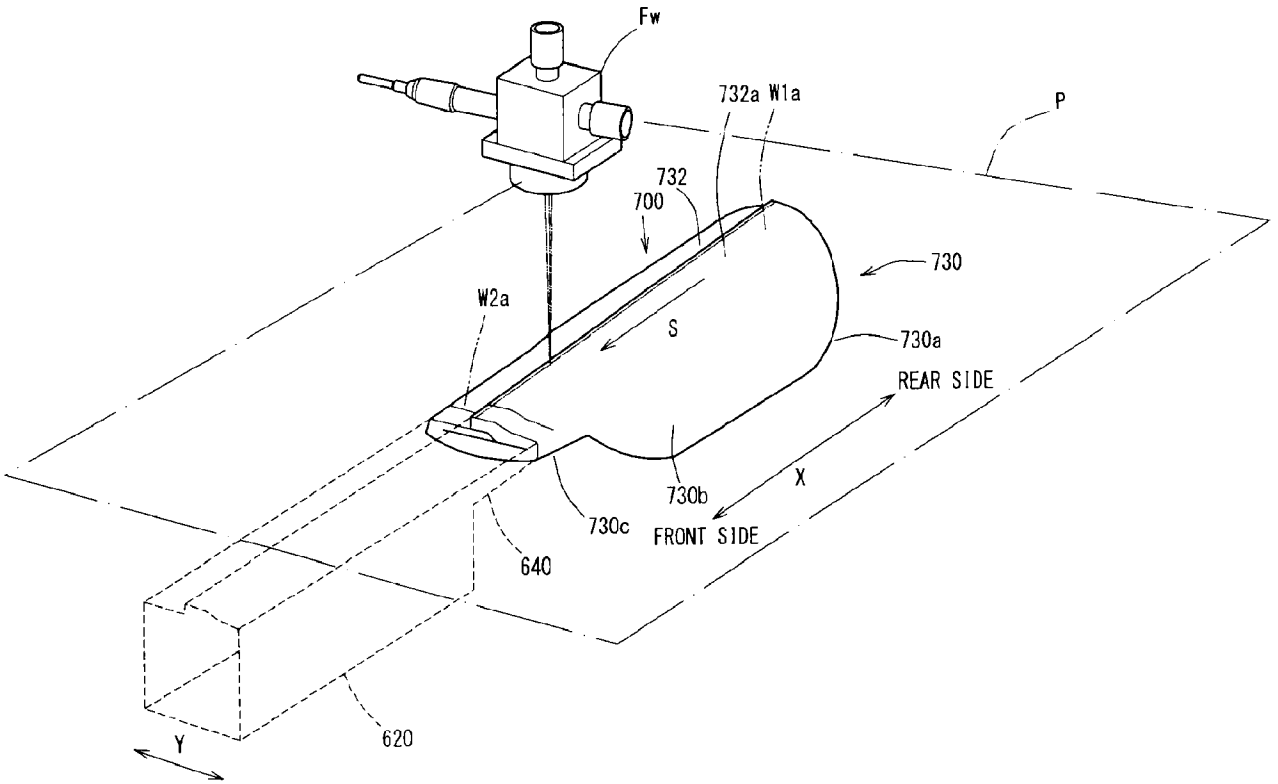

FIG. 35 is a perspective view showing a superposition welding situation.

Figure 36A:
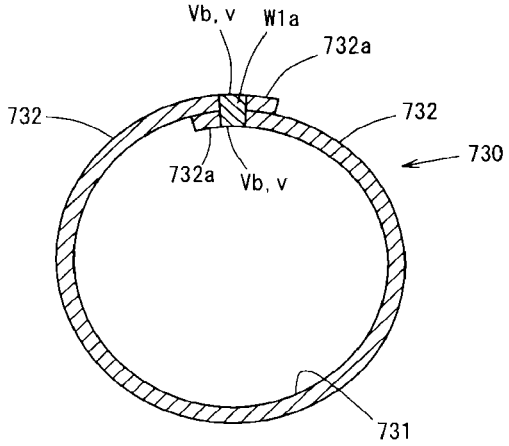
Figure 36B:
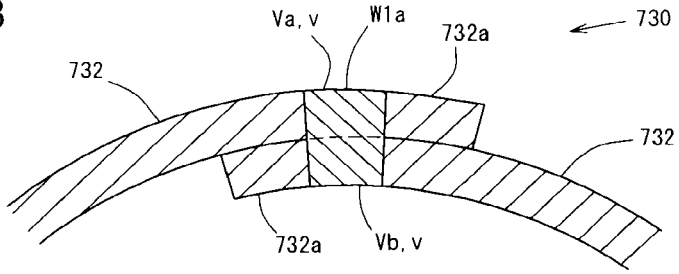
Figure 36C:
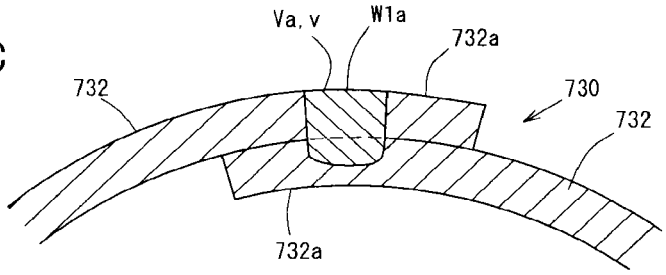
Figure 37A:
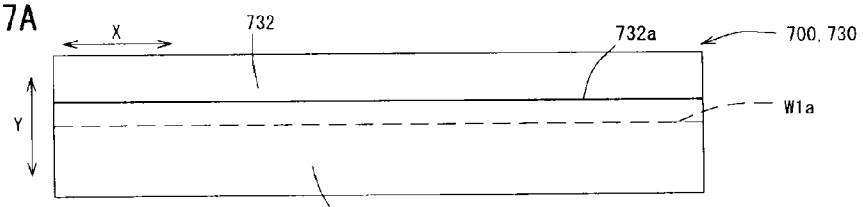
Figure 37B:
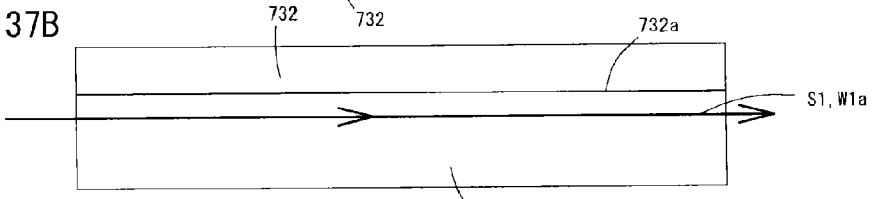
Figure 37C:
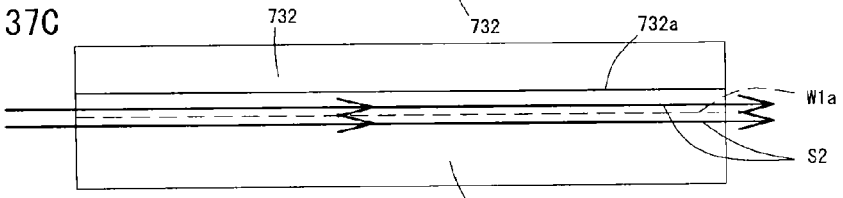
Figure 37D:
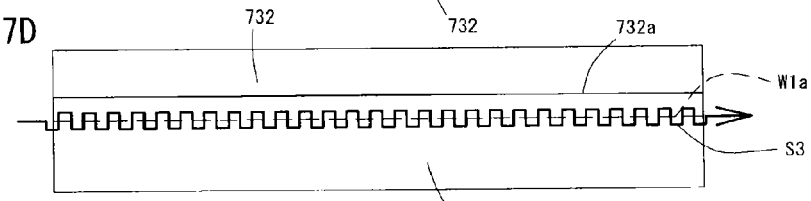
Figure 37E:
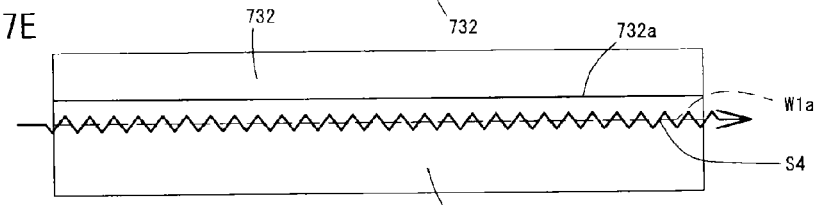
Figure 37F:
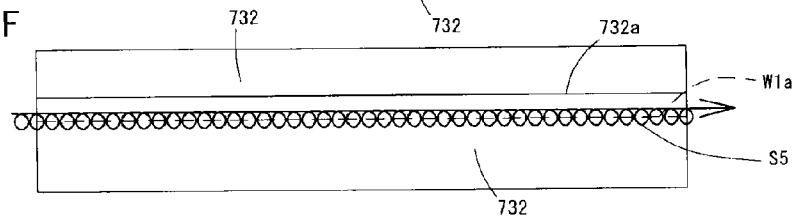

FIGS. 36(*a*) to 36(*c*) are views for explaining opposed ends of the barrel component piece configuring the superposition pressure-bonding section.

FIGS. 37(*a*) to 37(*f*) are views for explaining a sweeping method in the superposition welding.

Figure 38:
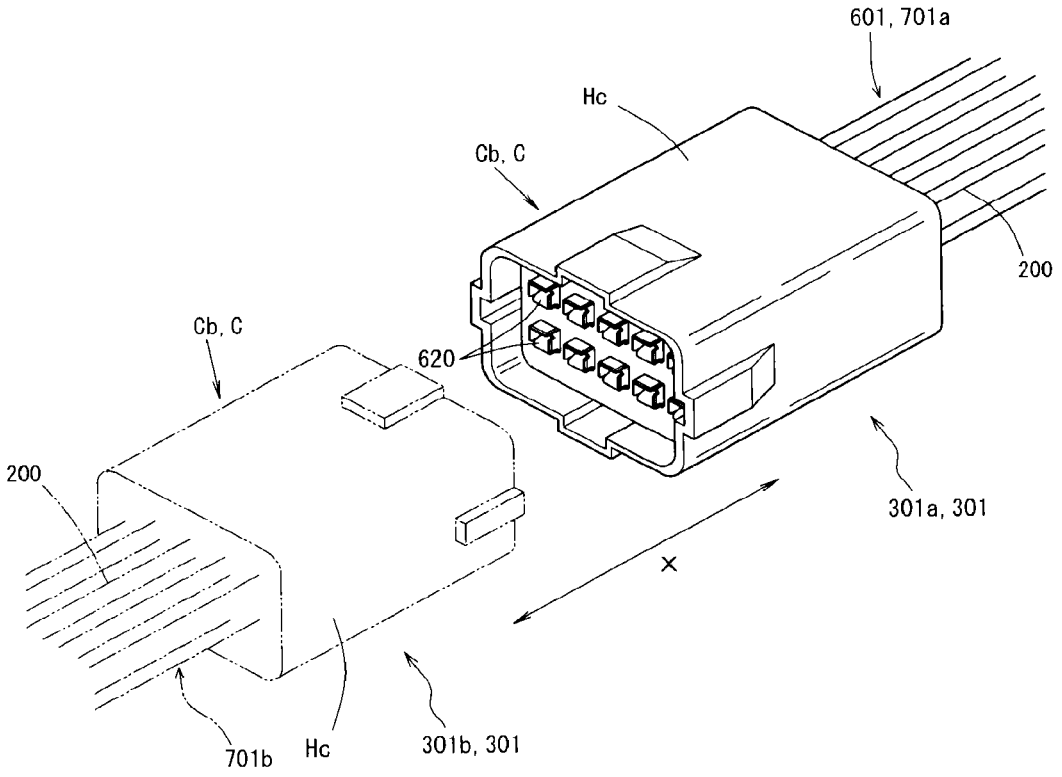

FIG. 38 is a perspective view showing a connector.

Figures 39A, 39B, 39C, 39D, 39E:
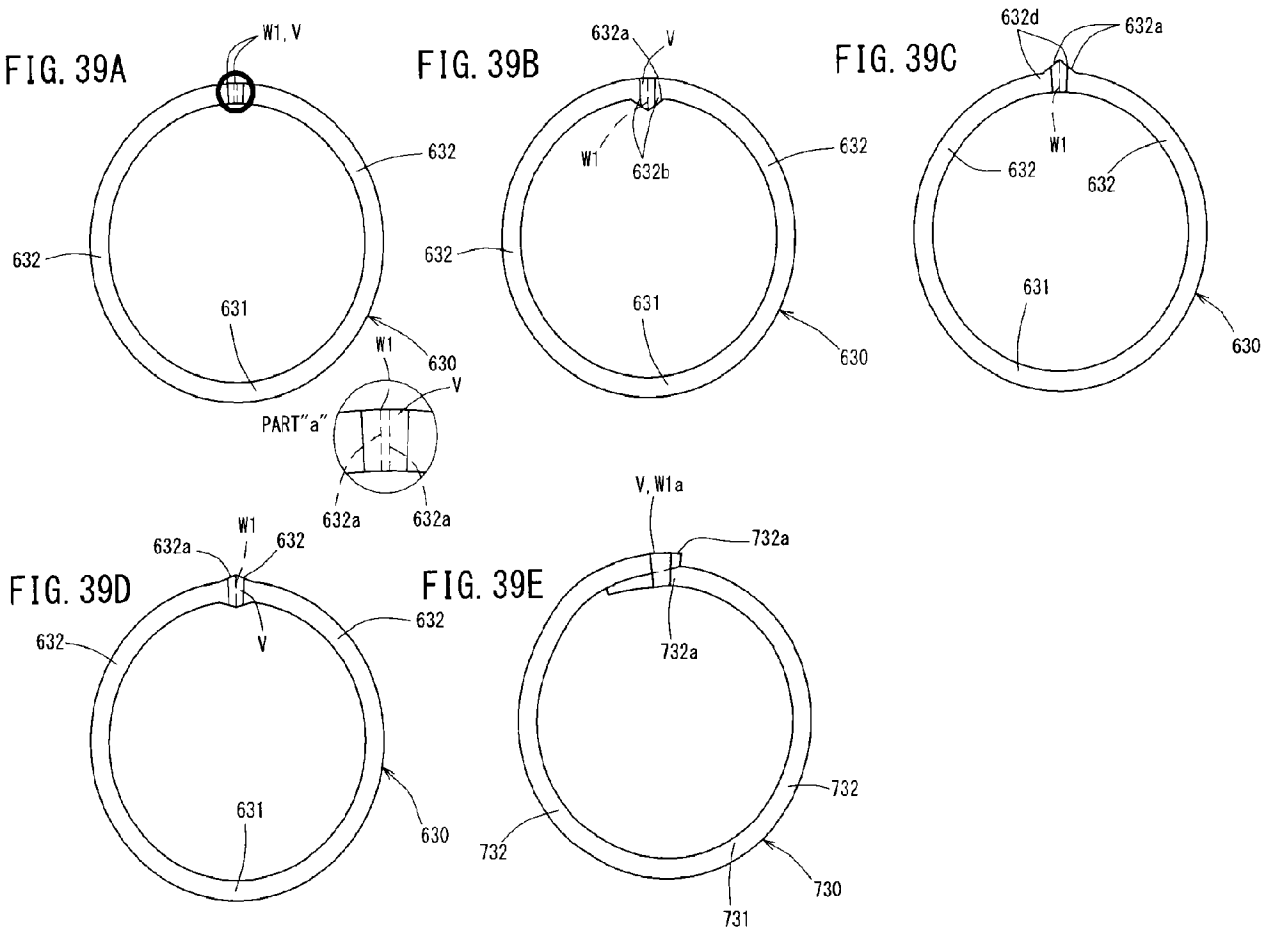

FIGS. 39(*a*) to 39(*e*) are views for explaining a further embodiment in the pressure-bonding section.

Figures 40A, 40B, 40C:
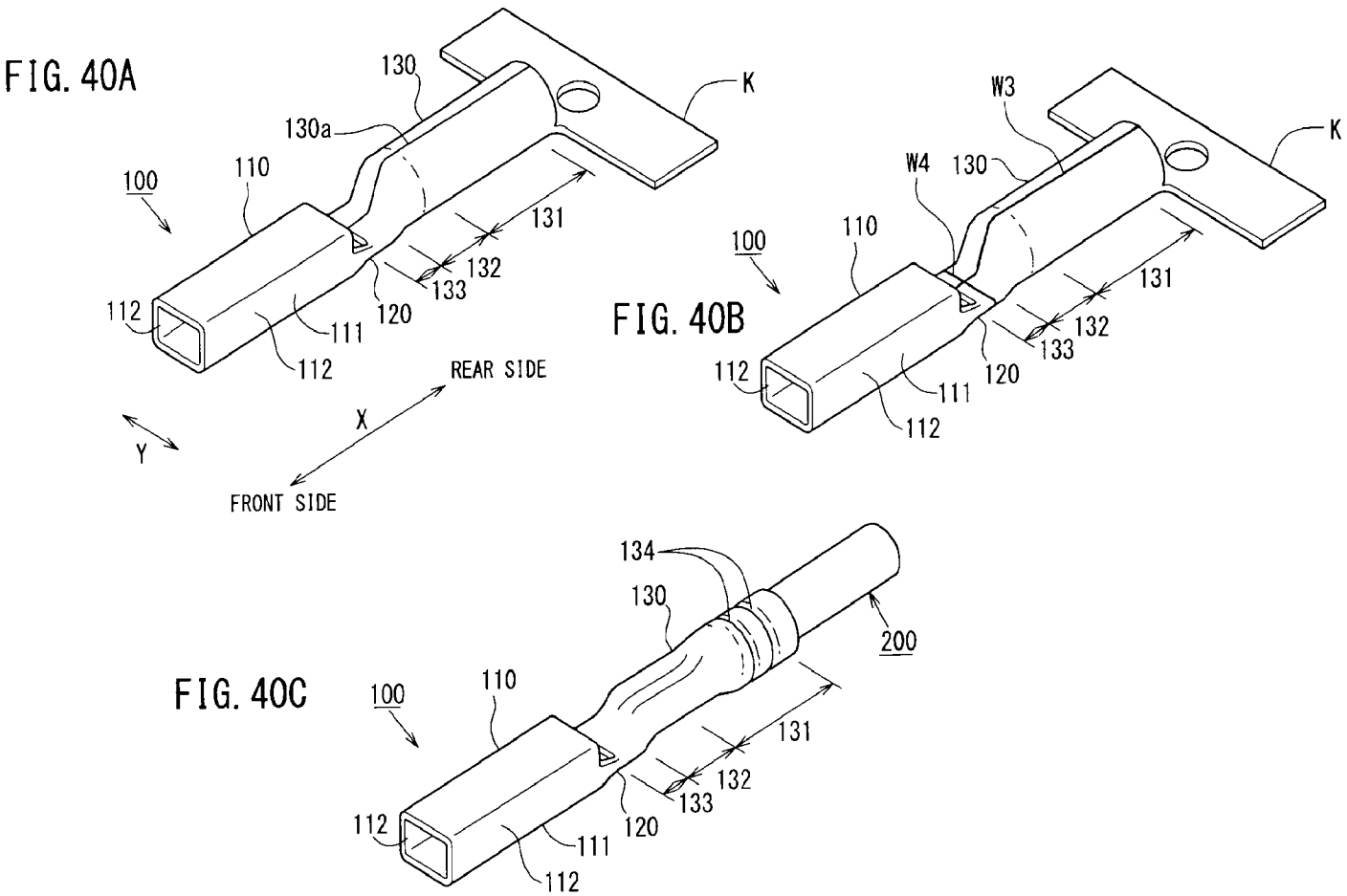

FIGS. 40(*a*) to 40(*c*) are views for explaining a further welding method in the barrel portion.

Figure 41A:
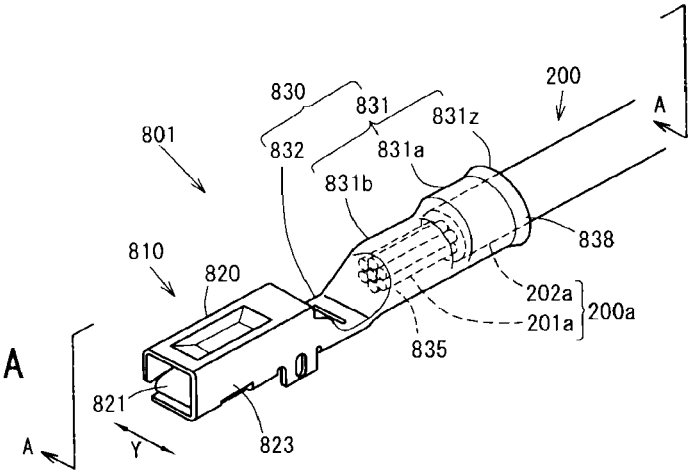
Figure 41B:
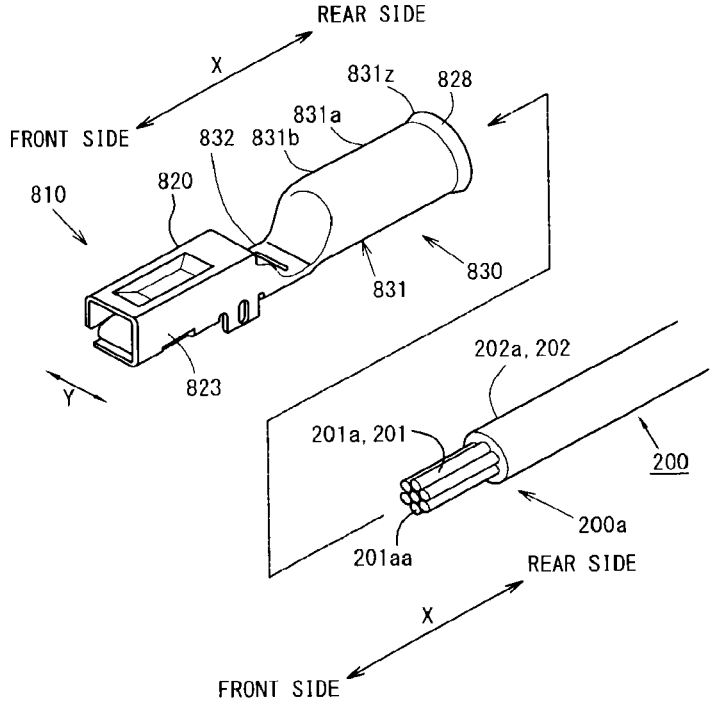

FIGS. 41(*a*) and 41(*b*) are views for explaining a wire having a crimp terminal according to a fifth embodiment.

Figure 42A:
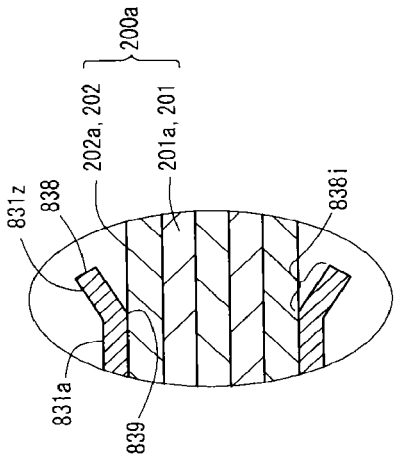
Figure 42A:
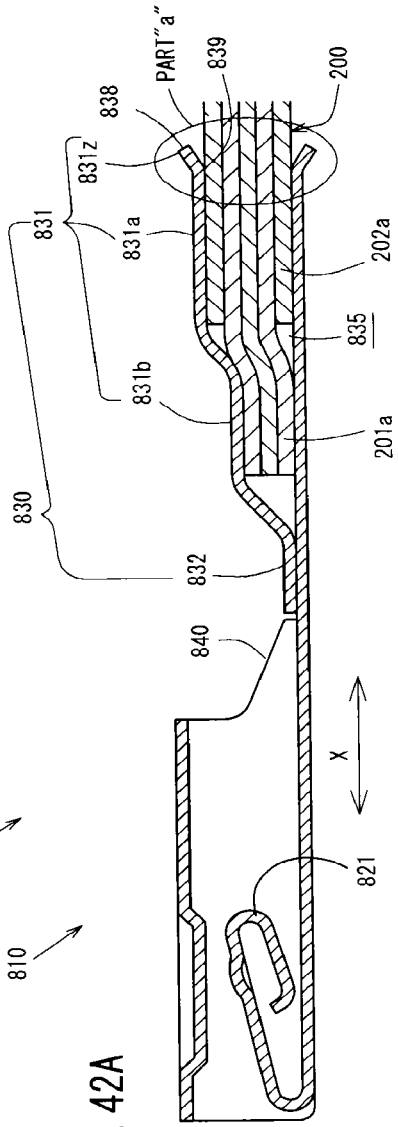

FIGS. 42(*a*) and 42(*b*) are longitudinal sectional views showing a center in a width direction of a tip part of the wire having a crimp terminal.

Figure 43A:
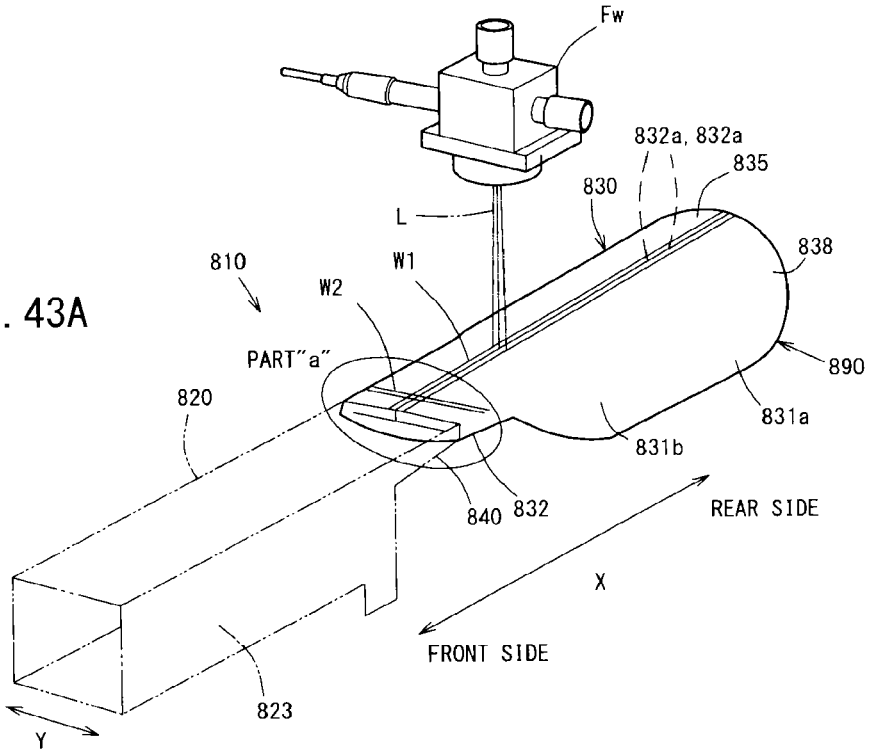
Figure 43A:
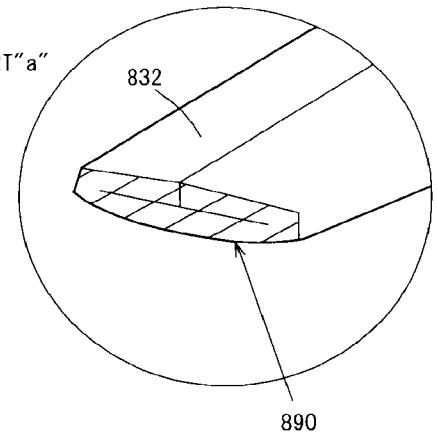

FIGS. 43(*a*) and 43(*b*) are views for explaining welding in a pressure-bonding section.

FIGS. 44(*a*) to 44(*d*) are explanatory views showing a situation in which the pressure-bonding section is pressure-bonded to the tip part of the wire.

Figure 45A:
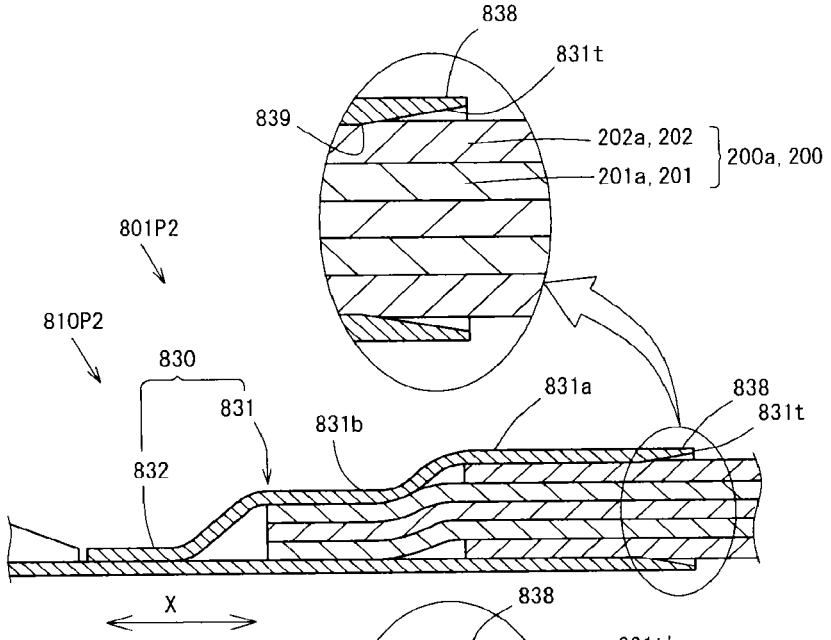
Figure 45B:
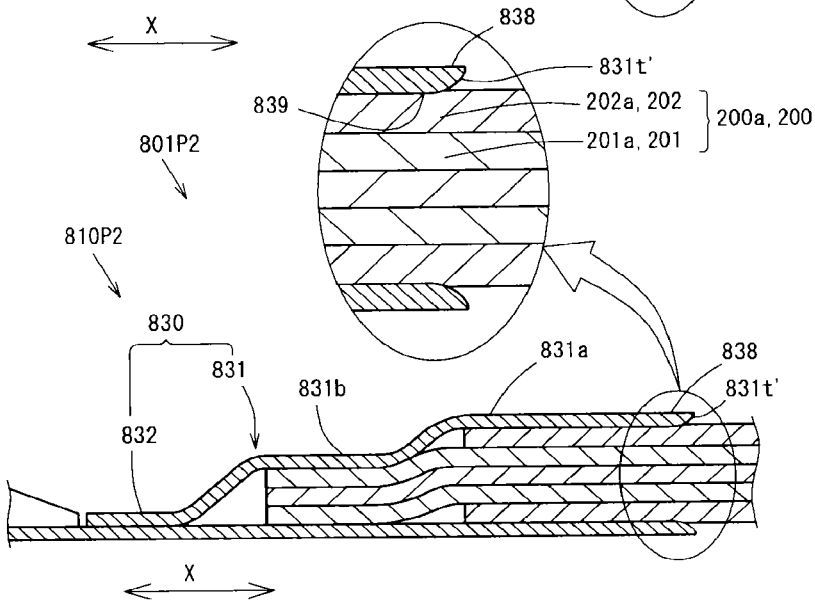

FIGS. 45(*a*) and 45(*b*) are views for explaining a wire having a crimp terminal according to a sixth embodiment and other embodiments.

Figure 46:
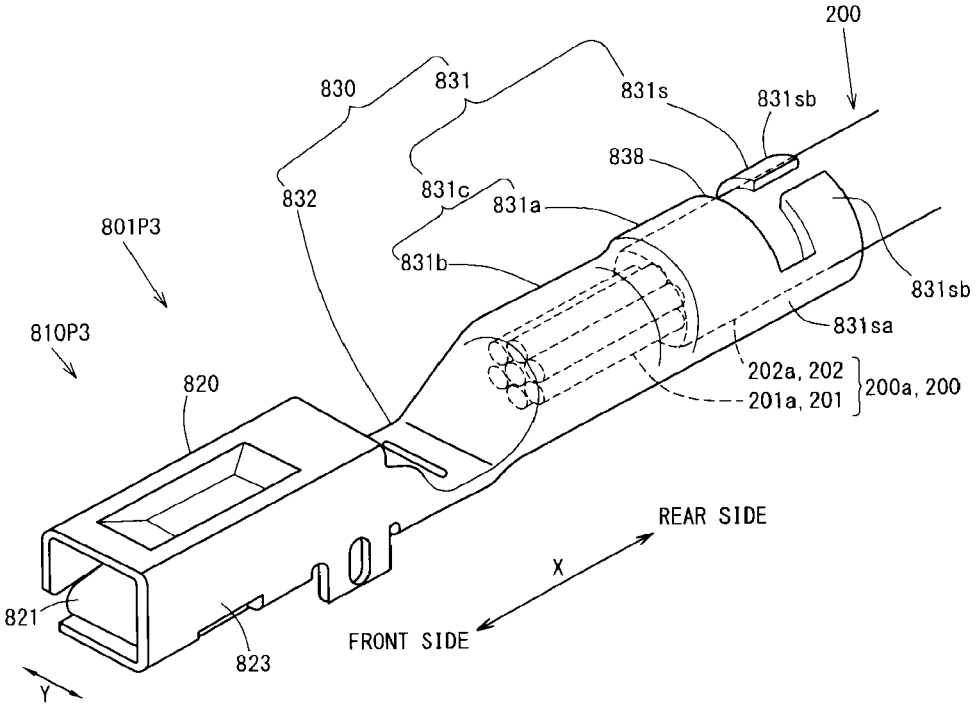

FIG. 46 is a view for explaining a wire having a crimp terminal according to a seventh embodiment.

Figure 47A:
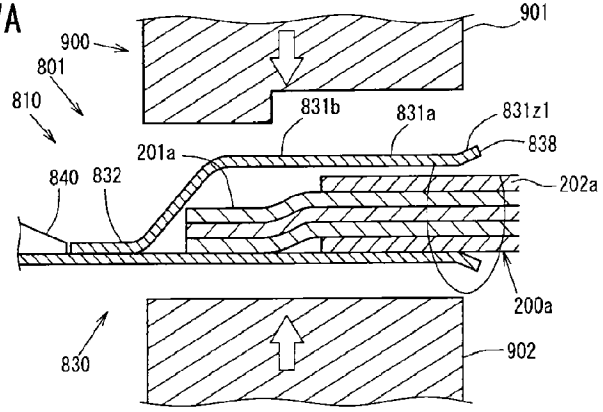
Figure 47B:
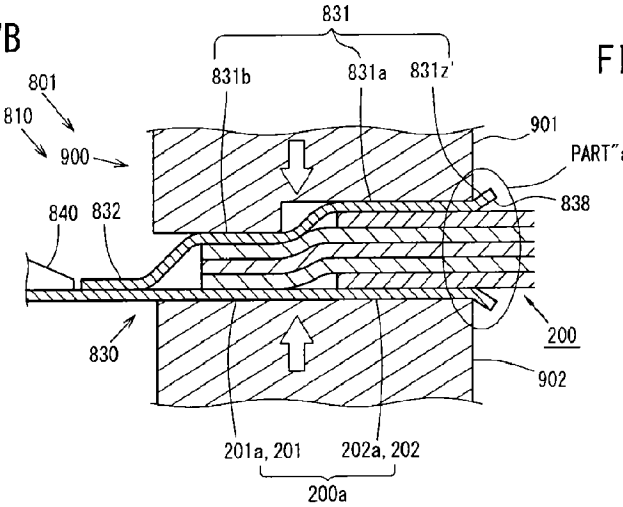
Figure 47C:
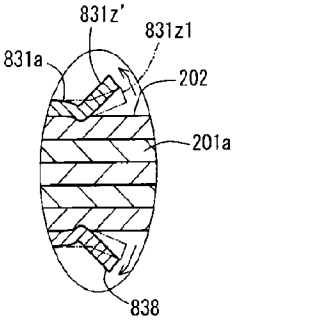

FIGS. 47(*a*) to 47(*c*) are explanatory views showing a situation in which a pressure-bonding section is pressure-bonded to a wire tip.

Figure 48:
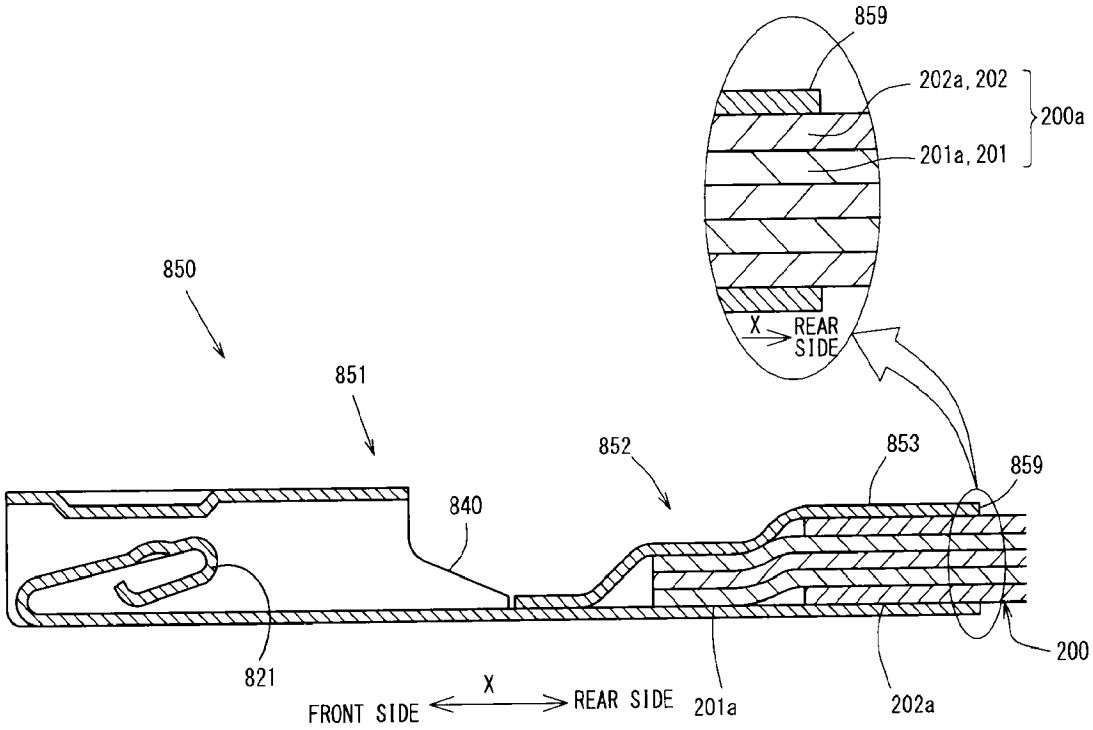

FIG. 48 is a view for explaining a conventional wire having a crimp terminal.

Figures 49A, 49B, 49C:
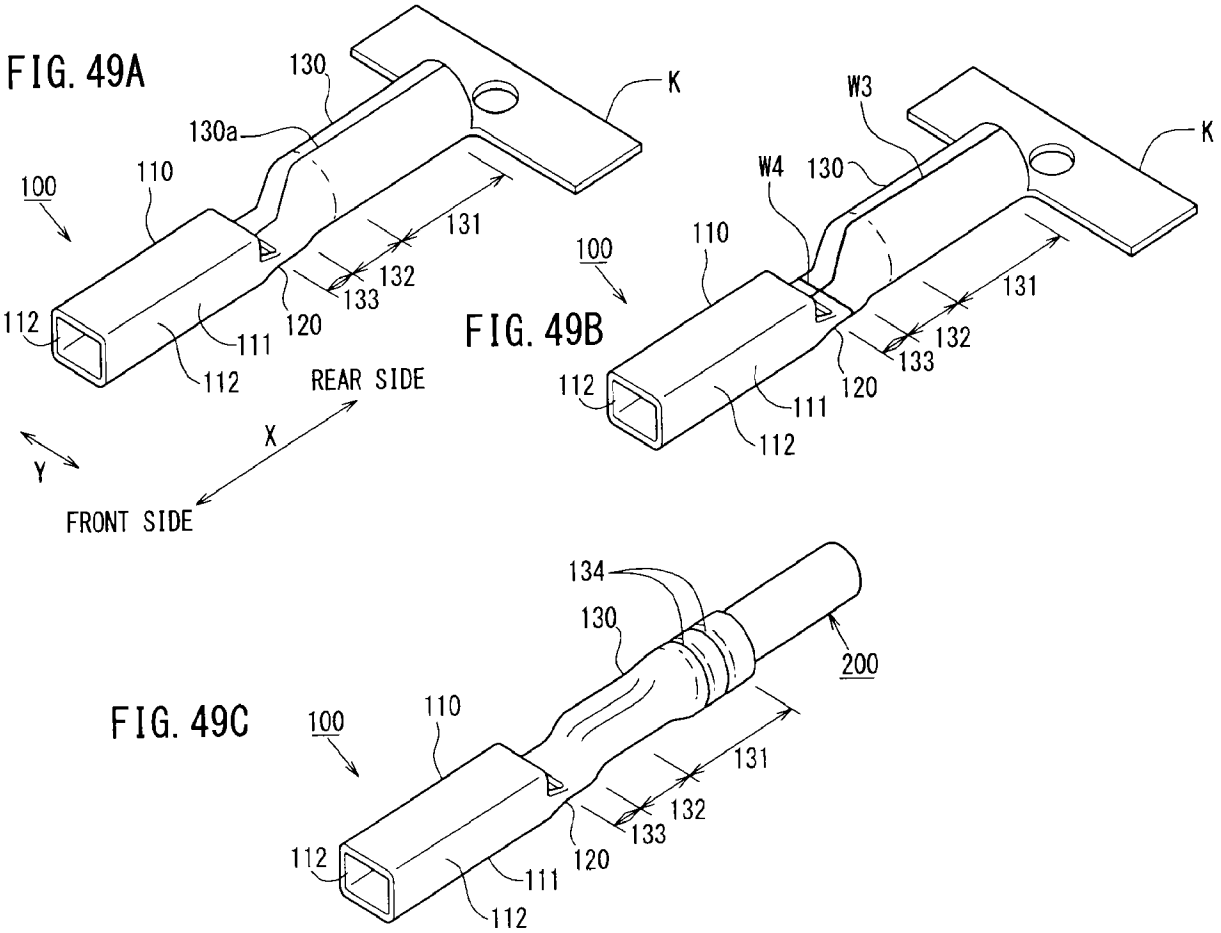

FIGS. 49(*a*) to 49(*c*) are views for explaining a further welding method in a barrel portion.

EMBODIMENTS OF THE INVENTION

First Embodiment

An embodiment according to the present invention will be described below in detail with reference to the drawings.

Figure 1A:
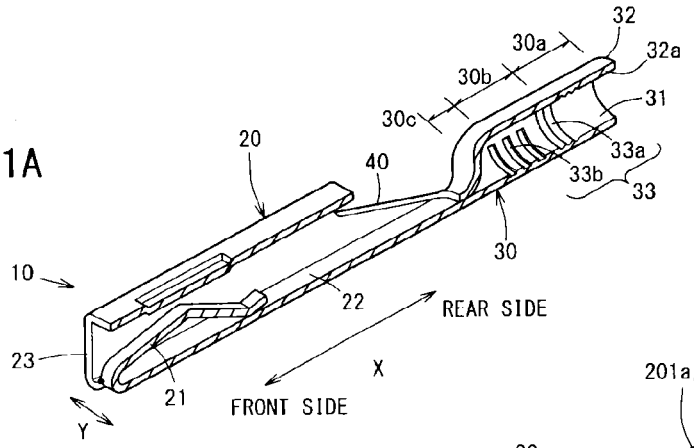
Figure 1B:
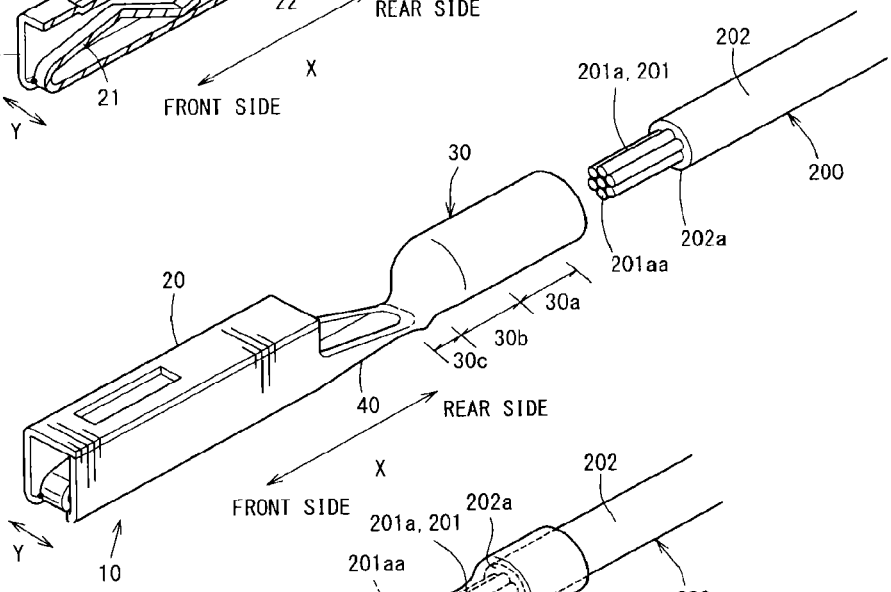
Figure 1C:
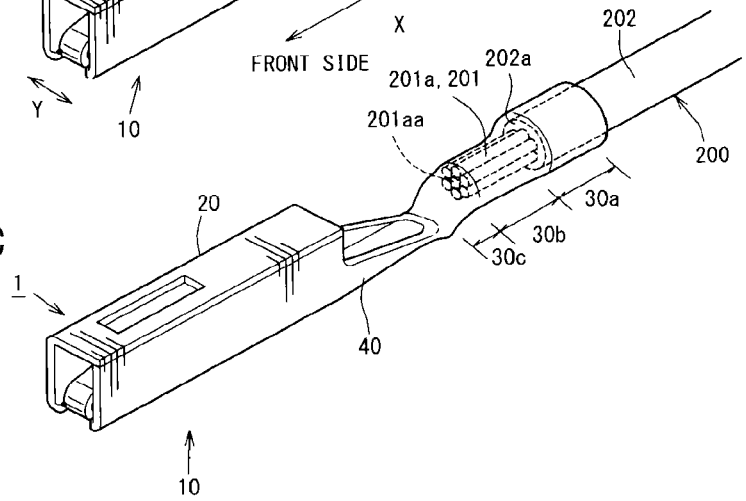
Figure 2A:
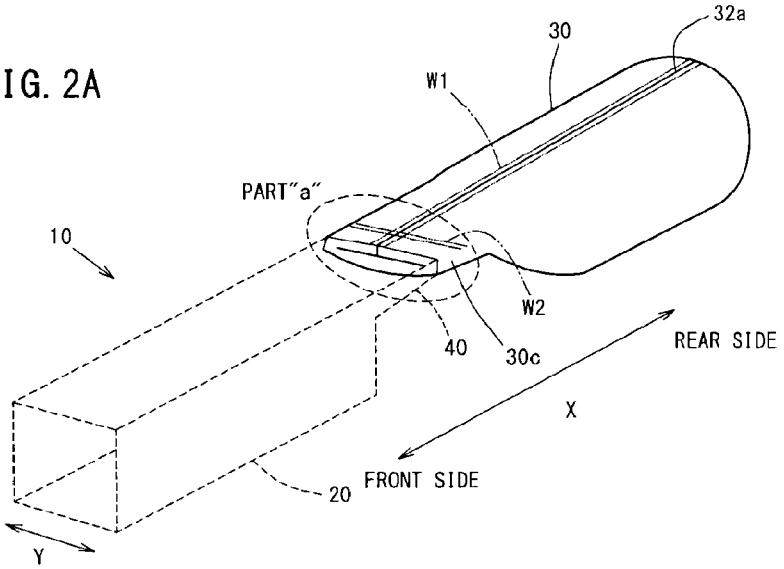
Figure 2C:
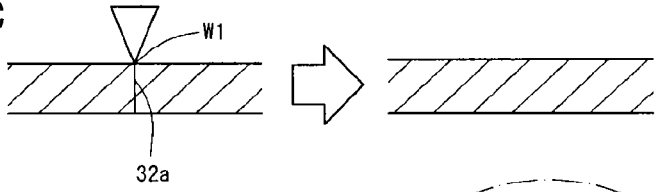
Figure 2B:
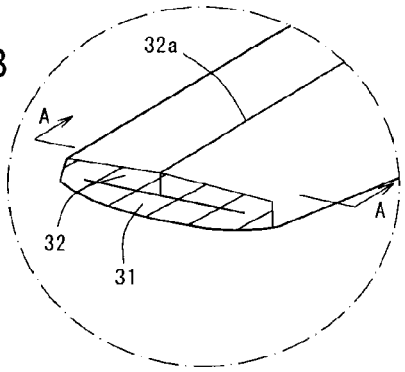
Figure 3:
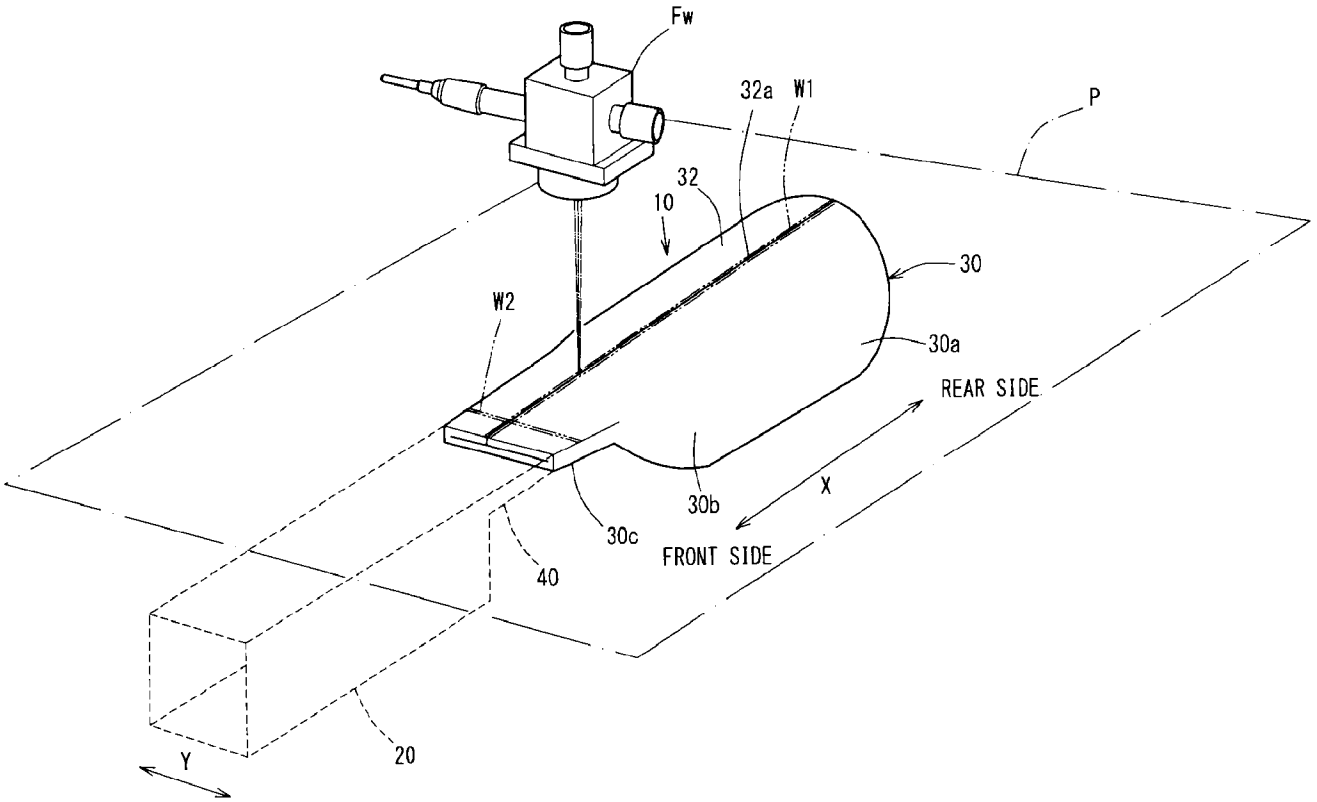
Figure 4A:
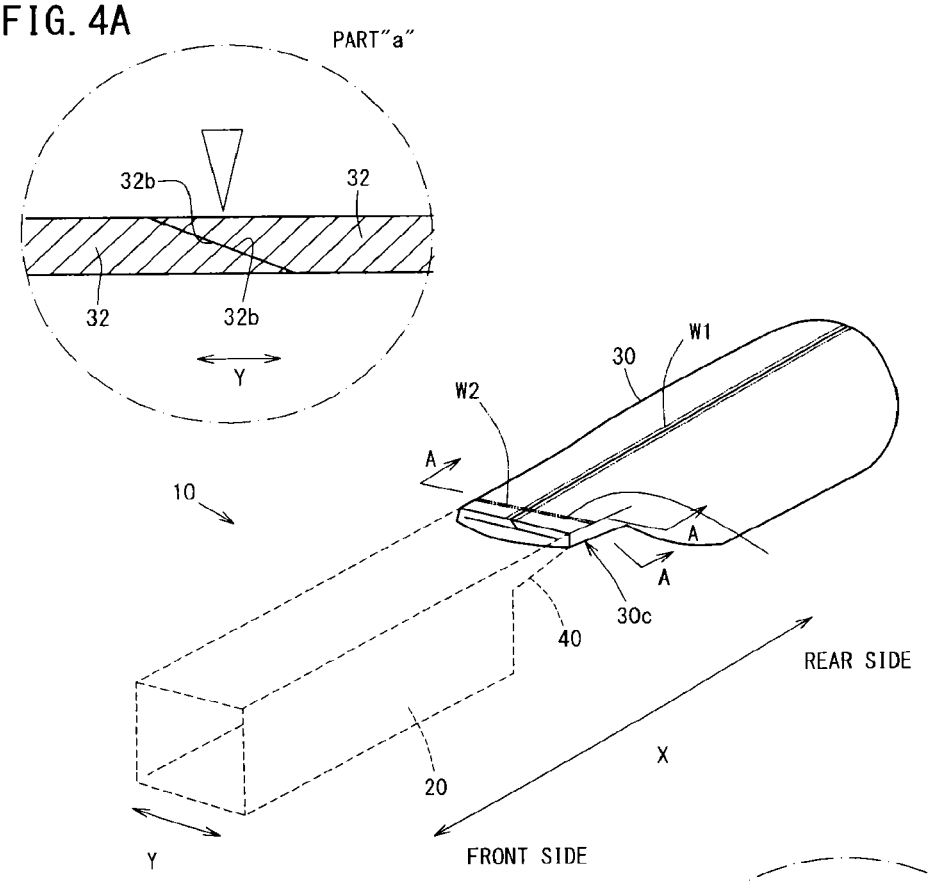
Figure 4B:
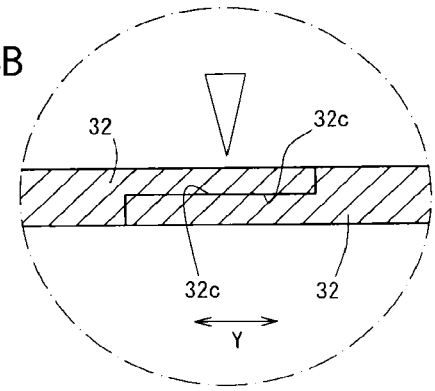
Figure 5A:
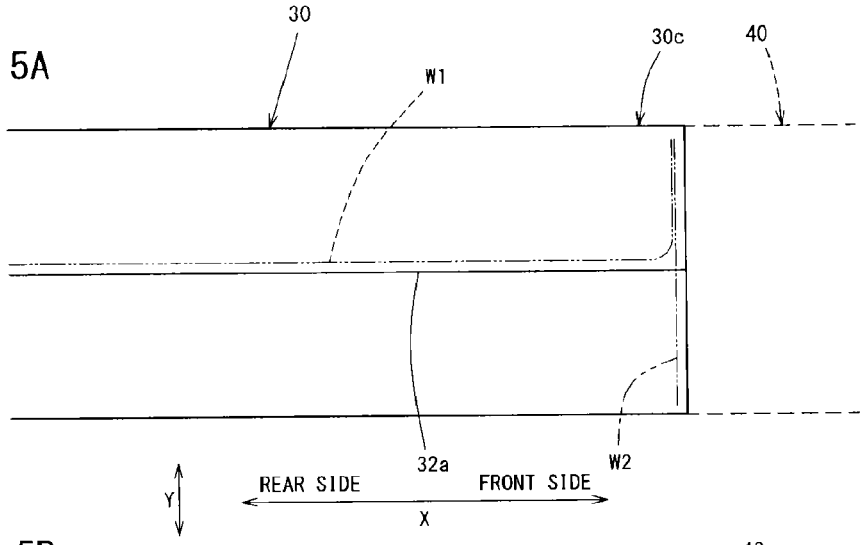
Figure 5B:
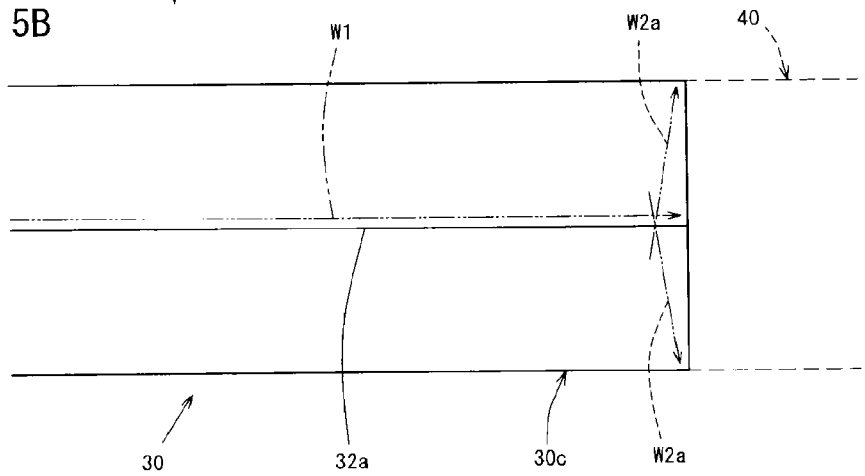

FIGS. 1(*a*) to 1(*c*) are views for explaining a female crimp terminal 10 for pressure-bonding and connecting an insulated wire 200, FIGS. 2(*a*), 2(*c*), and 2(*d*) are views for explaining welding in a pressure-bonding section 30, FIG. 3 is a perspective view showing a welding situation, FIGS. 4(*a*) and 4(*b*) are views for explaining opposed ends 32*a* of a barrel component piece 32, and FIGS. 5(*a*) and 5(*b*) are views for explaining a welding method.

Figure 6A:
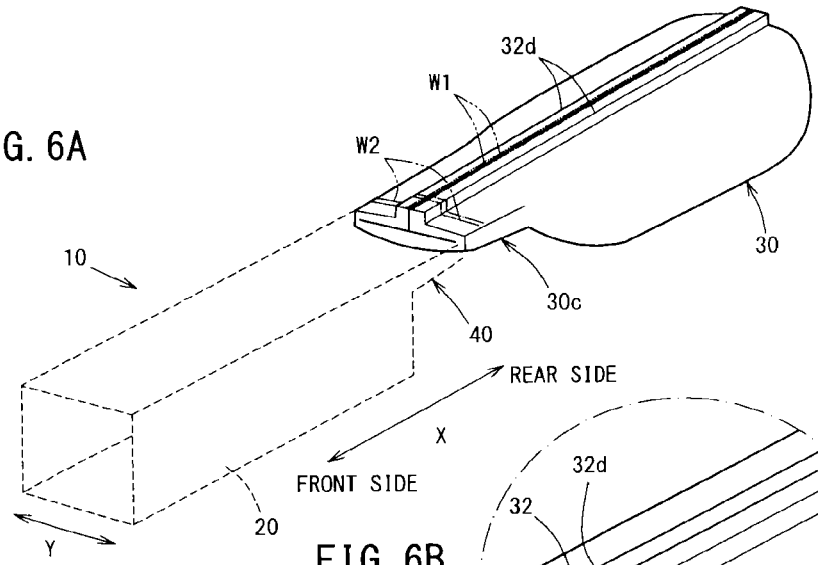
Figure 6B:
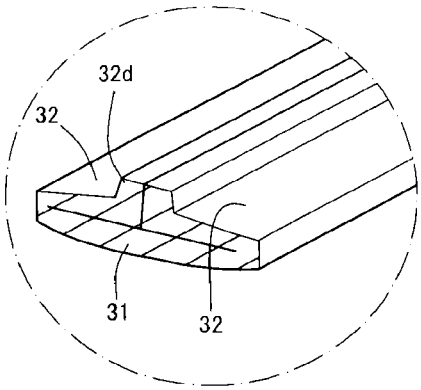
Figure 6C:
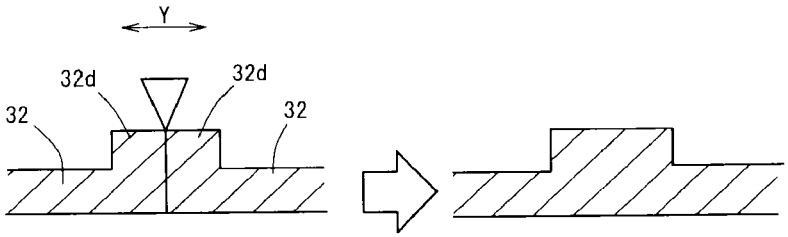
Figure 9A:
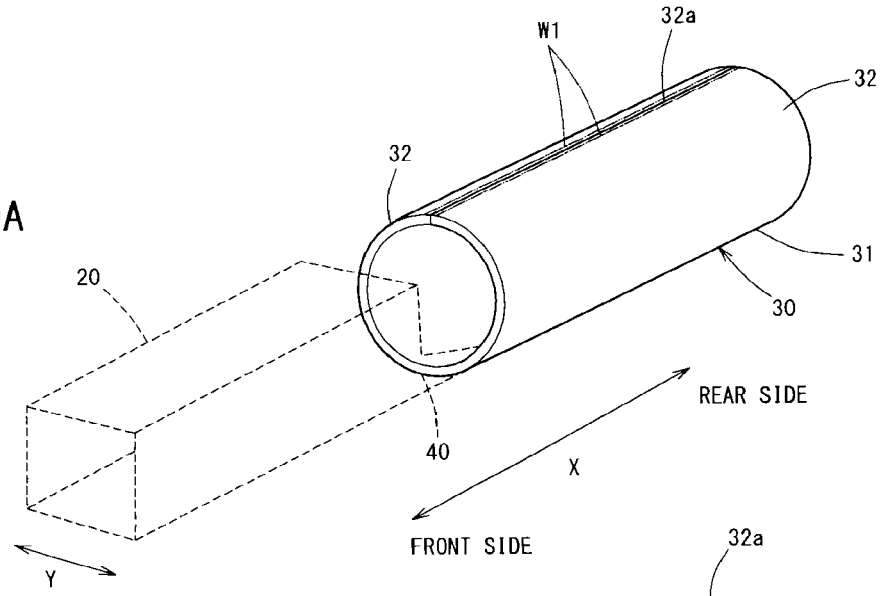
Figure 9B:
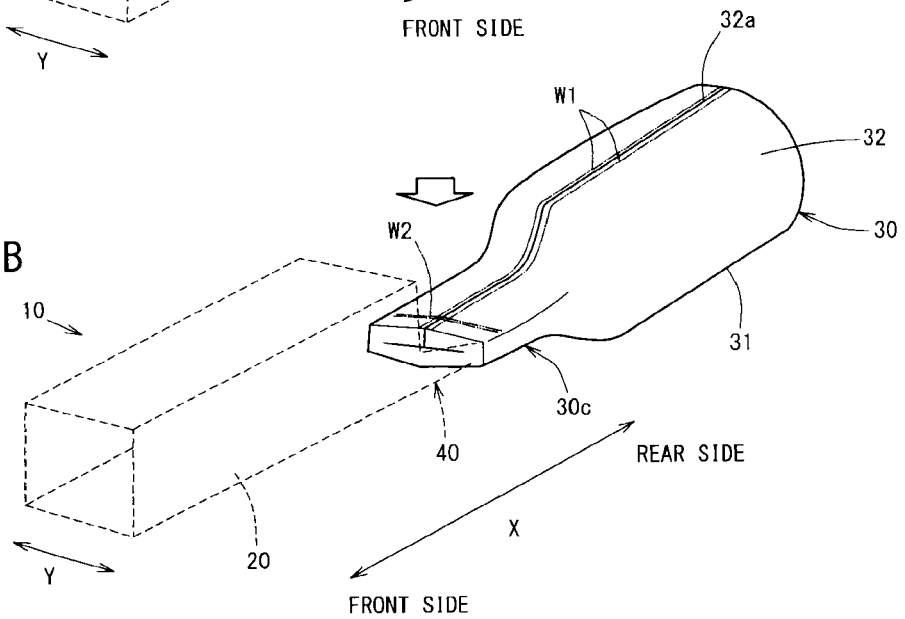
Figure 10A:
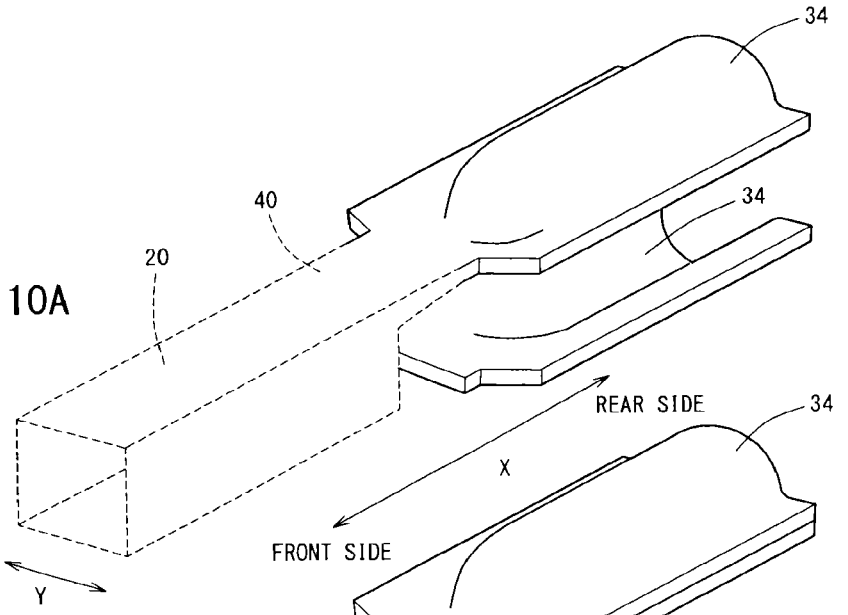
Figure 10B:
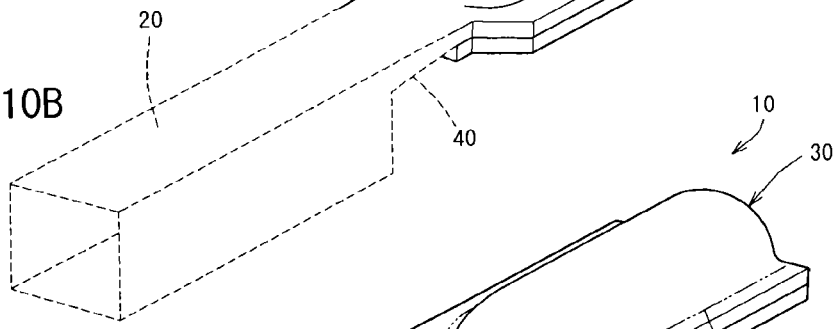
Figure 10C:
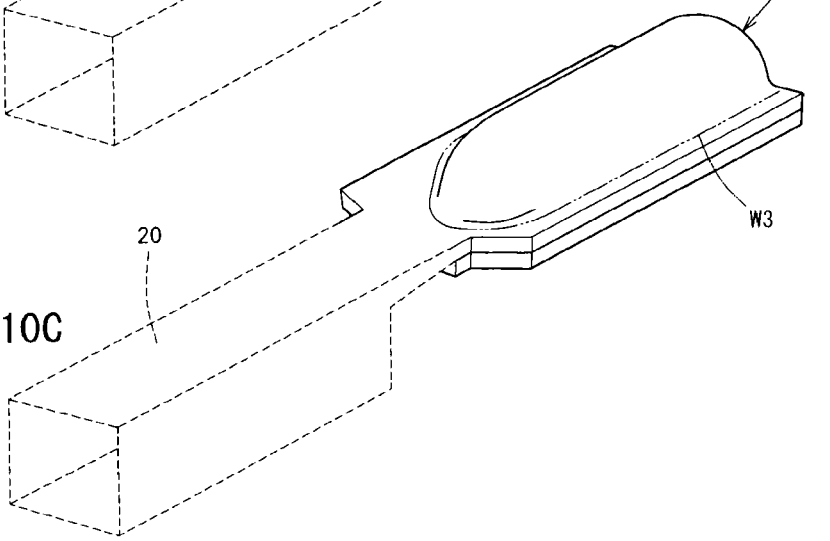

Moreover, FIGS. 6(*a*) to 7(*c*) are views for explaining a pressure-bonding section 30 having different welding configurations, FIGS. 8(*a*) to 8(*f*) are views for explaining an end of another barrel component piece 32, FIGS. 9(*a*) and 9(*b*) are views for explaining another welding procedure, and FIGS. 10(*a*) to 10(*c*) are views for explaining a pressure-bonding section 30 according to another embodiment.

FIG. 1(*a*) is a longitudinal sectional perspective view showing the female crimp terminal 10 which is divided on a center in a width direction, FIG. 1(*b*) is a perspective view showing a pre-pressure-bonding state of the female crimp terminal 10 and the insulated wire 200, and FIG. 1(*c*) is a perspective view showing a pressure-bonding connection structural body 1 in a pressure-bonding state in which the insulated wire 200 is pressure-bonded by the pressure-bonding section 30.

FIG. 2(*a*) is a schematic perspective view showing a bottom face side of the female crimp terminal 10 in which a box section 20 is set into a transmissive state, FIG. 2(*b*) is an enlarged view showing a part "a" in FIG. 2(*a*), and FIG. 2(*c*) is a view for explaining a welding situation through A-A line sectional view in FIG. 2(*b*).

FIG. 4(*a*) is a schematic perspective view showing the bottom face side of the female crimp terminal 10 in which the box section 20 is set into the transmissive state and the opposed ends 32*a* of the barrel component piece 32 configuring the pressure-bonding section 30 take another shape, FIG. 4(*b*) is A-A line sectional view in FIG. 4(*a*), and FIG. 4(*c*) is A-A line sectional view in which the opposed ends 32*a* take a further different shape.

FIG. 5(*a*) is a schematic enlarged bottom view showing the case in which a different method from the welding method illustrated in FIG. 3 is employed, and FIG. 5(*b*) is a schematic enlarged bottom view showing the case in which a further different welding method is employed.

The pressure-bonding connection structural body 1 according to the present embodiment is configured with the insulated wire 200 connected to the female crimp terminal 10. In other words, a wire exposed portion 201*a* of an aluminum core wire 201 which is exposed from an insulated tip 202*a* of an insulating cover 202 in the insulated wire 200 is pressure-bonded and connected to the pressure-bonding section 30 of the female crimp terminal 10.

The insulated wire 200 to be pressure-bonded and connected to the female crimp terminal 10 is configured by covering the aluminum core wire 201 obtained by bundling aluminum raw wires with the insulating cover 202 formed by an insulating resin. This will be described in more detail. The aluminum core wire 201 is configured by twisting aluminum alloy wires so as to have a section of 0.75 mm2.

The female crimp terminal 10 will be described below in more detail. The female crimp terminal 10 is obtained by integrally configuring the box section 20 and the pressure-bonding section 30. The box section 20 permits insertion of an insertion tab in a male terminal which is not shown from a front part being a tip side in a long length direction X toward a rear part and the pressure-bonding section 30 is disposed behind the box section 20 with a transition section 40 having a predetermined length interposed therebetween.

In the present embodiment, as described above, there is employed the female crimp terminal 10 configured from the box section 20 and the pressure-bonding section 30. However, it is also possible to employ any crimp terminal having the pressure-bonding section 30, for example, a male crimp terminal configured from an insertion tab to be inserted and connected to the box section 20 in the female crimp terminal 10 and the pressure-bonding section 30 if it is a crimp terminal having the pressure-bonding section 30. Moreover, it is also possible to employ a crimp terminal configured from only the pressure-bonding section 30 and serving to bundle and connect the aluminum core wires 201 of the insulated wires 200.

Furthermore, the long length direction X is coincident with a long length direction of the insulated wire 200 for pressure-bonding and connecting the pressure-bonding section 30 as shown in FIG. 1(*b*), and a width direction Y intersects with the long length direction X in an almost horizontal planar direction. Moreover, a side of the box section 20 with respect to the pressure-bonding section 30 is set to be a forward part, and reversely, a side of the pressure-bonding section 30 with respect to the box section 20 is set to be a rearward part.

Moreover, the female crimp terminal 10 is a closed barrel type terminal which is configured by punching a copper alloy strip (not shown) such as brass having a surface tin plated (Sn plated) into a two-dimensional developed terminal shape and then carrying out bending into a three-dimensional terminal shape including the box section 20 being a hollow quadrangular prismatic body and the pressure-bonding section 30 taking an almost O shape as seen from a rear side, and welding the pressure-bonding section 30. In the present embodiment, a copper alloy strip having a plate thickness of 0.1 to 0.6 mm is used.

The box section 20 is configured from an inverted hollow quadrangular prismatic body and includes an elastic contact piece 21 which is bent rearward in the long length direction X and comes in contact with an insertion tab (not shown) of a male connector to be inserted.

Moreover, the box section 20 taking the shape of the hollow quadrangular prismatic body is configured to take an almost rectangular shape as seen from a tip side in the long length direction X in a state in which side surface portions 23 linked to both side parts in the width direction Y that is orthogonal to the long length direction X of a bottom face portion 22 are bent to overlap with each other.

The pressure-bonding section 30 in a pre-pressure-bonding state is formed in an almost O shape as seen from a rear side by rounding a pressure-bonding surface 31 and the barrel component piece 32 extended to both sides in the width direction Y of the pressure-bonding surface 31 and butting and welding the ends 32*a* as shown in FIG. 1(*b*).

A length in the long length direction of the barrel component piece 32 is set to be greater than an exposure length in the long length direction X of the wire exposing portion 201*a* exposed in the forward part of the long length direction X from the insulated tip 202*a* being a tip on the forward side in the long length direction X of the insulating cover 202.

The pressure-bonding section 30 integrally configures a cover pressure-bonding range 30*a* for pressure-bonding the insulating cover 202 and a wire pressure-bonding range 30*b* for pressure-bonding the wire exposing portion 201*a* of the aluminum core wire 201, and furthermore, configures a sealing portion 30*c* (see FIG. 2(*a*)) in which an end farther forward than the wire pressure-bonding range 30*b* is deformed to be flattened into an almost flat plate.

Furthermore, engagement grooves 33 (33*a*, 33*b*) that are grooves in the width direction Y are formed on an internal surface of the pressure-bonding section 30 at a predetermined interval in the long length direction X.

This will be described in more detail. Three cover engagement grooves 33*a* that are the grooves in the width direction Y are formed on an internal surface of the cover pressure-bonding range 30*a* at a predetermined interval in the long length direction X. The insulating cover 202 bites into the cover engagement grooves 33*a* in a pressure-bonding state.

The cover engagement grooves 33*a* are configured to each have an arcuate section and are provided continuously in the long length direction to take a wavy shape, and furthermore, are continuous over the pressure-bonding surface 31 and the barrel component piece 32 extended from both sides in the width direction Y of the pressure bonding surface 31, thereby forming ring-shaped grooves in the pressure-bonding section 30.

Moreover, three wire engagement grooves 33*b* that are the grooves in the width direction Y are formed on an internal surface of the wire pressure-bonding range 30*b* at a predetermined interval in the long length direction X. The aluminum core wire 201 of the insulated wire 200 bites into the wire engagement grooves 33*b* in the pressure-bonding state.

The wire engagement grooves 33*b* are configured to each take a rectangular concave section, and furthermore, are formed on the pressure-bonding surface 31 and up to the middle of the barrel component piece 32 extended from both sides in the width direction Y of the pressure-bonding surface 31, and the aluminum core wire 201 bites into the wire engagement grooves 33*b* so that conductivity between the pressure-bonding section 30 and the aluminum core wire 201 can be enhanced.

Welding for forming the pressure-bonding section 30 thus configured will be described with reference to FIG. 3.

As described above, the pressure-bonding section 30 formed to take the almost O shape as seen from a rear side by rounding the pressure-bonding surface 31 and the barrel component piece 32 and butting and welding the opposed ends 32*a* of the barrel component piece 32 is configured by welding a long length direction weld portion W1 in the long length direction X where the opposed ends 32*a* of the barrel component piece 32 are butted each other and a width direction weld portion W2 in the width direction Y for perfectly sealing the forward part of the pressure-bonding section 30 in the sealing portion 30*c* as shown in FIG. 3.

This will be described in more detail. The pressure-bonding surface 31 and the barrel component piece 32 in the pressure-bonding section 30 are rounded and formed cylindrically in such a manner that the opposed ends 32*a* are butted each other at a bottom face side, and cylindrical forward parts are pushed against the bottom face side from an upper surface side and are thus deformed like an almost flat plate. Then, the long length direction weld portion W1 in the long length direction X where the cylindrical opposed ends 32*a* are butted each other is welded (see FIG. 2(*c*)). Thereafter, the width direction weld portion W2 in the width direction Y is welded so that the pressure-bonding section 30 is finished.

At this time, the long length direction weld portion W1 and the width direction weld portion W2 are disposed on almost the same plane in a virtual plane P shown in FIG. 3. Therefore, it is possible to weld them by laser welding on a single focal point.

A fiber laser welding device Fw is used herein in the laser welding for the long length direction weld portion W1 and the width direction weld portion W2. The fiber laser welding uses a fiber laser beam having a wavelength of about 1.06 to 1.08 μm. A fiber laser has a high light condensing performance. Therefore, it is possible to easily realize welding with a high energy density.

Thus, the pressure-bonding section 30 formed cylindrically by bending the pressure-bonding surface 31 and the barrel component piece 32 and having the sealing portion 30*c* deformed like the almost flat plate can be configured with water-blocking performance because the long length direction weld portion W1 and the width direction weld portion W2 are welded by the fiber laser welding.

Specifically, the female crimp terminal 10 including at least the pressure-bonding section 30 for permitting pressure-bonding and connection to the aluminum core wire 201 of the insulated wire 200 has the pressure-bonding section 30 formed cylindrically by a plate material, and furthermore, the long length direction weld portion W1 in the long length direction X is welded through the plate material. In the pressure-bonding state in which the aluminum core wire 201 is pressure-bonded by the pressure-bonding section 30, consequently, it is possible to prevent water from intruding an inner part, thereby ensuring reliable the water-blocking performance by sealing a front end side in the long length direction X of the cylindrical pressure-bonding section 30.

Moreover, it is possible to prevent degradation or aged deterioration from occurring without exposing the aluminum core wire 201 in the pressure-bonding section 30 to outside air. Accordingly, galvanic corrosion does not occur in the aluminum core wire 201 so that electric resistance can also be prevented from being raised due to the galvanic corrosion. Therefore, it is possible to obtain stable conductivity.

This will be described in more detail. The pressure-bonding section 30 is formed cylindrically by bending the pressure-bonding surface 31 and the barrel component piece 32, the long length direction weld portion W1 in the long length direction X for the opposed ends 32*a* of the barrel component piece 32 is welded, and furthermore, the front end side in the long length direction X of the cylindrical pressure-bonding section 30 is sealed to configure the sealing portion 30*c*. Consequently, the aluminum core wire 201 of the insulated wire 200 is prevented from being exposed to the outside of the pressure-bonding section 30. Thus, it is possible to carry out pressure-bonding into a wrapping state with the water-blocking performance.

Moreover, the forward part in the long length direction X in the pressure-bonding section 30 is caused to be almost flat plate-shaped for sealing and the width direction weld portion W2 in the width direction Y is welded. By simply pressure-bonding the pressure-bonding section 30 in which the aluminum core wire 201 is inserted, consequently, it is possible to carry out the bonding into the wrapping state with the water-blocking performance without exposing the aluminum core wire 201 of the insulated wire 200 from being exposed to the outside of the pressure-bonding section 30.

This will be described in more detail. The forward part in the long length direction X in the pressure-bonding section 30 is previously set to take the shape of the almost flat plate for sealing, and the width direction weld portion W2 in the width direction Y is welded to configure the sealing portion 30*c*. Therefore, portions other than an insertion portion where the aluminum core wire 201 is inserted into the cylindrical pressure-bonding section 30, that is, portions other than a rear opening portion of the pressure-bonding section 30 are sealed. By simply pressure-bonding the pressure-bonding section 30 where the aluminum core wire 201 is inserted, it is possible to prevent the aluminum core wire 201 of the insulated wire 200 from being exposed to the outside of the pressure-bonding section 30. Thus, it is possible to carry out the pressure-bonding into the wrapping state with the water-blocking performance.

As a method of manufacturing the female crimp terminal 10 including the pressure-bonding section 30 for permitting pressure-bonding and connection to the aluminum core wire 201 of the insulated wire 200, the pressure-bonding surface 31 and the barrel component piece 32 are bent and formed cylindrically and are deformed like the almost flat plate to seal the forward part in the long length direction X, the opposed ends 32*a* of the barrel component piece 32 formed cylindrically are butted each other to weld the long length direction weld portion W1 in the long length direction X, and the sealing portion 30*c* deformed like the almost flat plate is welded as the width direction weld portion W2 in the width direction Y to configure the pressure-bonding section 30. In this manner, a pressing processing step and a welding step are carried out in this order, the pressing processing step in which the pressure-bonding surface 31 and the barrel component piece 32 are bent and formed cylindrically and are subjected to shape processing to be the almost flat plate to seal the forward part in the long length direction X, the welding step carried out in the long length direction X and the width direction Y. Consequently, it is possible to manufacture the female crimp terminal 10 more efficiently.

By setting the long length direction weld portion W1 in the long length direction X and the width direction weld portion W2 in the width direction Y onto a virtual plane P, moreover, it is possible to easily move a welding device for laser welding or the like, thereby carrying out the welding reliably, for example.

Furthermore, the pressure-bonding section 30 is configured from the pressure-bonding surface 31 and the barrel component piece 32 extended from both sides in the width direction of the pressure-bonding surface 31, and the barrel component piece 32 is bent and formed to take a ring-shaped section, and furthermore, the opposed ends 32*a* of the barrel component piece 32 are butted each other and the long length direction weld portion W1 in the long length direction X is welded in the butting portion so that the pressure-bonding section 30 having the ring-shaped section is configured from the pressure-bonding surface 31 and the barrel component piece 32, and furthermore, the butting portion obtained by the opposed ends 32*a* of the barrel component piece 32 is welded as the long length direction weld portion W1 in the long length direction X. Consequently, it is possible to form the pressure-bonding section 30 sealed reliably.

Moreover, the welding is performed through the fiber laser welding to form the pressure-bonding section 30 having no gap. Consequently, it is possible to reliably prevent water from intruding the inner part of the pressure-bonding section 30 in the pressure-bonding state. Referring to the fiber laser welding, furthermore, it is possible to adjust a focal point into a minimal spot, to realize laser welding at a high output density and to enable continuous irradiation as compared with other laser welding. Accordingly, it is possible to carry out welding having reliable water-blocking performance.

Next, description will be given to the pressure-bonding connection structural body 1 which is configured by connecting the insulated wire 200 to the female crimp terminal 10 having the structure described above. As described above, the pressure-bonding connection structural body 1 is formed by performing the bending and pressure-bonding the aluminum core wire 201 of the insulated wire 200 to the pressure-bonding section 30 having the forward part sealed with the sealing portion 30*c* having the front end deformed like the almost flat plate (see FIG. 1(*c*)).

This will be described in more detail. The insulated wire 200 is disposed in the pressure bonding section 30 in such a manner that a position in the long length direction X of a tip 201 as of the wire exposing portion 201*a* of the aluminum core wire 201 which is exposed at a side closer to the tip than the insulating cover 202 of the insulated wire 200 is placed behind the sealing portion 30*c* in the pressure-bonding section 30.

Then, a part from the tip 201*aa* of the wire exposing portion 201*a* to a portion behind the insulated tip 202*a* of the insulating cover 202 is once pressure-bonded by the pressure-bonding section 30 and is thus surrounded integrally as shown in FIG. 1(*c*).

Consequently, the pressure-bonding section 30 is pressure-bonded in a close contact state with peripheral surfaces of the insulating cover 202 of the insulated wire 200 and the wire exposing portion 201*a* of the aluminum core wire 201.

The long length direction weld portion W1 of the pressure-bonding section 30 is welded in the long length direction X, and the scaling portion 30*c* of the pressure-bonding section 30 is deformed like the almost flat plate to weld the width direction weld portion W2. In the pressure-bonding state, therefore, there is realized the water-blocking performance in which water does not intrude the inner part of the pressure-bonding section 30 from the forward part of the pressure-bonding section 30 and the outside.

Moreover, the insulating cover 202 of the insulated wire 200 bites into the engagement groove 33*a* for the cover formed on the inside of the cover pressure-bonding range 30*a*. Therefore, it is also possible to enhance the water-blocking performance in the rear part of the pressure-bonding section 30.

In the pressure-bonding state, accordingly, the high water-blocking performance of the pressure bonding section 30 prevents the water from touching a contact portion in which the wire exposing portion 201*a* of the aluminum core wire 201 and the internal surface of the pressure-bonding section 30 are provided in close contact with each other.

Moreover, the aluminum core wire 201 is configured from an aluminum-based material and the pressure-bonding section 30 is configured from a copper-based material. Therefore, a weight can be reduced as compared with an insulated wire having a core wire formed by a copper wire.

As a result, galvanic corrosion does not occur in the aluminum core wire 201 and electric resistance is prevented from being raised due to the galvanic corrosion. Therefore, the conductivity of the aluminum core wire 201 is stabilized. As a result, the aluminum core wire 201 such as twisted wires, a single wire or a rectangular wire can be connected to the pressure-bonding section 30 of the female crimp terminal 10 reliably and strongly.

The pressure-bonding connection structural body 1 thus configured can form a connector having reliable conductivity by attaching the female crimp terminal 10 to a connector housing which is not shown.

This will be described in more detail. The pressure-bonding connection structural body 1 configured from the female crimp terminal 10 is attached to a female connector housing and thus configures a wire harness including a female connector, and furthermore, a pressure-bonding connection structural body (not shown) configured from a male crimp terminal (not shown) is attached to a male connector housing (not shown) and thus configures a wire harness including a male connector. By fitting the female connector and the male connector, it is possible to connect the wire harnesses to each other electrically and physically.

At this time, the pressure-bonding connection structural body 1 having the crimp terminal 10 and the insulated wire 200 connected thereto is attached to the connector housing. Therefore, it is possible to realize the connection of a wire harness having reliable conductivity.

In other words, the aluminum core wire 201 is integrally surrounded by the pressure-bonding section 30 and is not exposed to the outside. Regardless of exposure to outside air in the connector housing, therefore, it is possible to maintain an electrical connection state of the aluminum core wire 201 and the crimp terminal 10 in the pressure-bonding section 30. Therefore, it is possible to reliably maintain conductivity.

Referring to the pressure-bonding connection structural body 1 having the insulated wire 200 and the female crimp terminal 10 connected to each other through the pressure-bonding section 30 in the female crimp terminal 10, moreover, it is possible to configure the pressure-bonding connection structural body 1 capable of ensuring reliable water-blocking performance by simply carrying out surrounding and pressure-bonding through the pressure-bonding section 30 of the female crimp terminal 10. Therefore, it is possible to ensure stable conductivity.

Furthermore, a connector having the female crimp terminal 10 in the pressure-bonding connection structural body 1 disposed in the connector housing can connect the female crimp terminal 10 with stable conductivity ensured regardless of metal specified for configuring the female crimp terminal 10 and the aluminum core wire 201.

This will be described in more detail. For example, when the female connector and the male connector are fitted each other to connect the female crimp terminals 10 disposed in the connector housings of the respective connectors to each other, the female crimp terminals 10 of the respective connectors can be connected to each other with the water-blocking performance ensured.

In the description of the female crimp terminal 10, the opposed ends 32*a* of the barrel component piece 32 are perpendicular end surfaces to the surface and back faces of the barrel component piece 32, and the opposed ends 32*a* are butted each other to weld the long length direction weld portion W1. As shown in FIG. 4(*a*), however, the end surfaces 32*b* inclined in the same direction with respect to the surface and back faces of the barrel component piece 32 may be opposed and butted to weld the long length direction weld portion W1. In this case, the inclined end surfaces 32*b* partially overlap with each other in a front/back direction of the barrel component piece 32 even if the inclined end surfaces 32*b* expand in the width direction. Therefore, it is possible to reliably weld the long length direction weld portion W1.

Even if hook-shaped end surfaces 32*c* including concave portions each having a half thickness of a plate of the barrel component piece 32 are butted and welded as shown in FIG. 4(*b*), furthermore, it is possible to achieve the same effects.

In the above description, moreover, the long length direction weld portion W1 in the long length direction X is welded and the width direction weld portion W2 in the width direction Y is then welded to seal the sealing portion 30*c*. However, it is also possible to continuously dispose the long length direction weld portion W1 in the long length direction X and the width direction weld portion W2 in the width direction Y and to weld them unicursally as shown in FIG. 5(*a*).

By thus performing the welding, it is possible to continuously weld the long length direction weld portion W1 and the width direction weld portion W2. Therefore, the welding can efficiently be carried out. Moreover, the long length direction weld portion W1 and the width direction weld portion W2 are welded continuously so that the number of weld starting portions is decreased. In initial formation of a welding bead, that is, at start of weld penetration, therefore, the bead has not penetrated through the plate thickness yet in some cases. In those cases, therefore, it is necessary to contrive a way, for example, to weld two width direction weld portions W2*a* which are line symmetrical with respect to the long length direction weld portion W1.

As another method, there are supposed a method of controlling an output waveform to increase an output only at the beginning, a method of controlling a sweep rate to reduce the rate only at the beginning, and the like.

As shown in FIG. 5(*b*), furthermore, it is also possible to weld the two width direction weld portions W2*a* which are line symmetrical with respect to the long length direction weld portion W1 from a central side in the width direction Y toward an outside in the width direction across the long length direction weld portion W1 when welding the long length direction weld portion W1 in the long length direction X and then welding the width direction weld portion W2 in the width direction Y. By welding the two width direction weld portions W2*a* which are line symmetrical with respect to the long length direction weld portion W1 in place of the width direction weld portion W2 in the width direction Y, thus, it is possible to lessen a fear that insufficient welding might occur. Consequently, it is possible to realize reliable welding capable of ensuring the water-blocking performance.

For the same reason, the long length direction weld portion W1 may be welded from the vicinity of a center in the long length direction X toward one end side and may be then welded from the vicinity of the center in the long length direction X toward the other end side, which is not shown. At this time, weld starting positions are wrapped so that there is lessened a fear that the insufficient welding might be caused. Consequently, it is possible to realize reliable welding capable of ensuring the water-blocking performance.

As shown in FIGS. 6(*a*) and 6(*b*), furthermore, opposed abutting surface portions 32*d* formed on the ends of the barrel component piece 32 may be butted each other to weld the butting portion of the opposed abutting surface portions 32*d* as the long length direction weld portion W1 in the long length direction X. The opposed abutting surface portions 32*d* are opposed surfaces which are larger than sectional areas of the other portions in the barrel component piece 32. In this case, the opposed abutting surface portions 32*d* coming in face contact with each other are integrated by the fiber laser welding as shown in FIG. 6(*c*). Therefore, it is possible to enhance the water-blocking performance in the long length direction weld portion W1. The opposed abutting surface portions 32*d* may be formed by bending the ends of the barrel component piece 32 radially outward and may be previously formed to be thicker than the other portions of the barrel component piece 32.

In the butt portion, thus, the opposed abutting surface portions 32*d* having larger areas than the sectional areas of the other portions in the barrel component piece 32 are butted each other. Even in the case in which the butt portion is thinned by the butt welding, consequently, the weld portion has sufficient strength. For this reason, even if the weld portion is deformed by the pressure-bonding of the aluminum core wire 201, for example, it is possible to ensure sufficient welding strength, that is, sufficient water-blocking performance. Furthermore, in the case in which the opposed abutting surface portions 32*d* are protruded radially inward relative to the other portions, for example, the portions of the opposed abutting surface portion 32*d* protruded radially inward relative to the other portions bite into the aluminum core wire 201 in the pressure-bonding state so that the conductivity can be enhanced.

As shown in FIG. 8(*a*), moreover, the opposed abutting surface portions 32*d* may take a mode of radially inward protrusions relative to the other portions of the barrel component piece 32 configuring the pressure-bonding section 30. By contrast, the opposed abutting surface portions 32*d* may take a mode of radially outward protrusions (see FIG. 8(*b*)) or the opposed abutting surface portions 32*d* may take a mode of both radially inward and outward protrusions (see FIG. 8(*c*)). Thus, the opposed abutting surface portions 32*d* taking various modes can also achieve the effect thereof.

Figure 7A:
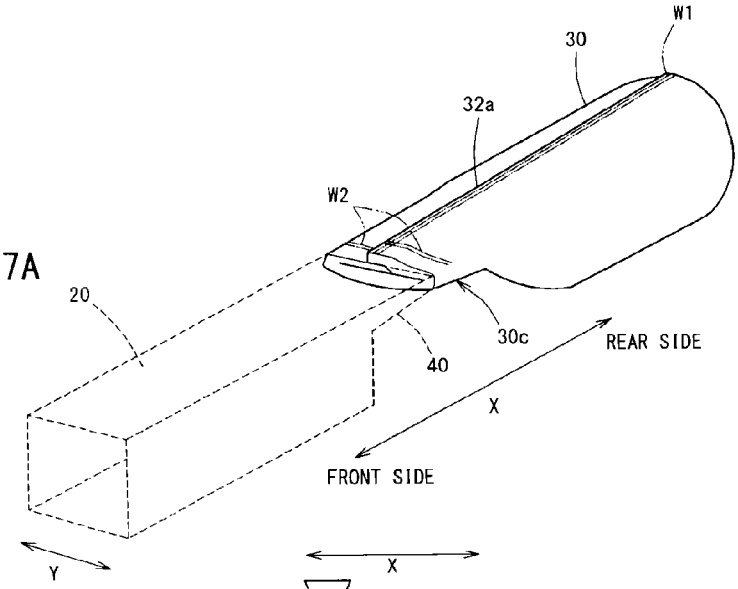
Figure 7C:
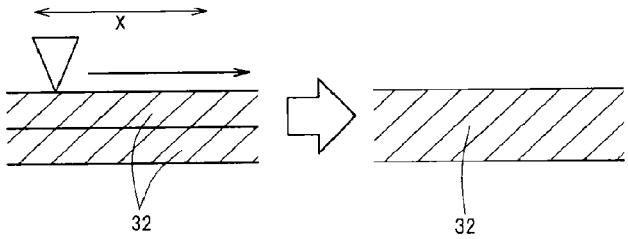
Figure 7B:
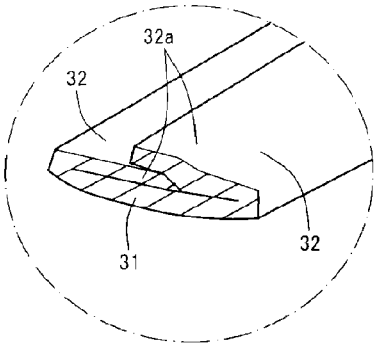

In the above description, moreover, the opposed ends 32*a* of the barrel component piece 32 are butted each other and the butting portion of the opposed ends 32*a* is welded as the long length direction weld portion W1 in the long length direction X. As shown in FIGS. 7(*a*) and 7(*b*), however, the opposed ends 32*a* of the barrel component piece 32 may be caused to overlap with each other and the overlapping portion of the opposed ends 32*a* may be thus welded as the long length direction weld portion W1 in the long length direction X. In this case, the overlapping opposed ends 32*a* are integrated by the fiber laser welding as shown in FIG. 7(*c*). Therefore, it is possible to enhance the water-blocking performance in the long length direction weld portion W1.

Thus, the pressure-bonding section 30 is configured from the pressure-bonding surface 31 on which the aluminum core wire 201 is to be mounted and the barrel component piece 32 extended from both sides in the width direction of the pressure-bonding surface 31, and the barrel component piece 32 is bent to form a ring-shaped section, and furthermore, the opposed ends 32*a* of the barrel component piece 32 are superposed on each other and the superposition is welded as the long length direction weld portion W1 in the long length direction X to configure the pressure-bonding section 30 having the ring-shaped section by the pressure-bonding surface 31 and the barrel component piece 32, and the superposition portion where the opposed ends 32*a* of the barrel component piece 32 are superposed on each other is welded as the long length direction weld portion W1 in the long length direction X. Consequently, it is possible to configure the pressure-bonding section 30 which is sealed reliably.

In addition, both ends of the barrel component piece 32 may be the taper ends 32*e* with one end having a taper surface on a radial outward side surface and the other end having a taper surface on a radial inward side surface. As shown in FIGS. 8(*d*) and 8(*e*), the taper surfaces on the taper ends 32*e* may be butted each other in a radial direction, that is, the taper ends 32*e* may be superposed on each other and be welded as the long length direction weld portion W1 in the long length direction X. The long length direction weld portion W1 through the taper end 32*e* is integrated in a thickness which is greater than a plate thickness of the single barrel component piece 32 and is smaller than that of the two barrel component pieces 32 as shown in FIG. 8(*f*).

Thus, the superposition portion is configured from the inclined end surface 32*b* which is thinner than the other portions in the barrel component piece 32. Consequently, there is reduced a fear that the superposition thickness might be excessively great, resulting in insufficient welding. Thus, it is possible to reliably perform the welding, thereby ensuring the water-blocking performance.

Moreover, the taper ends 32*e* each having a smaller thickness than the thicknesses of the other portions in the barrel component piece 32 are superposed on each other and the superposition portion is configured more thickly than the other portions in the barrel component piece 32. Even in the case in which the superposition portion is thinned by the welding, consequently, the weld portion has sufficient strength. For example, therefore, it is possible to ensure sufficient welding strength, that is, sufficient water-blocking performance even if the weld portion is deformed by the pressure-bonding of the aluminum core wire 201 or the like.

In the above description, the long length direction weld portion W1 and the width direction weld portion W2 are welded on the virtual plane P at the bottom face side of the female crimp terminal 10. In the case in which the long length direction weld portion W1 and the width direction weld portion W2 are welded at the upper surface side of the female crimp terminal 10, however, the pressure-bonding surface 31 and the barrel component piece 32 are rounded and formed cylindrically and a cylindrical top part is once welded as the long length direction weld portion W1 as shown in FIG. 9(*a*). Then, a cylindrical forward part is deformed like an almost flat plate so as to be flattened toward the bottom face side so that the sealing portion 30*c* is formed to weld the width direction weld portion W2 from above the sealing portion 30*c* (see FIG. 9(*b*)). Thus, the cylindrical top part is once welded as the long length direction weld portion W1 in the long length direction X. As shown in FIG. 9(*b*), consequently, a focal point in the laser welding can easily be adjusted and the pressure-bonding section 30 can efficiently be welded and sealed as compared with the case in which the long length direction weld portion W1 in the long length direction X deformed in a height direction is welded.

As the method of manufacturing the female crimp terminal 10 including the pressure-bonding section 30 for permitting pressure-bonding and connection to the aluminum core wire 201 of the insulated wire 200, the pressure-bonding surface 31 and the barrel component piece 32 are bent and formed cylindrically, the long length direction weld portion W1 in the long length direction X in which the opposed ends 32*a* of the barrel component piece 32 are butted each other is then welded, and furthermore, is deformed like the almost flat plate for sealing the forward part in the long length direction X and the sealing portion 30*c* deformed like the almost flat plate is thereafter welded as the width direction weld portion W2 in the width direction Y. Consequently, it is possible to manufacture the female crimp terminal 10 capable of realizing a pressure-bonding state with high water-blocking performance.

It is also possible to carry out welding for changing the long length direction weld portion W1 in the height direction. In this case, the pressure-bonding sections 30 taking various shapes and having the water-blocking performance can be configured so that versatility can be enhanced.

Figures 11A, 11B, 11C:
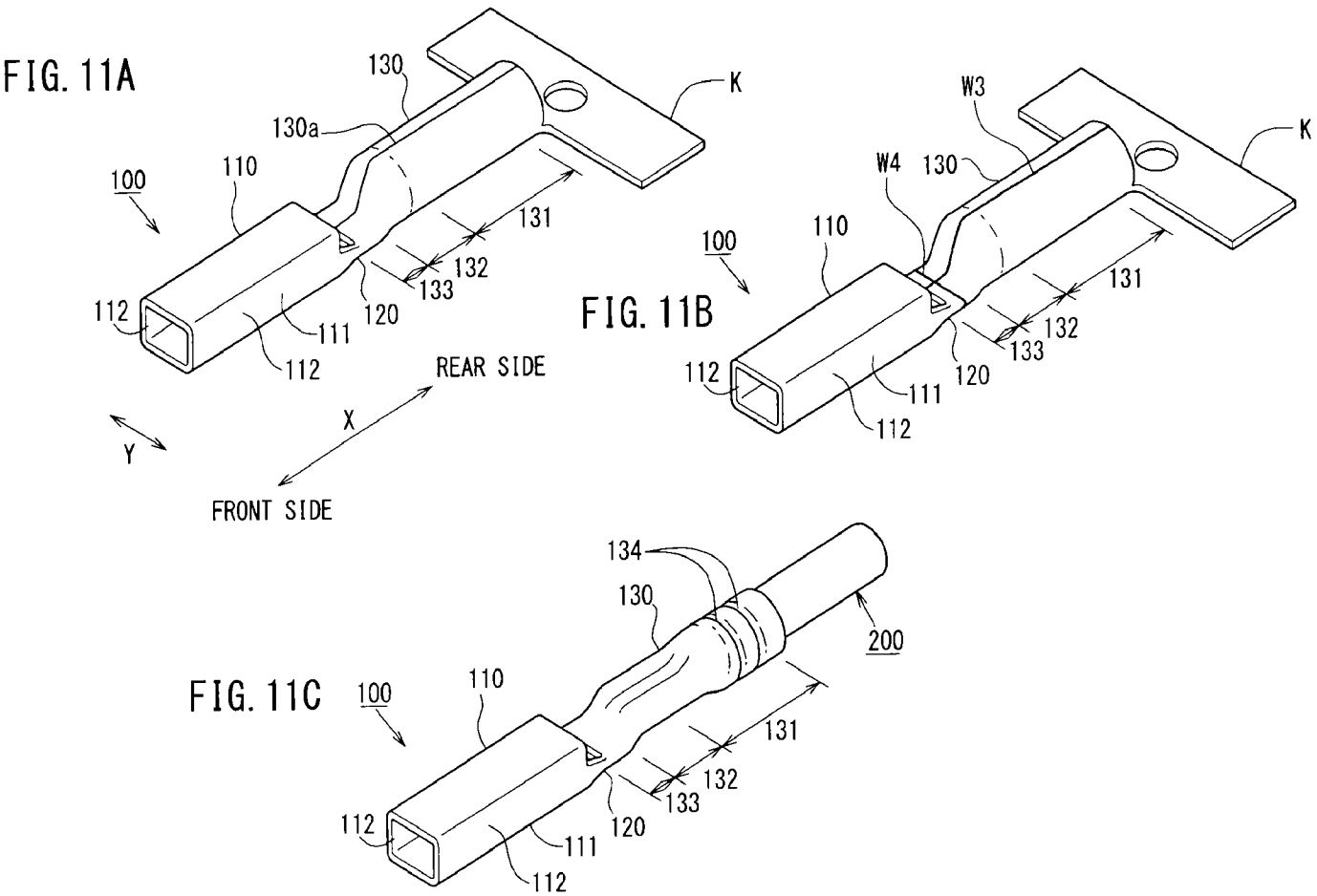
Figure 12A:
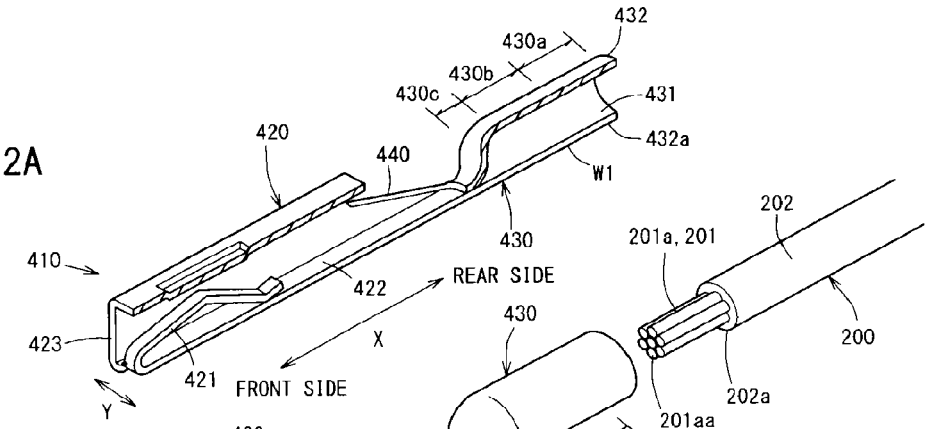
Figure 12B:
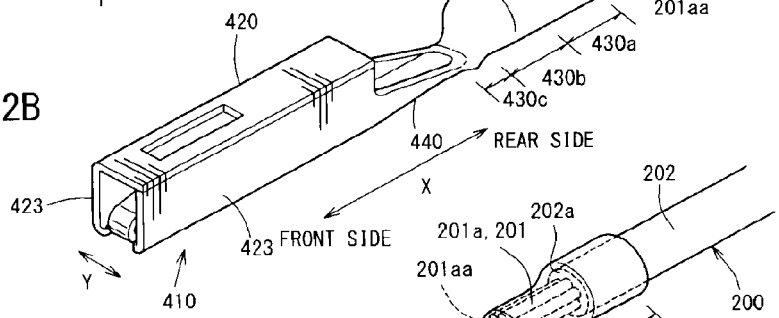
Figure 12C:
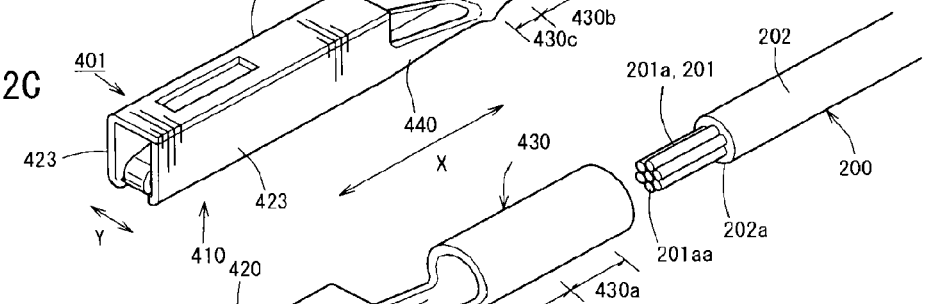
Figure 12D:
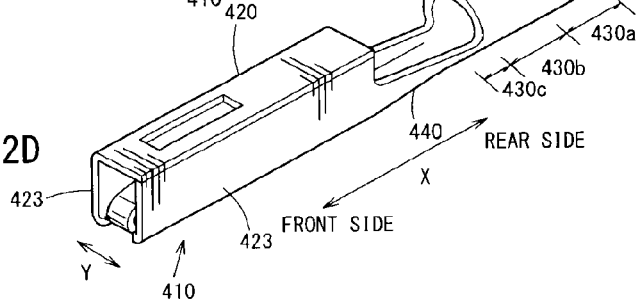

This will be described in more detail. As shown in FIG. 11(*a*), a copper alloy strip punched into a terminal shape is rounded and a front end portion in the long length direction X is flattened and formed previously into a shape of a barrel portion 130 including a sealing portion 133.

Then, ends 130*a* rounded and butted each other are welded along a weld portion W3 in the long length direction X and are welded and sealed along a weld portion W4 in the width direction Yin the sealing portion 133 to finish the barrel portion 130.

Moreover, the ends 130*a* may be butted and welded at the bottom face side of the barrel portion 130 as shown in FIG. 2(*a*) or the ends 130*a* may be butted and welded at the upper surface side of the barrel portion 130 as shown in FIGS. 11(*a*) and 11(*b*).

As shown in FIG. 11(*c*), furthermore, a cover pressure-bonding section 131 of the barrel portion 130 may be pressure-bonded in a circular shape as seen on a front surface to an insulating cover 202 of an insulated wire 200 and a core wire pressure-bonding section 132 may be pressure-bonded in an almost U shape as seen on a front surface to the aluminum core wire in a pressure-bonding state.

As shown in FIGS. 11(*a*) to 11(*c*), moreover, after the barrel portion 130 is welded with a band-shaped carrier K attached, a crimp terminal 100 may be separated from the carrier K when the insulated wire 200 is to be then pressure-bonded and connected or after the insulated wire 200 is pressure-bonded and connected. However, the crimp terminal 100 may be formed in a separating state from the carrier K to pressure-bond and connect the insulated wire 200.

Instead of the method of bending the plate-shaped pressure-bonding surface 31 and the barrel component piece 32 and forming them cylindrically and then deforming the cylindrical front part into a shape of an almost flat plate to configure the sealing portion 30*c*, furthermore, the pressure-bonding section 30 may be configured by superposing two plate materials each having a hollow convex portion 34 taking a shape of a bullet as seen on a plane and an almost semicircular shape as seen from a rear side with a rear part opened in a direction in which the hollow portions of the hollow convex portions 34 are opposed to each other and welding a continuous weld portion W3 in combination of the long length direction X and the width direction Y to surround the hollow convex portion 34 at an outside as seen on a plane in a portion corresponding to the pressure-bonding section 30 as shown in FIGS. 10(*a*) to 10(*c*).

The plate materials to be superposed are coupled in a portion which is not shown. It is also possible to employ a structure in which the plate material portions are superposed by bending or a structure in which plate materials being different components are superposed. Furthermore, if at least one of the plate materials has the hollow convex portion 34, the pressure-bonding section 30 can be formed.

As a method of manufacturing the female crimp terminal 10 including the pressure-bonding section 30 for permitting pressure-bonding and connection to the aluminum core wire 201 of the insulated wire 200, thus, the pressure-bonding section 30 is configured by superposing the plate materials, at least one of which has the hollow convex portion 34 with a forward part in the long length direction X sealed on the front side, and welding the continuous weld portion W3 in the long length direction X and the width direction Y to surround the hollow convex portion 34 at the outside of the hollow convex portion 34. Consequently, it is possible to cause a shape of a hollow concave portion to correspond to a diameter of the aluminum core wire 201, for example. It is possible to manufacture the female crimp terminal 10 capable of realizing a pressure-bonding state having high water-blocking performance with a small gap in the pressure-bonding state in which the aluminum core wire 201 is inserted into the pressure-bonding section 30.

Accordingly, even if the aluminum core wire 201 has a small diameter, for example, it is possible to manufacture the female crimp terminal 10 capable of realizing a pressure-bonding state having high water-blocking performance with a small gap.

In correspondence of the structure according to the present invention and the embodiment, the conductor portion according to the present invention corresponds to the aluminum core wire 201,
similarly to the foregoing,
the crimp terminal corresponds to the female crimp terminal 10,
the hollow sectional shape corresponds to a cylindrical shape,
one end side in the long length direction in the hollow sectional shape corresponds to the
front part in the long length direction X,
the sealing shape corresponds to the almost flat plate shape,
the direction intersecting with the long length direction corresponds to the width direction Y,
the weld portion in the long length direction corresponds to the long length direction weld portion W1,
the weld portion in the direction intersecting with the long length direction corresponds to the width direction weld portion W2 (W2*a*),
almost the same plane corresponds to the virtual plane P,
the extended pressure-bonding piece corresponds to the barrel component piece 32,
the end corresponds to the opposed end 32*a*,
the end surface corresponds to the opposed abutting surface portion 32*d*,
the connection structural body corresponds to the pressure-bonding connection structural body 1, and
the convex portion corresponds to the hollow convex portion 34.

However, the present invention is not restricted to only the structure according to the embodiment but can be applied based on technical ideas described in claims and many embodiments can be obtained.

In the present embodiment, the description has been given to the example in which the pressure-bonding section 30 of the female crimp terminal 10 is pressure-bonded and connected to the aluminum core wire 201 formed of a less noble metal such as aluminum or an aluminum alloy. However, the pressure-bonding section 30 may be pressure-bonded and connected to a conductor portion formed by a nobler metal material such as copper or a copper alloy in addition to the less noble metal, for instance, and it is possible to achieve almost equivalent functions and effects to those in the embodiment.

This will be described in more detail. The pressure-bonding section 30 having the structure can prevent water intrusion in the pressure-bonding state. For this reason, it is also possible to connect an insulated wire configured by a core wire such as copper or a copper alloy which is required to be sealed in a post-pressure-bonding state in order to obtain water blocking between wires, for instance.

Moreover, the barrel component piece 32 disposed on both sides in the width direction Y of the pressure-bonding surface 31 and the pressure-bonding surface 31 are rounded to weld and configure the opposed ends 32*a* of the barrel component piece 32 cylindrically. However, it is also possible to dispose the barrel component piece 32 on only either side in the width direction Y of the pressure-bonding surface 31 and to round and configure the pressure-bonding surface 31 and the barrel component piece 32 cylindrically, thereby welding the ends of the pressure-bonding surface 31 and the barrel component piece 32 to each other.

Second Embodiment

An embodiment according to the present invention will be described below in detail with reference to the drawings.

Figure 13A:
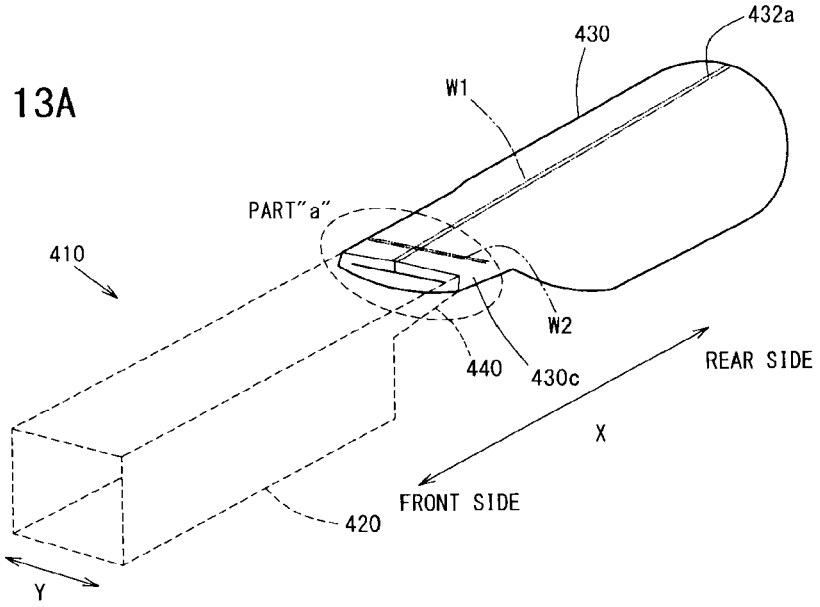
Figure 13B:
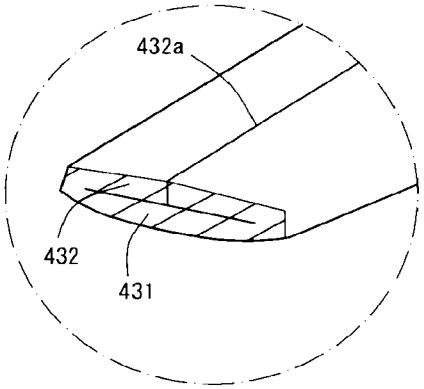
Figure 14:
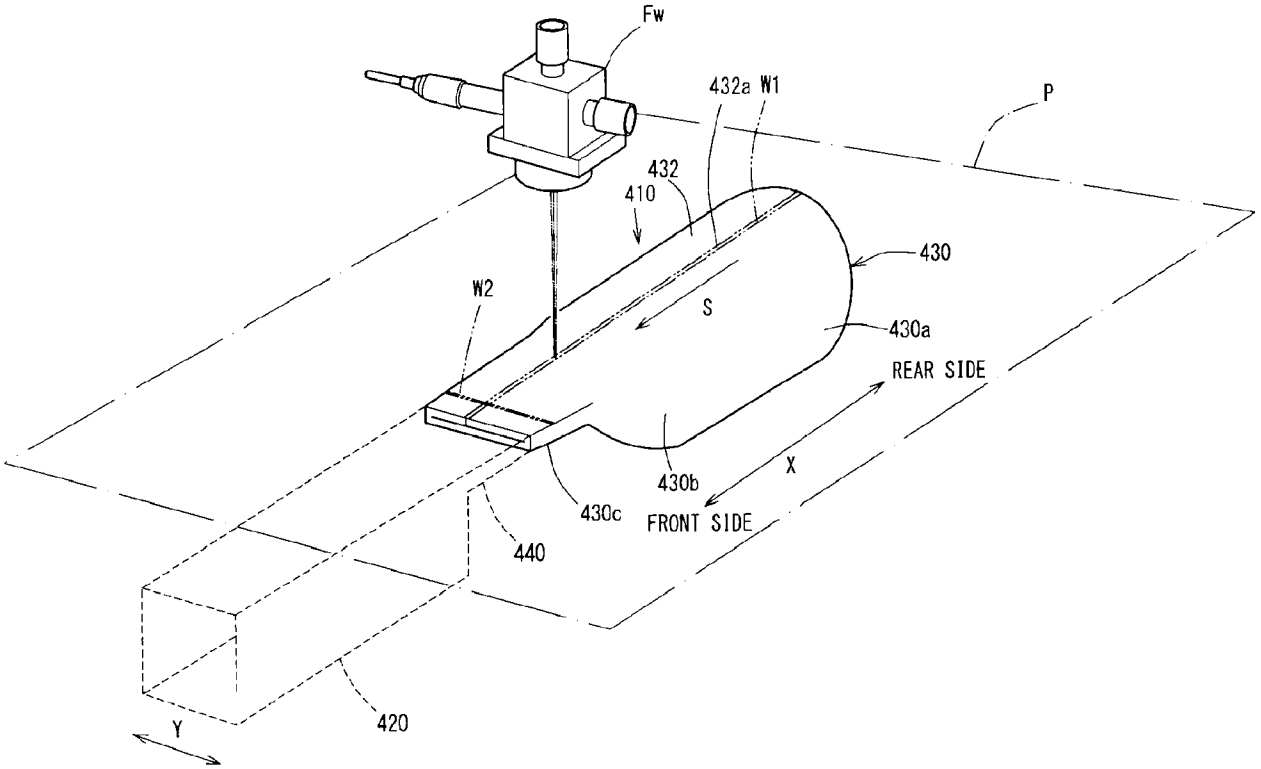

FIGS. 12(*a*) to 12(*d*) are views for explaining a female crimp terminal 410 having a butt pressure-bonding section 430 for pressure-bonding and connecting an insulated wire 200, FIGS. 13(*a*) and 13(*b*) are views for explaining butt welding in the butt pressure-bonding section 430, and FIG. 14 is a perspective view showing a butt welding situation.

Figure 15A:
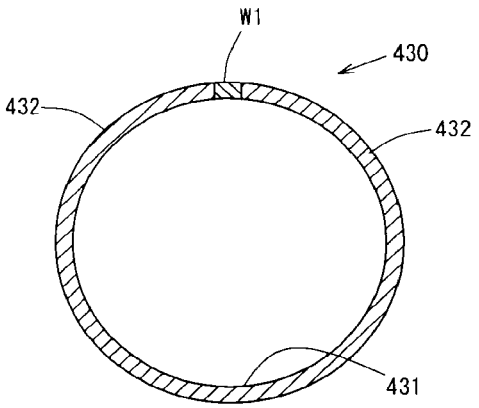
Figure 15B:
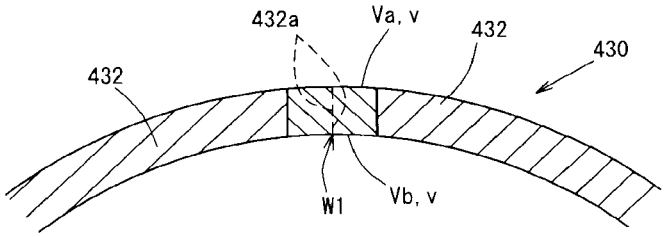
Figure 15C:
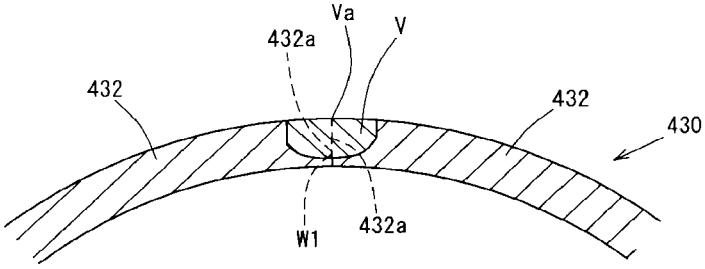
Figure 16A:
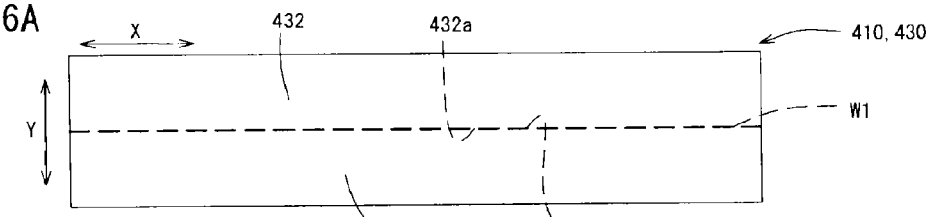
Figure 16B:
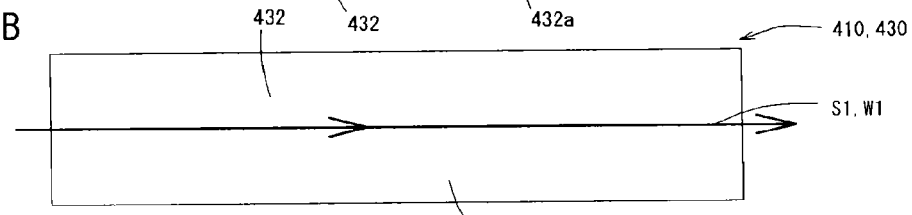
Figure 16C:
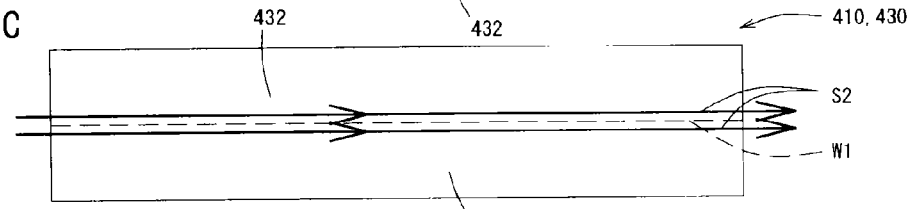
Figure 16D:
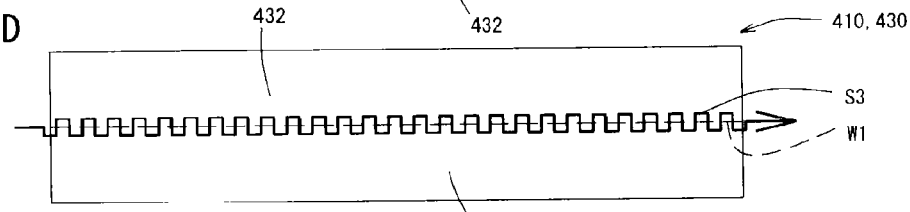
Figure 16E:
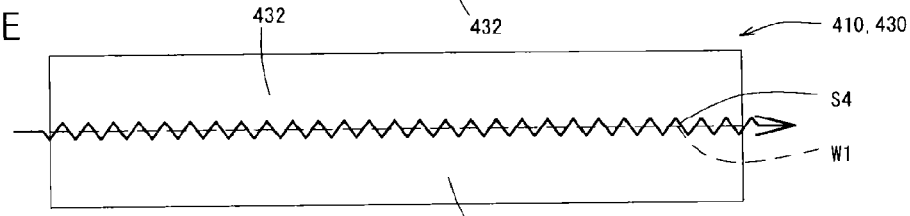
Figure 16F:
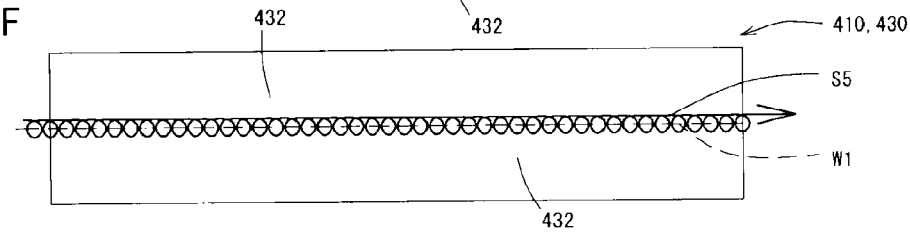

Moreover, FIGS. 15(*a*) to 15(*c*) are views for explaining opposed ends 432*a* of a barrel component piece 432 configuring the butt pressure-bonding section 430, and FIGS. 16(*a*) to 16(*f*) are views for explaining a sweeping method in the butt welding.

FIG. 12(*a*) is a longitudinal sectional perspective view showing the female crimp terminal 410 which is divided on a center in a width direction, FIG. 12(*b*) is a perspective view showing a pre-pressure-bonding state of the female crimp terminal 410 and the insulated wire 200, FIG. 12(*c*) is a perspective view showing a pressure-bonding connection structural body 401 in a pressure-bonding state in which the insulated wire 200 is pressure-bonded by the butt pressure-bonding section 430, and FIG. 12(*d*) is a perspective view showing the pre-pressure-bonding state of the female crimp terminal 410 having no sealing portion 430*c* formed therein and the insulated wire 200.

FIG. 13(*a*) is a schematic perspective view showing a bottom face side of the female crimp terminal 410 in which a box section 420 is set into a transmissive state, and FIG. 13(*b*) is an enlarged view showing a part "a" in FIG. 13(*a*).

FIG. 15(*a*) is a sectional view showing the butt pressure-bonding section 430 in which the butt welding is completed, FIG. 15(*b*) is an enlarged sectional view showing a long length direction weld portion W1 in the butt pressure-bonding section 430 in which the butt welding is completed, and FIG. 15(*c*) is an enlarged sectional view showing the long length direction weld portion W1 in which the butt welding is incomplete.

Moreover, FIG. 16(*a*) is an enlarged plan view showing the long length direction weld portion W1 in the butt pressure-bonding section 430 in which the butt welding is to be performed, FIG. 16(*b*) is an enlarged plan view showing one-time sweep in the butt welding with respect to a width direction Y, FIG. 16(*c*) is an enlarged plan view showing two-time sweep in the butt welding with respect to the width direction Y, FIG. 16(*d*) is an enlarged plan view showing rectangular sweep in the butt welding with respect to the width direction Y, FIG. 16(*e*) is an enlarged plan view showing triangular sweep in the butt welding with respect to the width direction Y, and FIG. 16(*f*) is an enlarged plan view showing spiral sweep in the butt welding with respect to the width direction Y.

The pressure-bonding connection structural body 401 according to the present embodiment is configured with the insulated wire 200 connected to the female crimp terminal 410. In other words, a wire exposing portion 201*a* of an aluminum core wire 201 which is exposed from an insulated tip 202*a* of an insulating cover 202 in the insulated wire 200 is pressure-bonded and connected to the butt pressure-bonding section 430 of the female crimp terminal 410.

The insulated wire 200 to be pressure-bonded and connected to the female crimp terminal 410 is configured by covering the aluminum core wire 201 obtained by bundling aluminum raw wires with the insulating cover 202 formed by an insulating resin. This will be described in more detail. The aluminum core wire 201 is configured by twisting aluminum alloy wires so as to have a section of 0.75 mm2.

The female crimp terminal 410 will be described below in more detail.

The female crimp terminal 410 is obtained by integrally configuring the box section 420 and the butt pressure-bonding section 430. The box section 420 permits insertion of an insertion tab in a male terminal which is not shown from a front part being a tip side in a long length direction X toward a rear part and the butt pressure-bonding section 430 is disposed behind the box section 420 with a transition section 440 having a predetermined length interposed therebetween.

In the present embodiment, as described above, there is employed the female crimp terminal 410 configured from the box section 420 and the butt pressure-bonding section 430. However, it is also possible to employ any crimp terminal having the butt pressure-bonding section 430, for example, a male crimp terminal configured from an insertion tab to be inserted and connected to the box section 420 in the female crimp terminal 410 and the butt pressure-bonding section 430. Moreover, it is also possible to employ a crimp terminal configured from only the butt pressure-bonding section 430 and serving to bundle and connect the aluminum core wires 201 of the insulated wires 200.

Furthermore, the long length direction X is coincident with a long length direction of the insulated wire 200 for pressure-bonding and connecting the butt pressure-bonding section 430 as shown in FIGS. 12(*b*) to 12(*d*), and the width direction Y intersects with the long length direction X in an almost horizontal planar direction. Moreover, a side of the box section 420 with respect to the butt pressure-bonding section 430 is set to be a forward part, and reversely, a side of the butt pressure-bonding section 430 with respect to the box section 420 is set to be a rearward part.

Moreover, the female crimp terminal 410 is a closed barrel type terminal which is configured by punching a copper alloy strip (not shown) such as brass having a surface tin plated (Sn plated) with a plate thickness of 0.1 to 0.6 mm into a two-dimensional developed terminal shape and then carrying out bending into a three-dimensional terminal shape including the box section 420 being a hollow quadrangular prismatic body and the butt pressure-bonding section 430 taking an almost O shape as seen from a rear side and welding the long length direction weld portion W1 of the butt pressure-bonding section 430. In the present embodiment, a surface of a copper alloy strip having a plate thickness of 0.25 mm is used for tin plating (Sn plating), and the butt pressure-bonding section 430 is configured like a cylinder having an inside diameter of ϕ3 mm.

The box section 420 is configured from an inverted hollow quadrangular prismatic body and includes an elastic contact piece 421 which is bent rearward in the long length direction X and comes in contact with an insertion tab (not shown) of a male connector to be inserted.

Moreover, the box section 420 taking the shape of the hollow quadrangular prismatic body is configured to take an almost rectangular shape as seen from a tip side in the long length direction X in a state in which side surface portions 423 linked to both side parts in the width direction Y that is orthogonal to the long length direction X of a bottom face portion 422 are bent.

The butt pressure-bonding section 430 in a pre-pressure-bonding state is formed in an almost O shape as seen from a rear side by rounding a pressure-bonding bottom face 431 and the barrel component piece 432 extended to both sides in the width direction Y of the pressure-bonding bottom face 431 and butting and welding the opposed ends 432*a* as shown in FIG. 12(*b*).

A length in the long length direction of the barrel component piece 432 is set to be greater than an exposure length in the long length direction X of the wire exposing portion 201*a* exposed in the forward part of the long length direction X from the insulated tip 202*a* being a tip on the forward side in the long length direction X of the insulating cover 202.

The butt pressure-bonding section 430 integrally configures a cover pressure-bonding range 430*a* for pressure-bonding the insulating cover 202 and a wire pressure-bonding range 430*b* for pressure-bonding the wire exposing portion 201*a* of the aluminum core wire 201, and furthermore, configures a sealing portion 430*c* (see FIG. 13(*a*)) in which an end farther forward than the wire pressure-bonding range 430*b* is deformed to be flattened into an almost flat plate and is welded in the width direction Y.

Welding for forming the butt pressure-bonding section 430 thus configured will be described with reference to FIG. 14.

As described above, the butt pressure-bonding section 430 formed to take the almost O shape as seen from a rear side by rounding the pressure-bonding bottom face 431 and the barrel component piece 432 and butting and welding the opposed ends 432*a* of the barrel component piece 432 is configured by welding the long length direction weld portion W1 in the long length direction X where the opposed ends 432*a* of the barrel component piece 432 are butted each other and a width direction weld portion W2 in the width direction Y for perfectly sealing the forward part of the butt pressure-bonding section 430 in the sealing portion 430*c* as shown in FIG. 14.

This will be described in more detail. The pressure-bonding bottom face 431 and the barrel component piece 432 in the butt pressure-bonding section 430 are rounded and formed cylindrically in such a manner that the opposed ends 432*a* are butted each other at the bottom face side, and cylindrical forward portions are pushed against a bottom face side from an upper surface side and are thus deformed like an almost flat plate. Then, the long length direction weld portion W1 in the long length direction X where the cylindrical opposed ends 432*a* are butted each other is welded (see FIG. 13(*a*)). Thereafter, the width direction weld portion W2 in the width direction Y is welded so that the butt pressure-bonding section 430 is finished.

At this time, the long length direction weld portion W1 and the width direction weld portion W2 are disposed on almost the same plane in a virtual plane P shown in FIG. 14. Therefore, it is possible to weld them by laser welding on a single focal point.

The welding for the long length direction weld portion W1 and the width direction weld portion W2 is carried out through fiber laser welding by a fiber laser welding device Fw. The fiber laser welding uses a fiber laser beam having a wavelength of about 1.06 to 1.08 μm. The fiber laser beam is an ideal Gaussian beam and can be condensed up to a diffraction limit. In other words, the fiber laser has high light condensing performance. Therefore, it is possible to constitute a light condensing spot diameter of 30 μm or less which is hard by a YAG laser or a CO2 laser. Accordingly, it is possible to easily realize welding with a high energy density.

In the present embodiment, a fiber laser beam having a wavelength of about 1.08 μm is focused to have a light condensing spot diameter of 20 μm. Thus, fiber laser welding having an output density of 380 MW/cm2 is carried out at a sweep rate of 90 to 300 mm/sec.

Moreover, the output density and the sweep rate are not restricted to the values. For example, the output density and the sweep rate are closely related to each other. When the output density is increased, for example, the sweep rate can also be raised.

Furthermore, an oscillation mode of the fiber laser beam in the fiber laser welding includes a continuous oscillation laser for carrying out continuous oscillation (hereinafter referred to as a CW laser), a pulse oscillation laser for carrying out pulse oscillation or a laser for pulse controlling the CW laser which performs continuous oscillation. Although the welding may be carried out by any oscillation mode, it is more preferable to perform the welding by the CW laser having high sealing performance.

As the welding for the long length direction weld portion W1 and the width direction weld portion W2 using the fiber laser beam, there is performed penetration welding for penetrating through the barrel component piece 432 configuring the butt pressure-bonding section 430 as shown in FIG. 15(*a*). Consequently, a welding bead V (Va, Vb) is formed through the welding on both a surface and a back face of the weld portion W (W1, W2) in the butt pressure-bonding section 430.

The welding bead V is preferably formed on both the surface and the back face of the long length direction weld portion W1 in at least a wire pressure-bonding range 430*b* to be pressure-bonded and deformed in order to pressure-bond and connect the aluminum core wire 201 through the butt pressure-bonding section 430. As a matter of course, however, the welding bead V may be formed in the cover pressure-bonding range 430*a* or the sealing portion 430*c*.

Furthermore, the width direction weld portion W2 in the sealing portion 430*c* is subjected to the laser welding in a post-pressure-bonding state and does not need to be resistant to pressure-bonding stress. If superposition portions are welded continuously by non-penetration welding, hermetic sealing performance is satisfied. For this reason, the penetration welding is not always required. In contrast to the penetration welding by which the welding bead V is formed on both the surface and the back face of the weld portion, however, the non-penetration welding tends to cause a welding defect and corrosion might occur due to water intrusion from a gap in a non-welded portion. Moreover, it is hard to decide from an outer appearance whether the superposition portions are welded continuously. Accordingly, it is preferable that the width direction weld portion W2 to be welded in the width direction Y in the sealing portion 430*c* should also be subjected to the penetration welding by which the welding bead V is formed on both the surface and the back face.

Furthermore, the long length direction weld portion W1 is welded in the sweeping direction S from a rear part toward a front part in the long length direction X of the butt pressure-bonding section 430. Moreover, the long length direction weld portion W1 including the box section 420 and the butt pressure-bonding section 430 is welded continuously. This will be described in more detail. As shown in FIG. 16(*a*), a butt portion in which the opposed ends 432*a* of the barrel component piece 432 are butted each other acts as the long length direction weld portion W1 in the long length direction X and a fiber laser beam irradiated from the fiber laser welding device Fw is focused onto the butt portion of the opposed ends 432*a*. As shown in FIG. 16(*b*), the welding is linearly carried out from the rear part toward the front part in the long length direction X along the long length direction weld portion W1.

The sweeping direction S of the fiber laser welding device Fw is not restricted to a direction from the rear part toward the front part if it is a single direction along the long length direction X, and may be a sweeping direction from the front part toward the rear part.

In addition, even if the sweeping direction is the single direction along the long length direction X, it is possible to employ various sweeping methods as shown in FIGS. 16(*a*) to 16(*f*).

This will be described in more detail. Although the butt portion of the opposed ends 432*a*, that is, the long length direction weld portion W1 may be swept in the long length direction X (which will be hereinafter referred to as basic sweep S1) as shown in FIG. 16(*b*), a sweeping axis may be slightly shifted from the long length direction weld portion W1 to carry out the two-time sweep so as to interpose the long length direction weld portion W1 (which will be hereinafter referred to as two-time sweep S2) as shown in FIG. 16(*c*). Although the two-time sweep S2 may be carried out in a single direction from the rear part toward the front part in the long length direction X for both of two sweeping operations as shown in FIG. 16(*c*), second sweep may be performed in a reverse direction with U turn after first sweep.

Moreover, the one-time sweep may be rectangular sweep S3 for alternately repeating sweep in the width direction Y and sweep in the long length direction X over the long length direction weld portion W1 to wholly carry out the sweep in the long length direction X (see FIG. 16(*d*)), triangular sweep S4 for carrying out sweep zigzag in an oblique direction to the long length direction X and the width direction Y to wholly perform the sweep in the long length direction X (see FIG. 16(*e*)) or spiral sweep S5 for carrying out sweep forward in a sweeping direction while drawing an almost circular shape at a rearward side in the sweeping direction (see FIG. 16(*f*)).

In contrast to the basic sweep S1 for sweeping the long length direction weld portion W1, thus, the two-time sweep S2, the rectangular sweep S3, the triangular sweep S4 or the spiral sweep S5 also performs the sweep in the width direction Y. Therefore, it is possible to form the welding bead V having a width in the width direction Y increased. Consequently, even in the case in which there is made such an error as to oscillate the butt portion in the width direction Y with respect to the long length direction X, for example, the welding bead V having a predetermined width in the width direction Y can be formed. Therefore, it is possible to reliably weld the long length direction weld portion W1.

Figure 17:
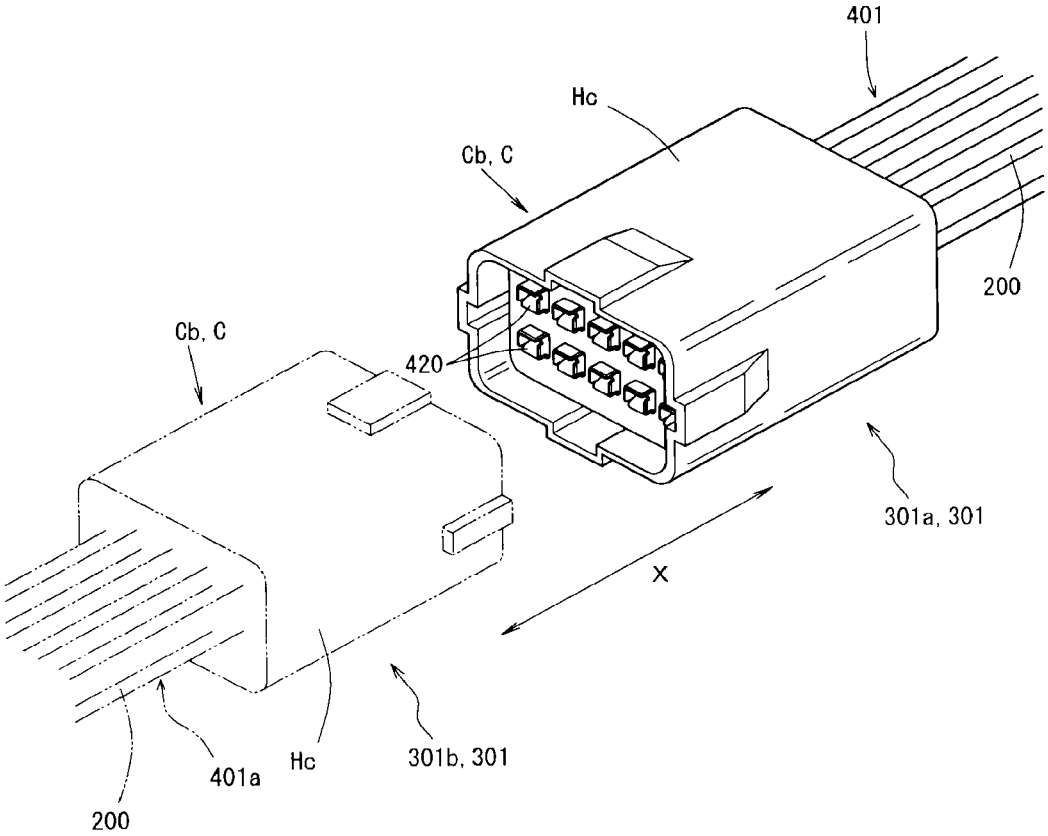
Figure 18A:
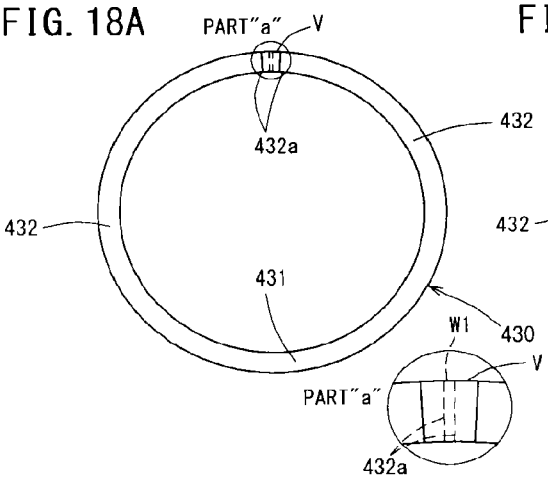
Figure 18B:
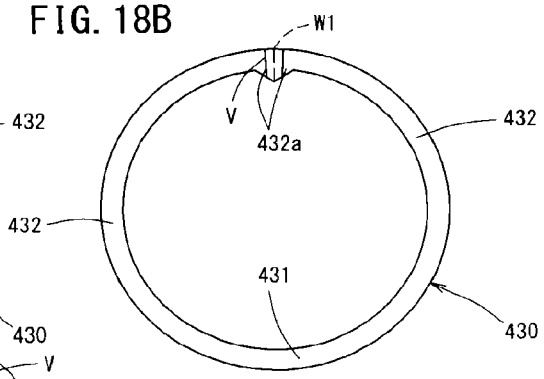
Figure 18C:
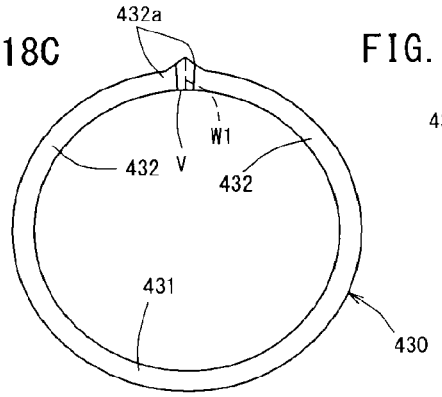
Figure 18D:
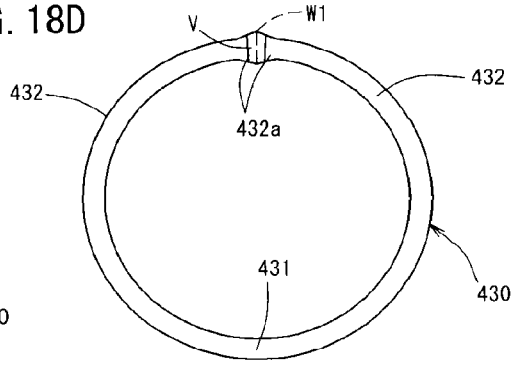

With reference to FIG. 17, next, description will be given to an example in which a pressure-bonding connection structural body 401 using the female crimp terminal 410 and a pressure-bonding connection structural body 401*a* using a male crimp terminal (not shown) are attached to a pair of connector housings Hc, respectively.

The pressure-bonding connection structural body 401 is a connection structural body using the female crimp terminal 410 and the pressure-bonding connection structural body 401*a* is a connection structural body using the male crimp terminal.

By attaching the pressure-bonding connection structural bodies 401 and 401*a* to the connector housing He respectively, it is possible to configure a female connector Ca and a male connector Cb which have reliable conductivity.

In the following, description will be given to an example in which both the female connector Ca and the male connector Cb serve as connectors for a wire harness H (Ha, Hb). However, one of them may be the connector for the wire harness and the other may be an auxiliary connector for a substrate, a component or the like.

This will be described in more detail. As shown in FIG. 17, the pressure-bonding connection structural body 401 formed by the female crimp terminal 410 is attached to the female connector housing He to configure a wire harness 301*a* including the female connector Ca.

Moreover, the pressure-bonding connection structural body 401*a* formed by the male crimp terminal is attached to the male connector housing Hc, thereby configuring a wire harness 301*b* including the male connector Cb.

By fitting the female connector Ca and the male connector Cb which are configured as described above, it is possible to connect the wire harness 301*a* to the wire harness 301*b*.

In other words, the connector C (Ca, Cb) having the female crimp terminal 410 of the pressure-bonding connection structural body 401 attached to the connector housing Hc can realize the connection of the wire harness 301 having reliable conductivity.

Moreover, the female crimp terminal 410 of the pressure-bonding connection structural body 401 and the male crimp terminal of the pressure-bonding connection structural body 401*a* have a sealing structure in which the conductor tip 201*a* of the aluminum core wire 201 in the insulated wire 200 is integrally covered with the butt pressure-bonding section 430 and is not exposed to an outside.

For this reason, regardless of exposure to outside air in the connector housing Hc, it is possible to maintain an electrical connection state of the aluminum core wire 201 and the female crimp terminal 410 in the pressure-bonding section 430 without reducing the conductivity due to galvanic corrosion. Thus, it is possible to ensure a connection state having reliable conductivity.

Thus, the plate material is bent in the width direction, the opposed ends 432*a* in the width direction of the plate material are butted each other, the long length direction weld portion W1 having the opposed ends 432*a* butted each other is welded in the long length direction X, and the welding bead V is formed by the welding at both of the surface and back face sides of the wire pressure-bonding range 430*b* to be pressure-bonded and deformed for pressure-bonding and connection to the aluminum core wire 201 in the weld portion which is welded in the long length direction X in such a manner that the butt pressure-bonding section 430 in the female crimp terminal 410 including the butt pressure-bonding section 430 for permitting pressure-bonding and connection to the aluminum core wire 201 of the insulated wire 200 takes a hollow sectional shape. Therefore, it is possible to configure the female crimp terminal 410 capable of reliably pressure-bonding the aluminum core wire 201 through the butt pressure-bonding section 430, thereby obtaining stable conductivity.

This will be described in more detail. The formation of the welding bead V through the welding on both of the surface and back face sides of the wire pressure-bonding range 430*b* to be pressure-bonded and deformed implies that at least most of a section in a front/back direction of the weld portion is welded. Accordingly, the plate material is bent in the width direction to take the hollow sectional shape, and the weld portion of the butt pressure-bonding section 430 where the opposed ends 432*a* are welded in the long length direction X has sufficient proof strength to pressure-bonding force for pressure-bonding the aluminum core wire 201 through the butt pressure-bonding section 430 and is not broken by pressure-bonding and deformation. Therefore, it is possible to reliably pressure-bond the aluminum core wire 201 of the insulated wire 200 through the butt pressure-bonding section 430, thereby obtaining stable conductivity. In other words, it is possible to ensure a stable electrical connection state.

Moreover, the welding bead V is formed on both of front and back sides by the penetration welding so that the welding is carried out in a whole sectional area in the front/back direction of the long length direction weld portion W1. Therefore, more sufficient proof strength can be possessed against the pressure-bonding force for pressure-bonding the aluminum core wire 201 through the butt pressure-bonding section 430, and furthermore, the long length direction weld portion W1 having no crack starting point can be configured.

This will be described in more detail. When a non-weld portion is formed in the section of the long length direction weld portion W1 as shown in FIG. 15(*c*), it tends to be such a crack starting point as to be turned from a lower part toward an upper part in a vertical direction on a center of the long length direction weld portion W1 because stress concentrates in the pressure-bonding. However, the section of the long length direction weld portion W1 is welded continuously by the penetration welding and the crack starting point is not generated so that welding having sufficient proof strength can be carried out. Accordingly, the aluminum core wire 201 of the insulated wire 200 is pressure-bonded more reliably through the butt pressure-bonding section 430 so that more stable conductivity can be obtained.

Moreover, the sealing portion 430*c* is formed on the forward side in the long length direction X in the hollow sectional shape and the sealing portion 430*c* is welded in the width direction Y to form the width direction weld portion W2. By simply pressure-bonding the butt pressure-bonding section 430 in which the aluminum core wire 201 is inserted, consequently, it is possible to prevent the aluminum core wire 201 of the insulated wire 200 or the aluminum core wire 201 from being exposed to the outside of the butt pressure-bonding section 430, thereby performing the pressure-bonding into a wrapping state with water-blocking performance.

This will be described in more detail. Even if the butt pressure-bonding section 430 is pressure-bonded and deformed in order to pressure-bond the aluminum core wire 201, the welding bead V is formed by the welding at least on both of the surface and back sides of the wire pressure-bonding range 430*b* to be pressure-bonded and deformed due to the pressure-bonding and connection to the aluminum core wire 201 in the long length direction weld portion W1 welded in the long length direction X, the welding is not broken by the pressure-bonding and deformation, the forward side in the long length direction X in the hollow sectional shape is caused to take a sealing shape for sealing, portions other than an insertion portion for inserting the aluminum core wire 201 into the butt pressure-bonding section 430 taking the hollow sectional shape is sealed because of the welding in the width direction Y, it is possible to prevent water intrusion into an inner part without exposing the aluminum core wire 201 in the butt pressure-bonding section 430 to the outside air, and it is possible to inhibit degradation or aged deterioration from being caused. Therefore, corrosion does not occur in the aluminum core wire 201 and it is also possible to prevent a rise in electric resistance from being caused by the corrosion. Consequently, stable conductivity can be obtained.

In order to previously weld, in the width direction Y, the sealing portion 430*c* formed on the forward side in the long length direction X in the hollow sectional shape to form the width direction weld portion W2, moreover, the portions other than the insertion portion for inserting the aluminum core wire 201 into the butt pressure-bonding section 430 taking the hollow sectional shape are sealed. By simply pressure-bonding the butt pressure-bonding section 430 in which the aluminum core wire 201 is inserted, it is possible to carry out the pressure-bonding in a wrapping state with water-blocking performance without exposing the aluminum core wire 201 of the insulated wire 200 or the aluminum core wire 201 to the outside of the butt pressure-bonding section 430. In order to ensure the water-blocking performance, accordingly, it is possible to reliably prevent the aluminum core wire 201 pressure-bonded to the butt pressure-bonding section 430 from being exposed to the outside air without using a cap configured by a separate component or the like in the aluminum core wire 201.

By setting the long length direction weld portion W1 in the long length direction X and the width direction weld portion W2 in the width direction Y onto almost the same plane, moreover, it is possible to reliably carry out the welding by readily moving the fiber laser welding device Fw, for example. This will be described in more detail. A distance between the fiber laser welding device Fw and the long length direction weld portion W1 and width direction weld portion W2 is constant. Therefore, it is possible to carry out the welding in a stable welding state. Thus, the welding can reliably be performed.

Furthermore, the welding is carried out by using a fiber laser beam to be a high energy density beam. Therefore, it is possible to perform the welding with high precision at a high aspect ratio. Accordingly, it is possible to realize a welding state with small deformation of a terminal material. This will be described in more detail. The fiber laser has high light condensing performance and a high average output density. Therefore, it is possible to efficiently bring a reliable welding state.

In the case in which a material structure of a base material around the long length direction weld portion W1 has strength of a material itself (hardness), furthermore, there is a fear that stress might concentrate on an interface between a weld portion to be a soft structure and a base material structure (a hard structure), resulting in a crack. However, a portion provided around the long length direction weld portion W1 has a softer structure than the base material by a thermal effect produced through the laser welding using the fiber laser beam, and the periphery of the long length direction weld portion W1 has gentle orientation with change from a soft structure to a hard structure toward a bottom face. Therefore, it is possible to prevent breakage of the long length direction weld portion W1 in the pressure-bonding more reliably.

Moreover, the female crimp terminal 410 is configured by a copper alloy strip having a surface Sn plated. For this reason, the Sn plating on the surface functions as a light absorption material in the execution of the fiber laser welding. Consequently, absorption of a laser beam is increased so that the welding can be carried out efficiently.

Moreover, the pressure-bonding connection structural body 401 having the insulated wire 200 and the female crimp terminal 410 connected through the butt pressure-bonding section 430 in the female crimp terminal 410 can ensure reliable water-blocking performance by simply performing surrounding and pressure-bonding through the butt pressure-bonding section 430 of the female crimp terminal 410. Thus, it is possible to ensure stable conductivity.

The aluminum core wire 201 formed by an aluminum based material is used. Therefore, it is possible to reduce a weight as compared with the insulated wire formed by a copper based material and to prevent so-called galvanic corrosion, thereby ensuring a sufficient conductive function through the reliable water-blocking performance.

Furthermore, the connector C having the female crimp terminal 410 in the pressure-bonding connection structural body 401 disposed in the connector housing He can connect the pressure-bonding connection structural body 401 while ensuring stable conductivity.

This will be described in more detail. For example, when fitting the female connector C and the male connector C each other to connect the female crimp terminals 410 disposed in the connector housings Hc of the respective connectors C, it is possible to connect the female crimp terminals 410 of the connectors C while ensuring the water-blocking performance. As a result, it is possible to ensure a connection state having reliable conductivity.

In correspondence of the structure according to the present invention and the embodiment, the conductor portion according to the present invention corresponds to the aluminum core wire 201, similarly to the foregoing, the pressure-bonding section corresponds to the butt pressure-bonding section 430, the crimp terminal corresponds to the female crimp terminal 410, the end corresponds to the opposed end 432*a*, the butting portion and the weld portion in the long length direction correspond to the long length direction weld portion W1, the direction intersecting with the long length direction corresponds to the width direction Y, the portion to be pressure-bonded and deformed corresponds to the wire pressure-bonding range 430*b*, the weld portion in the intersecting direction corresponds to the width direction weld portion W2, and the connection structural body corresponds to the pressure-bonding connection structural body 401.

However, the present invention is not restricted to only the structure according to the embodiment but can be applied based on technical ideas described in claims and many embodiments can be obtained.

Although the above description has been given to the female crimp terminal 410 in which the box section 420, the transition section 440 and the butt pressure-bonding section 430 are disposed in this order, it is also possible to employ a crimp terminal configured from only the butt pressure-bonding section 430.

For the butt of the opposed ends 432*a* in the width direction of the plate material, it is possible to butt the side surfaces of the opposed ends 432*a* of the plate material, and furthermore, inclined side surfaces obtained by inclining the side surfaces of the opposed ends 432*a* or side surfaces each configuring a surface having a height which is equal to or greater than the thickness of the plate material.

Although there is carried out the fiber laser welding for irradiating a fiber laser beam from the fiber laser welding device Fw, moreover, it is also possible to perform the welding by irradiating an electron beam.

When the aluminum core wire 201 is to be inserted into the cylindrical butt pressure-bonding section 430 to perform the pressure-bonding as shown in FIG. 12(*d*), furthermore, the forward part of the butt pressure-bonding section 430 may be configured into a sealing shape to form the sealing portion 430*c*. In addition, the width direction weld portion W2 may be welded to configure the sealing portion 430*c*, and furthermore, the forward part of the butt pressure-bonding section 430 may be only formed into the sealing shape without welding the width direction weld portion W2, or a sealing material such as a resin may be provided in the sealing portion 430*c* to carry out the sealing.

As shown in FIG. 18(*a*) which is a view for explaining another embodiment of the butt pressure-bonding section 430, in the butt pressure-bonding section 430 configured cylindrically by butting the opposed ends 432*a* of the barrel component piece 432 to perform fiber laser welding over the long length direction weld portion W1 in the long length direction X, it is also possible to butt the opposed ends 432*a*, if not with close contact, with a gap therebetween if the gap is equal to or smaller than a spot diameter in the fiber laser welding, thereby performing the fiber laser welding in the long length direction X to form the welding bead V.

As shown in FIGS. 18(*b*) to 18(*d*), moreover, the thick opposed ends 432*a* protruded in radial inward/outward directions may be butted and welded. With the increase in the thickness of the opposed ends 432*a*, thus, the thickness of the welding bead V formed in the butting portion is increased so that the strength of the weld portion can be enhanced.

Figures 19A, 19B, 19C:
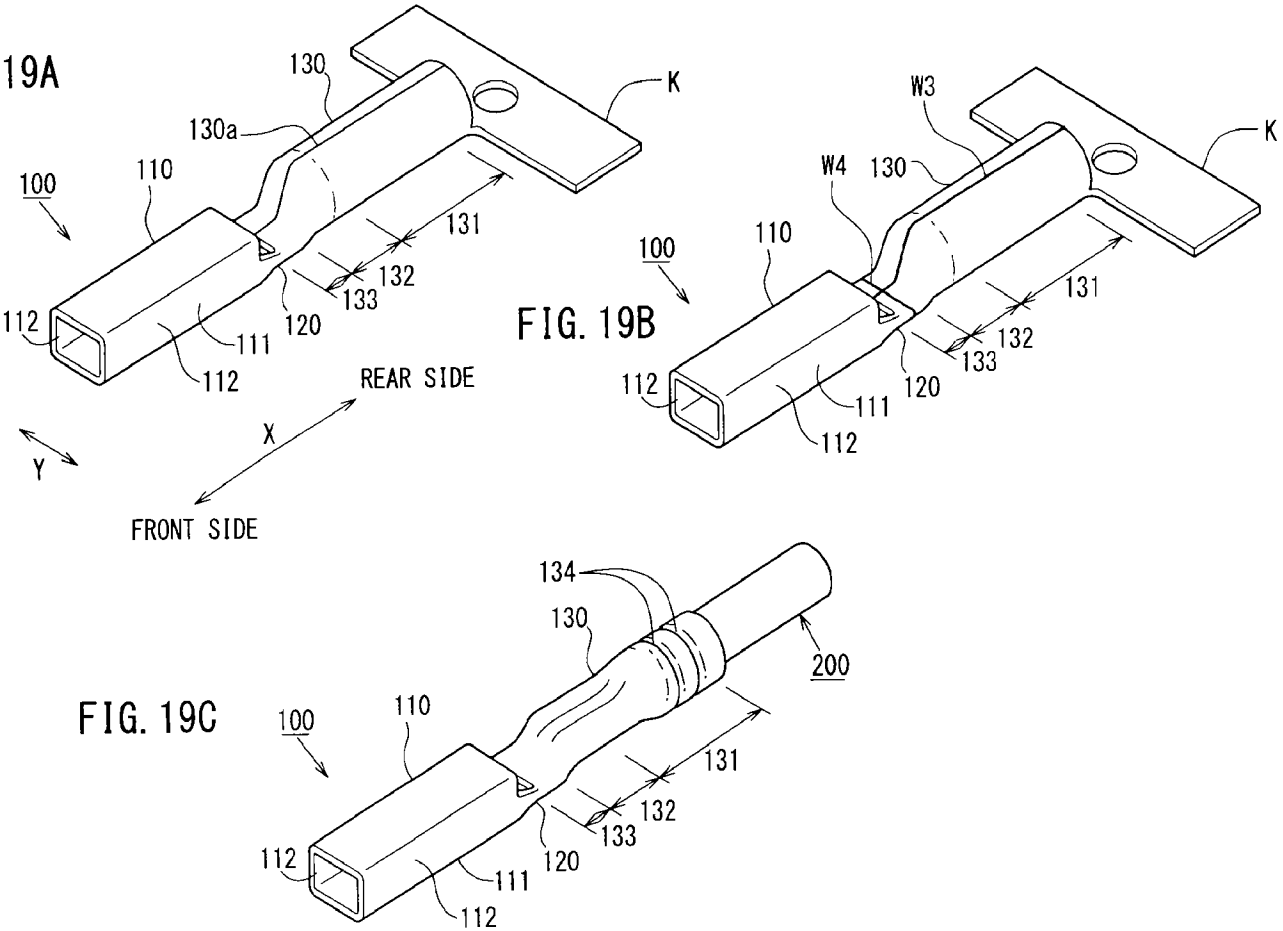
Figure 20A:
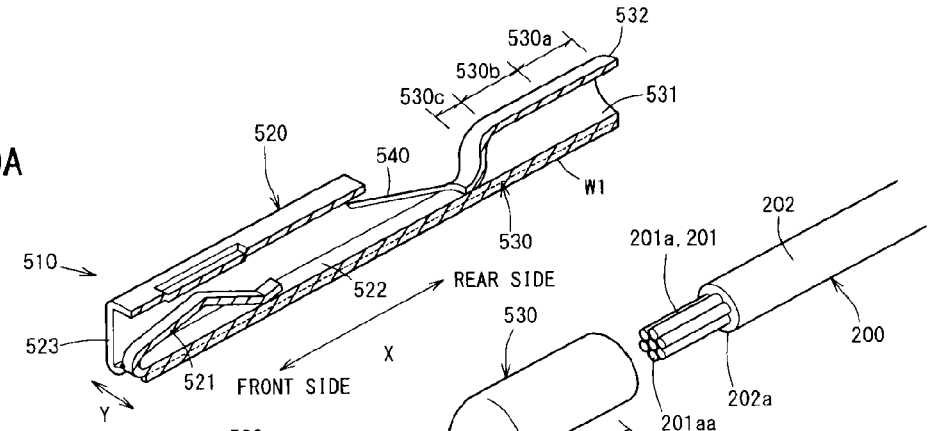
Figure 20B:
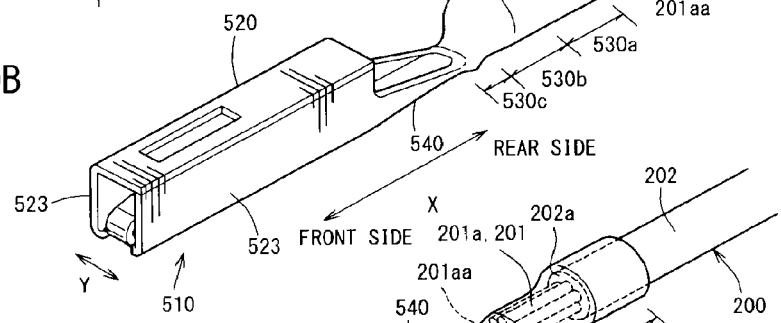
Figure 20C:
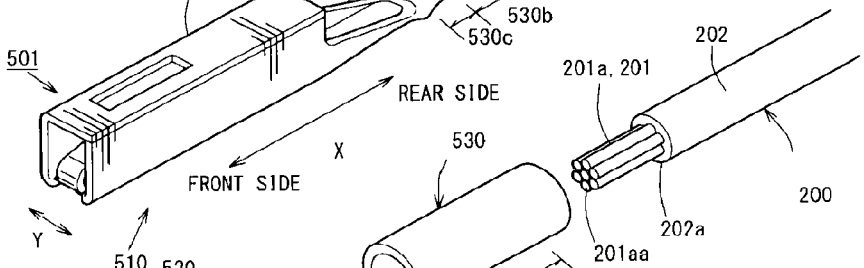
Figure 20D:
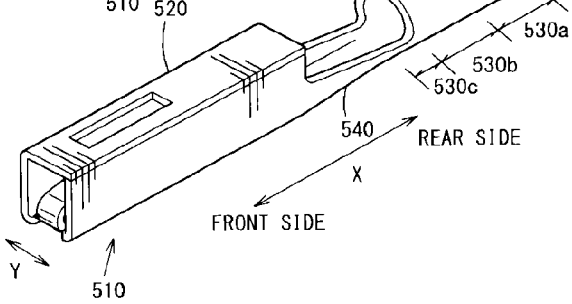

In the above description, as shown in FIGS. 13(*a*) and 13(*b*), the almost cylindrical barrel portion 430 having an opening in a rear part in the long length direction X is formed by rounding the copper alloy strip punched into the terminal shape, butting and welding the ends 432*a* along the weld portion W1 in the long length direction X to form an almost O shape as seen from a rear side, then flattening a front end portion in the long length direction X, carrying out welding and sealing along the weld portion W2 in the width direction Y, and sealing the front end in the long length direction X with the sealing portion 430*c*. As shown in FIGS. 19(*a*) to 19(*c*) which is a view for explaining another welding method in the barrel portion 430, however, it is also possible to take the shape of the barrel portion 130 and to then weld a weld portion, thereby forming the barrel portion 130.

This will be described in more detail. As shown in FIG. 19(*a*), the copper alloy strip punched into the terminal shape is rounded and the front end portion in the long length direction X is flattened and formed previously into the shape of the barrel portion 130 including a sealing portion 133.

Then, ends 130*a* rounded and butted each other are welded along a weld portion W3 in the long length direction X and is welded and sealed along a weld portion W4 in the width direction Yin the sealing portion 133 to finish the barrel portion 130.

Moreover, the ends 432*a* may be butted and welded at a bottom face side of the barrel portion 430 as shown in FIGS. 13(*a*) and 13(*b*) or the ends 130*a* may be butted and welded at an upper surface side of the barrel portion 130 as shown in FIGS. 19(*a*) and 19(*b*).

As shown in FIG. 19(*c*), furthermore, a cover pressure-bonding section 131 of the barrel portion 130 may be pressure-bonded in a circular shape as seen on a front surface to an insulating cover 202 of an insulated wire 200 and a core wire pressure-bonding section 132 may be pressure-bonded in an almost U shape as seen on a front surface to the aluminum core wire in a pressure-bonding state.

As shown in FIGS. 19(*a*) to 19(*c*), moreover, after the barrel portion 130 is welded with a band-shaped carrier K attached, a crimp terminal 100 may be separated from the carrier K when the insulated wire 200 is to be then pressure-bonded and connected or after the insulated wire 200 is pressure-bonded and connected. However, the crimp terminal 100 may be formed in a separating state from the carrier K to pressure-bond and connect the insulated wire 200.

In the present embodiment, the description has been given to the example in which the pressure-bonging section 30 of the female crimp terminal 10 is pressure-bonded and connected to the aluminum core wire 201 formed of a less noble metal such as aluminum or an aluminum alloy. However, the pressure-bonding section 30 may be pressure-bonded and connected to a conductor portion formed by a nobler metal material such as copper or a copper alloy in addition to the less noble metal, and it is possible to achieve almost equivalent functions and effects to those in the embodiment.

This will be described in more detail. The pressure-bonding section 30 having the structure can prevent water intrusion in the pressure-bonding state. For this reason, it is also possible to connect an insulated wire configured by a core wire such as copper or a copper alloy which is required to be sealed or the like in a post-pressure-bonding state in order to obtain water blocking between wires, for instance.

Third Embodiment

An embodiment according to the present invention will be described below in detail with reference to the drawings.

Figure 21A:
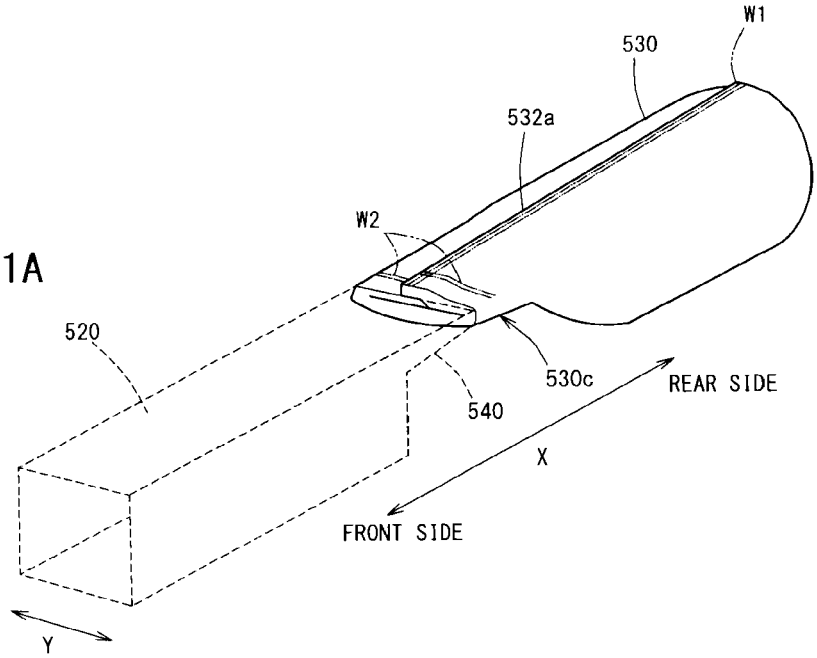
Figure 21B:
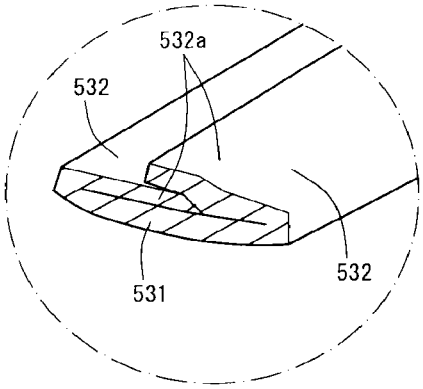
Figure 22:
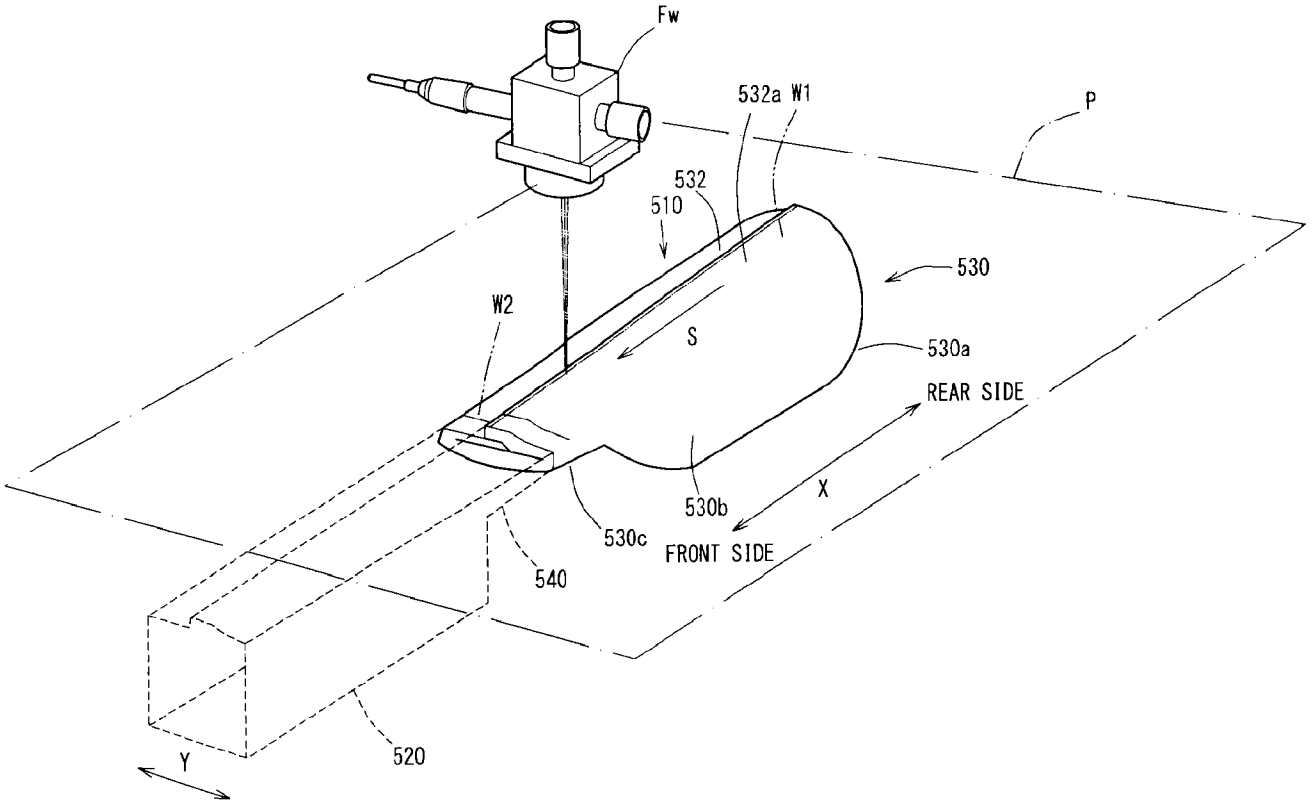

FIGS. 20(*a*) to 20(*d*) are views for explaining a female crimp terminal 510 having a superposition pressure-bonding section 530 for pressure-bonding and connecting an insulated wire 200, FIGS. 21(*a*) and 21(*b*) are views for explaining superposition welding in the superposition pressure-bonding section 530, and FIG. 22 is a perspective view showing a superposition welding situation.

Figure 23A:
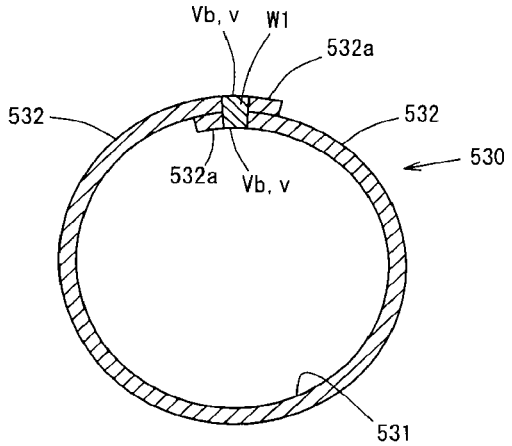
Figure 23B:
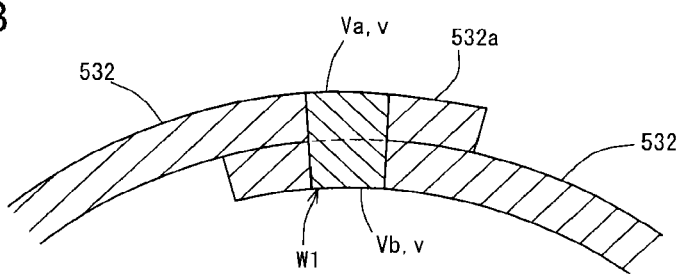
Figure 23C:
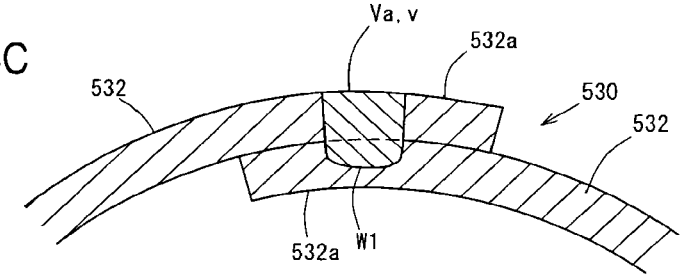
Figure 24A:
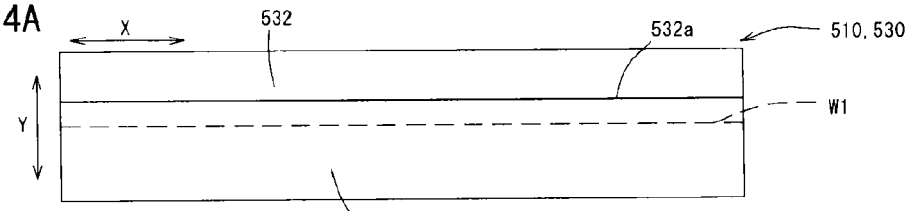
Figure 24B:
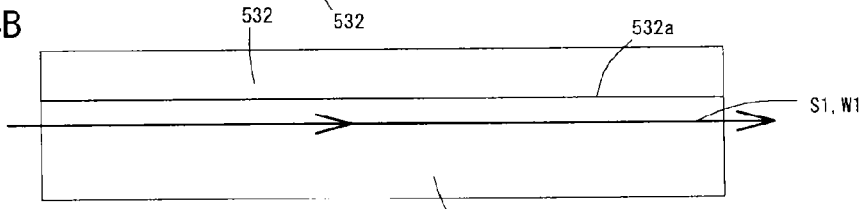
Figure 24C:
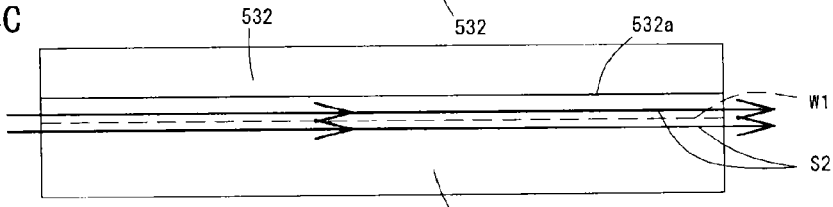
Figure 24D:
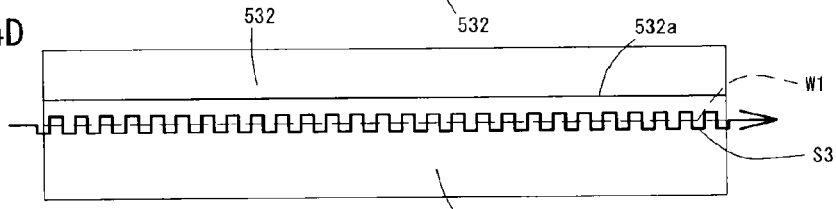
Figure 24E:
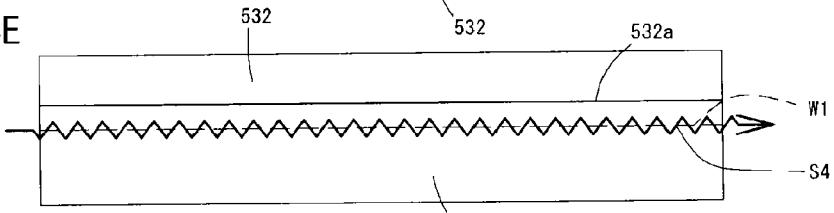
Figure 24F:
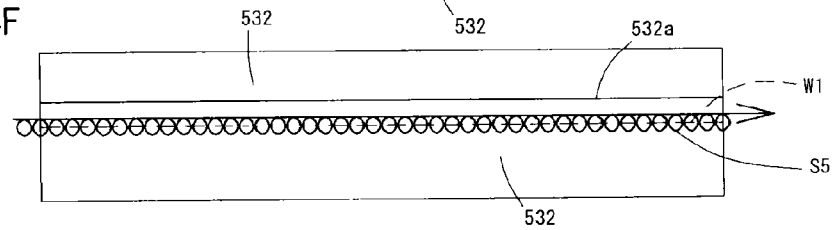

Moreover, FIGS. 23(*a*) to 23(*c*) are views for explaining a component piece end 532*a* of a barrel component piece 532 configuring the superposition pressure-bonding section 530, and FIGS. 24(*a*) to 24(*f*) are views for explaining a sweeping method in the superposition welding.

FIG. 20(*a*) is a longitudinal sectional perspective view showing the female crimp terminal 510 which is divided on a center in a width direction, FIG. 20(*b*) is a perspective view showing a pre-pressure-bonding state of the female crimp terminal 510 and an insulated wire 200, FIG. 20(*c*) is a perspective view showing a pressure-bonding connection structural body 501 in a pressure-bonding state in which the insulated wire 200 is pressure-bonded by the superposition pressure-bonding section 530, and FIG. 20(*d*) is a perspective view showing the pre-pressure-bonding state of the female crimp terminal 510 in which a sealing portion 530*c* is not formed and the insulated wire 200.

FIG. 21(*a*) is a schematic perspective view showing a bottom face side of the female crimp terminal 510 in which a box section 520 is set into a transmissive state and FIG. 21(*b*) is an enlarged view showing a part "a" in FIG. 21(*a*).

FIG. 23(*a*) is a sectional view showing the superposition pressure-bonding section 530 in which the superposition welding is completed, FIG. 23(*b*) is an enlarged sectional view showing a long length direction weld portion W1 in the superposition pressure-bonding section 530 in which the superposition welding is completed, and FIG. 23(*c*) is an enlarged sectional view showing the long length direction weld portion W1 in which the superposition welding is incomplete.

Moreover, FIG. 24(*a*) is an enlarged plan view showing the long length direction weld portion W1 in the superposition pressure-bonding section 530 in which the superposition welding is to be performed, FIG. 24(*b*) is an enlarged plan view showing one-time sweep in the superposition welding with respect to the long length direction weld portion W1, FIG. 24(*c*) is an enlarged plan view showing two-time sweep in the superposition welding with respect to the long length direction weld portion W1, FIG. 24(*d*) is an enlarged plan view showing rectangular sweep in the superposition welding with respect to the long length direction weld portion W1, FIG. 24(*e*) is an enlarged plan view showing triangular sweep in the superposition welding with respect to the long length direction weld portion W1, and FIG. 24(*f*) is an enlarged plan view showing spiral sweep in the superposition welding with respect to the long length direction weld portion W1.

A pressure-bonding connection structural body 501 according to the present embodiment is configured with the insulated wire 200 connected to the female crimp terminal 510. In other words, a wire exposing portion 201 of an aluminum core wire 201 which is exposed from an insulated tip 202*a* of an insulating cover 202 in the insulated wire 200 is pressure-bonded and connected to the superposition pressure-bonding section 530 of the female crimp terminal 510.

The insulated wire 200 to be pressure-bonded and connected to the female crimp terminal 510 is configured by covering the aluminum core wire 201 obtained by bundling aluminum raw wires with the insulating cover 202 formed by an insulating resin. This will be described in more detail. The aluminum core wire 201 is configured by twisting aluminum alloy wires so as to have a section of 0.75 mm2.

The female crimp terminal 510 will be described below in more detail.

The female crimp terminal 510 is obtained by integrally configuring the box section 520 and the superposition pressure-bonding section 530. The box section 520 permits insertion of an insertion tab in a male terminal which is not shown from a front part being a tip side in a long length direction X toward a rear part and the superposition pressure-bonding section 530 is disposed behind the box section 520 with a transition section 540 having a predetermined length interposed therebetween.

In the present embodiment, as described above, there is employed the female crimp terminal 510 configured from the box section 520 and the superposition pressure-bonding section 530. However, it is also possible to employ any crimp terminal having the superposition pressure-bonding section 530, for example, a male crimp terminal configured from an insertion tab to be inserted and connected to the box section 520 in the female crimp terminal 510 and the superposition pressure-bonding section 530. Moreover, it is also possible to employ a crimp terminal configured from only the superposition pressure-bonding section 530 and serving to bundle and connect the aluminum core wires 201 of the insulated wires 200.

Furthermore, the long length direction X is coincident with a long length direction of the insulated wire 200 for pressure-bonding and connecting the superposition pressure-bonding section 530 as shown in FIGS. 20(*b*) to 20(*d*), and a width direction Y intersects with the long length direction X in an almost horizontal planar direction. Moreover, a side of the box section 520 with respect to the superposition pressure-bonding section 530 is set to be a forward part, and reversely, a side of the superposition pressure-bonding section 530 with respect to the box section 520 is set to be a rearward part.

Moreover, the female crimp terminal 510 is a closed barrel type terminal which is configured by punching a copper alloy strip (not shown) such as brass having a surface tin plated (Sn plated) with a plate thickness of 0.1 to 0.6 mm into a two-dimensional developed terminal shape and then carrying out bending into a three-dimensional terminal shape including the box section 520 being a hollow quadrangular prismatic body and the superposition pressure-bonding section 530 taking an almost O shape as seen from a rear side and welding the long length direction weld portion W1 of the superposition pressure-bonding section 530. In the present embodiment, a surface of a copper alloy strip having a plate thickness of 0.25 mm is used for tin plating (Sn plating), and the superposition pressure-bonding section 530 is configured like a cylinder having an inside diameter of ϕ3 mm.

The box section 520 is configured from an inverted hollow quadrangular prismatic body and includes an elastic contact piece 521 which is bent rearward in the long length direction X and comes in contact with an insertion tab (not shown) of a male connector to be inserted.

Moreover, the box section 520 taking the shape of the hollow quadrangular prismatic body is configured to take an almost rectangular shape as seen from a tip side in the long length direction X in a state in which side surface portions 523 linked to both side parts in the width direction Y that is orthogonal to the long length direction X of a bottom face portion 522 are bent.

The superposition pressure-bonding section 530 in a pre-pressure-bonding state is formed in an almost O shape as seen from a rear side by rounding a pressure-bonding bottom face 531 and the barrel component piece 532 extended to both sides in the width direction Y of the pressure-bonding bottom face 531 and superposing and welding the component piece ends 532*a* as shown in FIG. 20(*b*).

A length in the long length direction of the barrel component piece 532 is set to be greater than an exposure length in the long length direction X of the wire exposing portion 201 exposed in the forward part of the long length direction X from the insulated tip 202*a* being a tip on the forward side in the long length direction X of the insulating cover 202.

The superposition pressure-bonding section 530 integrally configures a cover pressure-bonding range 530*a* for pressure-bonding the insulating cover 202 and a wire pressure-bonding range 530*b* for pressure-bonding the wire exposing portion 201 of the aluminum core wire 201, and furthermore, configures a sealing portion 530*c* (see FIG. 21(*a*)) in which an end farther forward than the wire pressure-bonding range 530*b* is deformed to be flattened into an almost flat plate and is welded in the width direction Y.

Welding for forming the superposition pressure-bonding section 530 thus configured will be described with reference to FIG. 22.

As described above, the superposition pressure-bonding section 530 formed to take the almost O shape as seen from a rear side by rounding the pressure-bonding bottom face 531 and the barrel component piece 532 and superposing and welding the component piece ends 532*a* of the barrel component piece 532 is configured by welding the long length direction weld portion W1 in the long length direction X where the component piece ends 532*a* of the barrel component piece 532 are superposed on each other and a width direction weld portion W2 in the width direction Y for perfectly sealing the forward part of the superposition pressure-bonding section 530 in the sealing portion 530*c* as shown in FIG. 22.

This will be described in more detail. The pressure-bonding bottom face 531 and the barrel component piece 532 in the superposition pressure-bonding section 530 are rounded and formed cylindrically in such a manner that the component piece ends 532*a* are superposed on each other at the bottom face side, and cylindrical forward portions are pushed against the bottom face side from an upper surface side and are thus deformed like an almost flat plate. Then, the superposition position in the long length direction X where the cylindrical component piece ends 532*a* are superposed on each other is welded (see FIG. 21(*a*)). Thereafter, the width direction weld portion W2 in the width direction Y is welded so that the superposition pressure-bonding section 530 is finished.

At this time, the long length direction weld portion W1 and the width direction weld portion W2 are disposed on almost the same plane in a virtual plane P shown in FIG. 22. Therefore, it is possible to weld them by laser welding on a single focal point.

The welding for the long length direction weld portion W1 and the width direction weld portion W2 is carried out through fiber laser welding by a fiber laser welding device Fw. The fiber laser welding uses a fiber laser beam having a wavelength of about 1.06 to 1.08 μm. The fiber laser beam is an ideal Gaussian beam and can be condensed up to a diffraction limit. In other words, the fiber laser has high light condensing performance. Therefore, it is possible to constitute a light condensing spot diameter of 30 μm or less which is hard to obtain by a YAG laser or a CO2 laser. Accordingly, it is possible to easily realize welding with a high energy density.

In the present embodiment, a fiber laser beam having a wavelength of about 1.08 μm is focused to have a light condensing spot diameter of 20 μm. Thus, fiber laser welding having an output density of 240 MW/cm2 is carried out at a sweep rate of 100 to 400 mm/sec.

Although the output density and the sweep rate are not restricted to the values, the output density and the sweep rate are closely related to each other, for example. When the output density is increased, for example, the sweep rate can also be raised.

Furthermore, an oscillation mode of the fiber laser beam in the fiber laser welding includes a continuous oscillation laser for carrying out continuous oscillation (hereinafter referred to as a CW laser), a pulse oscillation laser for carrying out pulse oscillation or a laser for pulse controlling the CW laser which performs continuous oscillation. Although the welding may be carried out by any oscillation mode, it is more preferable to perform the welding by the CW laser having high sealing performance.

As the welding for the long length direction weld portion W1 and the width direction weld portion W2 using the fiber laser beam, there is performed penetration welding for penetrating through the barrel component piece 532 configuring the superposition press-bonding section 530 as shown in FIG. 23(*a*). Consequently, a welding bead V (Va, Vb) is formed through the welding on both a surface and a back face of the weld portion W in the superposition pressure-bonding section 530.

The welding bead V is preferably formed on both the surface and the back face of the long length direction weld portion W1 in at least a wire pressure-bonding range 530*b* to be pressure-bonded and deformed in order to pressure-bond and connect the aluminum core wire 201 through the superposition pressure-bonding section 530. As a matter of course, however, the welding bead V may be formed in the cover pressure-bonding range 530*a* or the sealing portion 530*c*.

Furthermore, the width direction weld portion W2 in the sealing portion 530*c* is subjected to the laser welding in the post-pressure-bonding state and does not need to be resistant to pressure-bonding stress. If superposition portions are welded continuously by non-penetration welding, hermetic sealing performance is satisfied. For this reason, the penetration welding is not always required. In contrast to the penetration welding by which the welding bead V is formed on both the surface and the back face of the weld portion, however, the non-penetration welding tends to cause a welding defect and corrosion might occur due to water intrusion from a gap in a non-weld portion. Moreover, it is hard to decide from an outer appearance whether the superposition portions are welded continuously. Accordingly, it is preferable that the width direction weld portion W2 to be welded in the width direction Y in the sealing portion 530*c* should be subjected to the penetration welding by which the welding bead V is formed on both the surface and the back face.

Furthermore, the long length direction weld portion W1 is welded in a sweeping direction S from a rear part toward a front part in the long length direction X of the superposition pressure-bonding section 530. Moreover, the long length direction weld portion W1 including the box section 520 and the superposition pressure-bonding section 530 is welded continuously. This will be described in more detail. As shown in FIG. 24(*a*), a superposition portion in which the component piece ends 532*a* of the barrel component piece 532 are superposed on each other acts as the long length direction weld portion W1 in the long length direction X and a fiber laser beam irradiated from the fiber laser welding device Fw is focused onto the superposition portion of the component piece ends 532*a*, that is, the long length direction weld portion W1. As shown in FIG. 24(*b*), the welding is linearly carried out from the rear part toward the front part in the long length direction X along the long length direction weld portion W1.

The sweeping direction S of the fiber laser welding device Fw is not restricted to a direction from the rear part toward the front part if it is a single direction along the long length direction X, and may be a sweeping direction from the front part toward the rear part.

In addition, even if the sweeping direction is the single direction along the long length direction X, it is possible to employ various sweeping methods as shown in FIGS. 24(*a*) to 24(*f*).

This will be described in more detail. Although the superposition portion of the component piece ends 532*a*, that is, the long length direction weld portion W1 may be swept in the long length direction X (which will be hereinafter referred to as basic sweep S1) as shown in FIG. 24(*b*), a sweeping axis may be slightly shifted from the long length direction weld portion W1 to carry out the two-time sweep so as to interpose the long length direction weld portion W1 (which will be hereinafter referred to as two-time sweep S2) as shown in FIG. 24(*c*). Although the two-time sweep S2 may be carried out in a single direction from the rear part toward the front part in the long length direction X for both of the sweeping operations as shown in FIG. 24(*c*), second sweep may be performed in a reverse direction with U turn after first sweep.

Moreover, the one-time sweep may be rectangular sweep S3 for alternately repeating sweep in the width direction Y and sweep in the long length direction X over the long length direction weld portion W1 to wholly carry out the sweep in the long length direction X (see FIG. 24(*d*)), triangular sweep S4 for carrying out sweep zigzag in an oblique direction to the long length direction X and the width direction Y to wholly perform the sweep in the long length direction X (see FIG. 24(*e*)) or spiral sweep S5 for carrying out sweep forward in a sweeping direction while drawing an almost circular shape at a rearward side in the sweeping direction (see FIG. 24(*f*)).

In contrast to the basic sweep S1 for sweeping the long length direction weld portion W1, thus, the two-time sweep S2, the rectangular sweep S3, the triangular sweep S4 or the spiral sweep S5 also performs the sweep in the width direction Y. Therefore, it is possible to form the welding bead V having a width in the width direction Y increased. Consequently, a welding area in the superposition portion is increased so that reliable welding with high hermetic sealing performance can be carried out.

Since the superposition portion in which the component piece ends 532*a* of the barrel component piece 532 are superposed on each other has an asymmetrical sectional structure, moreover, it takes such a shape as to be twisted in a tube axial direction in the pressure-bonding so that shearing stress easily acts on the long length direction weld portion W1. By carrying out the welding through the two-time sweep S2, the rectangular sweep S3, the triangular sweep S4 or the spiral sweep S5, however, it is possible to relieve pressure-bonding stress per unit area which acts on the long length direction weld portion W1.

Figure 25:
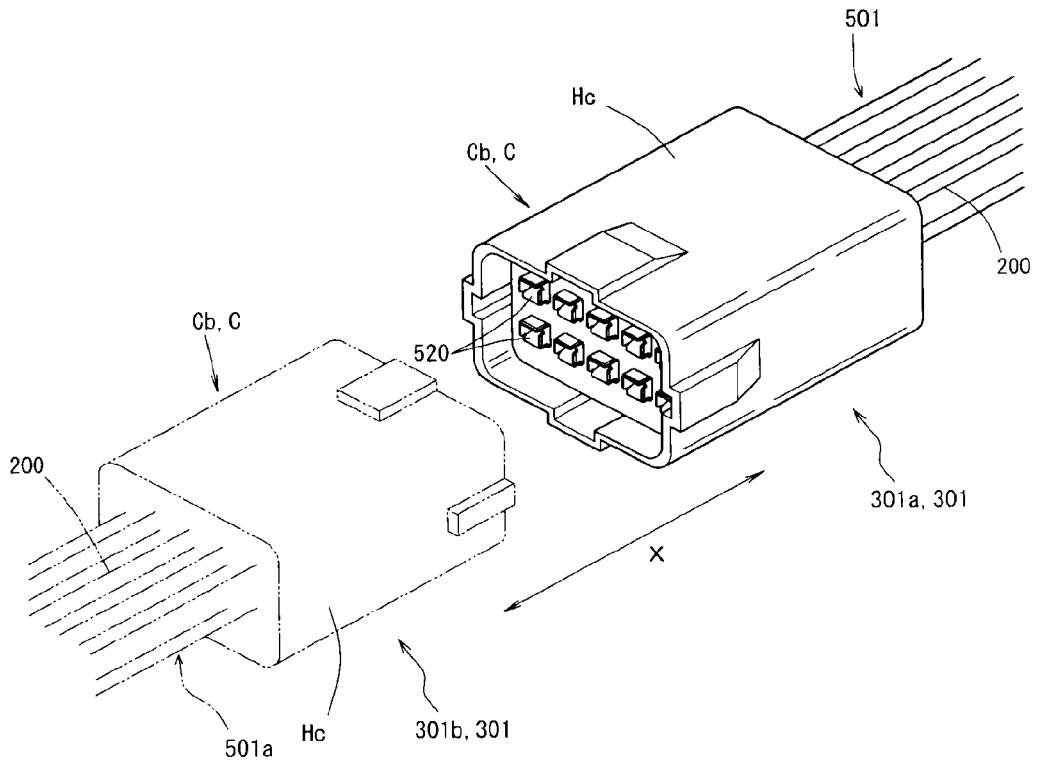
FIG. 25 is a perspective view showing a connector.

With reference to FIG. 25, next, description will be given to an example in which a pressure-bonding connection structural body 501 using the female crimp terminal 510 and a pressure-bonding connection structural body 501*a* using a male crimp terminal (not shown) are attached to a pair of connector housings Hc, respectively.

The pressure-bonding connection structural body 501 is a connection structural body using the female crimp terminal 510 and the pressure-bonding connection structural body 501*a* is a connection structural body using the male crimp terminal.

By attaching the pressure-bonding connection structural bodies 501 and 1*a* to the connector housing Hc respectively, it is possible to configure a female connector Ca and a male connector Cb which have reliable conductivity.

In the following, description will be given to an example in which both the female connector Ca and the male connector Cb serve as connectors for a wire harness H (Ha, Hb). However, one of them may be the connector for the wire harness and the other may be an auxiliary connector for a substrate, a component or the like.

This will be described in more detail. As shown in FIG. 25, the pressure-bonding connection structural body 501 formed by the female crimp terminal 510 is attached to the female connector housing Hc to configure a wire harness 301*a* including the female connector Ca.

Moreover, the pressure-bonding connection structural body 501*a* formed by the male crimp terminal is attached to the male connector housing Hc to configure a wire harness 301*b* including the male connector Cb.

By fitting the female connector Ca and the male connector Cb which are configured as described above, it is possible to connect the wire harness 301*a* to the wire harness 301*b*.

In other words, the connector C (Ca, Cb) having the female crimp terminal 510 of the pressure-bonding connection structural body 501 attached to the connector housing Hc can realize the connection of the wire harness 301 having reliability conductivity.

Moreover, the female crimp terminal 510 of the pressure-bonding connection structural body 501 and the male crimp terminal of the pressure-bonding connection structural body 501*a* have a sealing structure in which the conductor tip 201*a* of the aluminum core wire 201 in the insulated wire 200 is integrally covered with the butt superposition pressure-bonding section 530 and is not exposed to an outside.

For this reason, regardless of exposure to outside air in the connector housing Hc, it is possible to maintain an electrical connection state of the aluminum core wire 201 in the pressure-bonding section 530 and the female crimp terminal 510 without reducing the conductivity due to galvanic corrosion. Thus, it is possible to ensure a connection state having reliable conductivity.

Thus, the plate material is bent in the width direction, the component piece ends 532*a* in the width direction of the plate material are superposed on each other, the superposition portion in the long length direction X having the component piece ends 532*a* superposed on each other is welded in the long length direction X, and the welding bead V (Va, Vb) is formed by the welding at both of the surface and back face sides of the wire pressure-bonding range 530*b* to be pressure-bonded and deformed for pressure-bonding and connection to the aluminum core wire 201 in the superposition portion which is welded in the long length direction X in such a manner that the superposition pressure-bonding section 530 in the female crimp terminal 510 including the superposition pressure-bonding section 530 for permitting pressure-bonding and connection to the aluminum core wire 201 of the insulated wire 200 takes a hollow sectional shape.

According to the present invention, it is possible to configure the female crimp terminal 510 capable of obtaining stable conductivity by reliably pressure-bonding the aluminum core wire 201 through the superposition pressure-bonding section 530.

This will be described in more detail. The formation of the welding bead V (Va, Vb) through the welding on both of the surface and back face sides of the wire pressure-bonding range 530*b* implies that a section in a front/back direction of the long length direction weld portion W1 is welded continuously. Accordingly, the plate material is bent in the width direction to take the hollow sectional shape, and the long length direction weld portion W1 of the superposition pressure-bonding section 530 where the component piece ends 532*a* are welded in the long length direction X has sufficient proof strength to pressure-bonding force for pressure-bonding the aluminum core wire 201 through the superposition pressure-bonding section 530 and is not broken by pressure-bonding and deformation. Therefore, it is possible to reliably pressure-bond the aluminum core wire 201 of the insulated wire 200 through the superposition pressure-bonding section 530, thereby obtaining stable conductivity. In other words, it is possible to ensure a stable electrical connection state.

Moreover, the welding bead V (Va, Vb) is formed on both of front and back sides by the penetration welding so that the welding is carried out in a whole sectional area in the front/back direction of the long length direction weld portion W1. Therefore, more sufficient proof strength can be possessed against the pressure-bonding force for pressure-bonding the aluminum core wire 201 through the superposition pressure-bonding section 530, and furthermore, it is possible to configure the long length direction weld portion W1 where stress does not concentrate.

This will be described in more detail. In the section of the long length direction weld portion W1, in the case of non-penetration welding in which a welded portion and a base material are present as shown in FIG. 23(*c*), a difference in a hardness between the weld portion and the base material or a local difference in bending workability against the pressure-bonding or the like is made in the front/back direction. For this reason, stress is added to the weld portion in application of pressure-bonding force so that breakage tends to occur. However, the continuous long length direction weld portion W1 is formed in the front/back direction through the penetration welding. Therefore, it is possible to form the long length direction weld portion W1 which is hard to break and has sufficient proof strength.

Accordingly, the aluminum core wire 201 of the insulated wire 200 is pressure-bonded more reliably through the superposition pressure-bonding section 530 so that more stable conductivity can be obtained.

Moreover, the sealing portion 530*c* is formed by sealing the forward side in the long length direction X in the hollow sectional shape and the sealing portion 530*c* is welded in the width direction Y to form the width direction weld portion W2. By simply pressure-bonding the superposition pressure-bonding section 530 in which the aluminum core wire 201 is inserted, consequently, it is possible to prevent the aluminum core wire 201 of the insulated wire 200 or the aluminum core wire 201 from being exposed to the outside of the superposition pressure-bonding section 530, thereby performing the pressure-bonding into a wrapping state with water-blocking performance.

This will be described in more detail. Even if the superposition pressure-bonding section 530 is pressure-bonded and deformed in order to pressure-bond the aluminum core wire 201, the welding bead V (Va, Vb) is formed by the welding at least on both of the surface and back sides of the wire pressure-bonding range 530*b* to be pressure-bonded and deformed for the pressure-bonding and connection to the aluminum core wire 201 in the long length direction weld portion W1 welded in the long length direction X, the welding is not broken by the pressure-bonding and deformation, the forward side in the long length direction X in the hollow sectional shape is caused to take a sealing shape for sealing and the welding is performed in a direction intersecting with the long length direction X at the forward side in the long length direction X which is formed into the sealing shape for sealing. Therefore, portions other than an insertion portion for inserting the aluminum core wire 201 into the superposition pressure-bonding section 530 taking the hollow sectional shape are sealed because of the welding in the width direction Y, it is possible to prevent water intrusion into an inner part without exposing the aluminum core wire 201 in the superposition pressure-bonding section 530 to the outside air, and it is possible to inhibit degradation or aged deterioration from being caused. Therefore, corrosion does not occur in the aluminum core wire 201 and it is also possible to prevent a rise in electric resistance from being caused by the corrosion. Consequently, stable conductivity can be obtained.

In order to previously cause the forward side in the long length direction X in the hollow sectional shape to take the sealing shape for sealing and to perform the welding in the direction intersecting with the long length direction X at the forward side in the long length direction X which is formed into the sealing shape for sealing, thereby forming the sealing portion 530*c*, there are sealed portions other than the insertion portion for inserting the aluminum core wire 201 into the superposition pressure-bonding section 530 taking the hollow sectional shape. By simply pressure-bonding the superposition pressure-bonding section 530 in which the aluminum core wire 201 is inserted, it is possible to carry out the pressure-bonding into a wrapping state with water-blocking performance without exposing the aluminum core wire 201 of the insulated wire 200 or the aluminum core wire 201 to the outside of the superposition pressure-bonding section 530. In order to ensure the water-blocking performance, accordingly, it is possible to reliably prevent the aluminum core wire 201 pressure-bonded to the superposition pressure-bonding section 530 from being exposed to the outside air without using a cap configured by a separate component or the like in the aluminum core wire 201.

By setting the long length direction weld portion W1 in the long length direction X and the width direction weld portion W2 in the width direction Y onto almost the same plane, moreover, it is possible to reliably carry out the welding by readily moving the fiber laser welding device Fw, for example. This will be described in more detail. A distance between the fiber laser welding device Fw and the long length direction weld portion W1 and width direction weld portion W2 is constant. Therefore, it is possible to carry out the welding in a stable welding state. Thus, the welding can reliably be performed.

Furthermore, the welding is carried out by using a fiber laser beam as a high energy density beam. Therefore, it is possible to perform the welding with high precision at a high aspect ratio. Accordingly, it is possible to realize a welding state with small deformation of a terminal material.

This will be described in more detail. By configuring the high energy density beam from the fiber laser beam, it is possible to carry out welding at a high output density. This will be described in more detail. The fiber laser has high light condensing performance and a high average output density. Therefore, it is possible to efficiently bring a reliable welding state.

Moreover, the female crimp terminal 510 is configured by a copper alloy strip having a surface Sn plated. For this reason, the Sn plating on the surface functions as a light absorption material in the execution of the fiber laser welding. Consequently, absorption of a laser beam is increased so that the welding can be carried out efficiently.

Moreover, the pressure-bonding connection structural body 501 having the insulated wire 200 and the female crimp terminal 510 connected through the superposition pressure-bonding section 530 in the female crimp terminal 510 can ensure reliable water-blocking performance by simply performing surrounding and pressure-bonding through the superposition pressure-bonding section 530 of the female crimp terminal 510. Accordingly, it is possible to ensure stable conductivity.

The aluminum core wire 201 formed by an aluminum based material is used. Therefore, it is possible to reduce a weight as compared with the insulated wire formed by a copper based material and to prevent so-called galvanic corrosion, thereby ensuring a sufficient conductive function through the reliable water-blocking performance.

Furthermore, the connector C having the female crimp terminal 510 in the pressure-bonding connection structural body 501 disposed in the connector housing He can connect the female crimp terminal 510 while ensuring stable conductivity.

This will be described in more detail. For example, when fitting the female connector C and the male connector C each other to connect the female crimp terminals 510 disposed in the connector housings Hc of the respective connectors C, it is possible to connect the female crimp terminals 510 of the connectors C while ensuring the water-blocking performance. As a result, it is possible to ensure a connection state having reliable conductivity.

In correspondence of the structure according to the present invention and the embodiment, the conductor portion according to the present invention corresponds to the aluminum core wire 201, similarly to the foregoing, the pressure-bonding section corresponds to the superposition pressure-bonding section 530, the crimp terminal corresponds to the female crimp terminal 510, the end corresponds to the component piece end 532*a*, the superposition portion and the weld portion in the long length direction correspond to the long length direction weld portion W1, the direction intersecting with the long length direction corresponds to the width direction Y, the portion to be pressure-bonded and deformed corresponds to the wire pressure-bonding range 530*b*, the weld portion in the intersecting direction corresponds to the width direction weld portion W2, and the connection structural body corresponds to the pressure-bonding connection structural body 501.

However, the present invention is not restricted to only the structure according to the embodiment but can be applied based on technical ideas described in claims and many embodiments can be obtained.

Although the above description has been given to the female crimp terminal 510 in which the box section 520, the transition section 540 and the superposition pressure-bonding section 530 are disposed in this order, it is also possible to employ a crimp terminal configured from only the superposition pressure-bonding section 530.

Although there is carried out the fiber laser welding for irradiating a fiber laser beam from the fiber laser welding device Fw, it is also possible to perform the welding by irradiating an electron beam.

When the aluminum core wire 201 is to be inserted into the cylindrical superposition pressure-bonding section 530 to perform the pressure-bonding as shown in FIG. 20(*d*), furthermore, the forward part of the superposition pressure-bonding section 530 may be configured into a sealing shape to form the sealing portion 530*c*. In addition, the width direction weld portion W2 may be welded to configure the sealing portion 530*c*, and furthermore, the forward part of the superposition pressure-bonding section 530 may be only formed into the sealing shape without welding the width direction weld portion W2, or a sealing material such as a resin may be provided in the sealing portion 530*c* to carry out the sealing.

Figure 26:
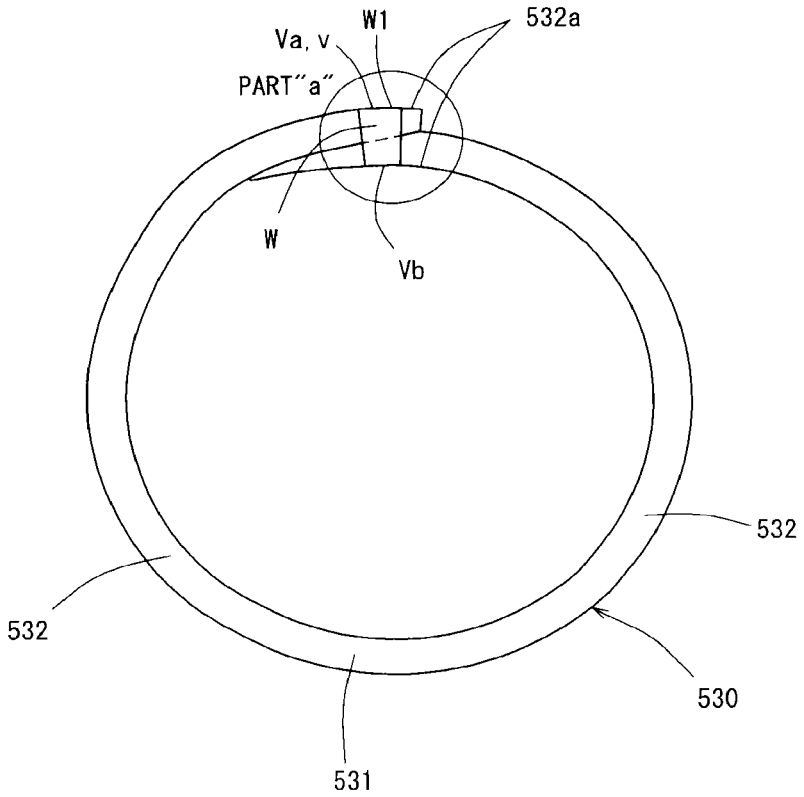
FIG. 26 is a view for explaining a further embodiment in the superposition pressure-bonding section.
Figure 26:
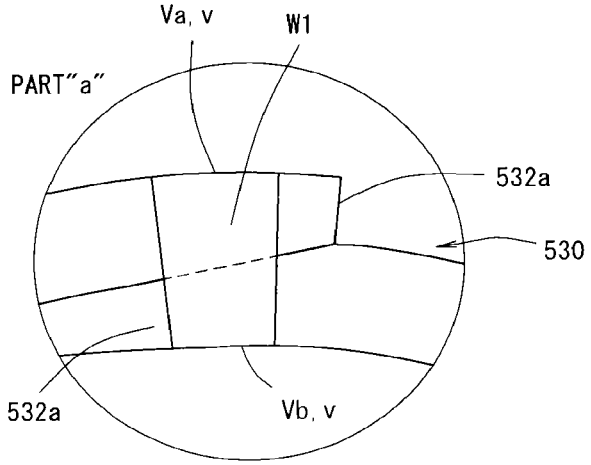

As shown in FIG. 26, furthermore, the component piece end 532*a* of the plate material forming the superposition portion is configured more thinly than the other portions of the plate material and the superposition portion is formed more thickly than the other portions of the plate material. Consequently, it is possible to reduce a fear that the welding cannot be sufficiently performed due to an excessively great superposition thickness and to reliably carry out the welding, thereby ensuring the water-blocking performance. In addition, the long length direction weld portion W1 has sufficient strength. For this reason, even if the long length direction weld portion W1 is deformed by the pressure-bonding of the aluminum core wire 201 or the like, for example, it is possible to ensure sufficient welding strength, that is, sufficient water-blocking performance.

In the above description, as shown in FIGS. 21(*a*) and 21(*b*), the almost cylindrical barrel portion 530 having an opening in a rear part in the long length direction X is formed by rounding the copper alloy strip punched into the terminal shape, butting and welding the ends 532*a* along the weld portion W1 in the long length direction X to form an almost O shape as seen from a rear side, then flattening a front end portion in the long length direction X, carrying out welding and sealing along the weld portion W2 in the width direction Y, and sealing the front end in the long length direction X with the sealing portion 530*c*. As shown in FIGS. 27(*a*) to 27(*c*) which are views for explaining another welding method in the barrel portion 530, however, it is also possible to take the shape of the barrel portion 130 and to then weld a weld portion, thereby forming the barrel portion 130.

This will be described in more detail. As shown in FIG. 27(*a*), the copper alloy strip punched into the terminal shape is rounded and the front end portion in the long length direction X is flattened and formed previously into the shape of the barrel portion 130 including a sealing portion 133.

Then, ends 130*a* rounded and butted each other are welded along a weld portion W3 in the long length direction X and is welded and sealed along a weld portion W4 in the width direction Y in the sealing portion 133 to finish the barrel portion 130.

Moreover, the ends 532*a* may be butted and welded at a bottom face side of the barrel portion 530 as shown in FIGS. 21(*a*) and 21(*b*) or the ends 130*a* may be butted and welded at an upper surface side of the barrel portion 130 as shown in FIGS. 27(*a*) and 27(*b*).

As shown in FIG. 27(*c*), furthermore, a cover pressure-bonding section 131 of the barrel portion 130 may be pressure-bonded in a circular shape as seen on a front surface to an insulating cover 202 of an insulated wire 200 and a core wire pressure-bonding section 132 may be pressure-bonded in an almost U shape as seen on a front surface to the aluminum core wire in a pressure-bonding state.

As shown in FIGS. 27(*a*) to 27(*c*), after the barrel portion 130 is welded with a band-shaped carrier K attached, a crimp terminal 100 may be separated from the carrier K when the insulated wire 200 is to be then pressure-bonded and connected or after the insulated wire 200 is pressure-bonded and connected. However, the crimp terminal 100 may be formed in a separating state from the carrier K to pressure-bond and connect the insulated wire 200.

In the present embodiment, the description has been given to the example in which the pressure-bonging section 30 of the female crimp terminal 10 is pressure-bonded and connected to the aluminum core wire 201 formed of a less noble metal such as aluminum or an aluminum alloy. However, the pressure-bonding section 30 may be pressure-bonded and connected to a conductor portion formed by a nobler metal material such as copper or a copper alloy in addition to the less noble metal, and it is possible to achieve almost equivalent functions and effects to those in the embodiment.

This will be described in more detail. The pressure-bonding section 30 having the structure can prevent water intrusion in the pressure-bonding state. For this reason, it is also possible to connect an insulated wire configured by a core wire such as copper or a copper alloy which is required to be sealed or the like in the post-pressure-bonding state in order to obtain water blocking between wires, for instance.

Fourth Embodiment

An embodiment according to the present invention will be described below in detail with reference to the drawings.

FIGS. 28(*a*) to 28(*d*) are views for explaining a female crimp terminal 610 having a butt pressure-bonding section 630 for pressure-bonding and connecting an insulated wire 200, FIGS. 29(*a*) and 29(*b*) are views for explaining butt welding in the butt pressure-bonding section 630, and FIG. 30 is a perspective view showing a butt welding situation.

Moreover, FIGS. 31(*a*) to 31(*c*) are views for explaining opposed ends 632*a* of a barrel component piece 632 configuring the butt pressure-bonding section 630, and FIGS. 32(*a*) to 32(*f*) are views for explaining a sweeping method in the butt welding.

FIG. 28(*a*) is a longitudinal sectional perspective view showing the female crimp terminal 610 which is divided on a center in a width direction, FIG. 28(*b*) is a perspective view showing a pre-pressure-bonding state of the female crimp terminal 610 and the insulated wire 200, FIG. 28(*c*) is a perspective view showing a pressure-bonding connection structural body 601 in a pressure-bonding state in which the insulated wire 200 is pressure-bonded by the butt pressure-bonding section 630, and FIG. 28(*d*) is a perspective view showing the pre-pressure-bonding state of the female crimp terminal 610 in which a sealing portion 630*c* is not formed and the insulated wire 200.

FIG. 29(*a*) is a schematic perspective view showing a bottom face side of the female crimp terminal 610 in which a box section 620 is set into a transmissive state and FIG. 29(*b*) is an enlarged view showing a part "a" in FIG. 29(*a*).

FIG. 31(*a*) is a sectional view showing the butt pressure-bonding section 630 in which the butt welding is completed, FIG. 31(*b*) is an enlarged sectional view showing a long length direction weld portion W1 in the butt pressure-bonding section 630 in which the butt welding is completed, and FIG. 31(*c*) is an enlarged sectional view showing the long length direction weld portion W1 in which the butt welding is incomplete.

Moreover, FIG. 32(*a*) is an enlarged plan view showing the long length direction weld portion W1 in the butt pressure-bonding section 630 in which the butt welding is to be performed, FIG. 32(*b*) is an enlarged plan view showing one-time sweep in the butt welding with respect to the long length direction weld portion W1, FIG. 32(*c*) is an enlarged plan view showing two-time sweep in the butt welding with respect to the long length direction weld portion W1, FIG. 32(*d*) is an enlarged plan view showing rectangular sweep in the butt welding with respect to the long length direction weld portion W1, FIG. 32(*e*) is an enlarged plan view showing triangular sweep in the butt welding with respect to the long length direction weld portion W1, and FIG. 32(*f*) is an enlarged plan view showing spiral sweep in the butt welding with respect to the long length direction weld portion W1.

A pressure-bonding connection structural body 601 according to the present embodiment is configured with the insulated wire 200 connected to the female crimp terminal 610. In other words, a wire exposing portion 6201*a* of an aluminum core wire 201 which is exposed from an insulated tip 202*a* of an insulating cover 202 in the insulated wire 200 is pressure-bonded and connected to the butt pressure-bonding section 630 of the female crimp terminal 610.

The insulated wire 200 to be pressure-bonded and connected to the female crimp terminal 610 is configured by covering the aluminum core wire 201 obtained by bundling aluminum raw wires with the insulating cover 202 formed by an insulating resin. This will be described in more detail. The aluminum core wire 201 is configured by twisting aluminum alloy wires so as to have a section of 0.75 mm2.

The female crimp terminal 610 will be described below in more detail.

The female crimp terminal 610 is obtained by integrally configuring the box section 620 and the butt pressure-bonding section 630. The box section 620 permits insertion of an insertion tab in a male terminal which is not shown from a front part being a tip side in a long length direction X toward a rear part and the butt pressure-bonding section 630 is disposed behind the box section 620 with a transition section 640 having a predetermined length interposed therebetween.

In the present embodiment, as described above, there is employed the female crimp terminal 610 configured from the box section 620 and the butt pressure-bonding section 630.

However, it is also possible to employ any crimp terminal having the butt pressure-bonding section 630, for example, a male crimp terminal configured from an insertion tab to be inserted and connected to the box section 620 in the female crimp terminal 610 and the butt pressure-bonding section 630. Moreover, it is also possible to employ a crimp terminal configured from only the butt pressure-bonding section 630 and serving to bundle and connect the aluminum core wires 201 of the insulated wires 200.

Furthermore, the long length direction X is coincident with a long length direction of the insulated wire 200 for pressure-bonding and connecting the butt pressure-bonding section 630 as shown in FIGS. 28(*b*) to 28(*d*), and a width direction Y intersects with the long length direction X in an almost horizontal planar direction. Moreover, a side of the box section 620 with respect to the butt pressure-bonding section 630 is set to be a forward part, and reversely, a side of the butt pressure-bonding section 630 with respect to the box section 620 is set to be a rearward part.

Moreover, the female crimp terminal 610 is a closed barrel type terminal which is configured by punching a copper alloy strip (not shown) such as brass having a surface tin plated (Sn plated) with a plate thickness of 0.1 to 0.6 mm into a two-dimensional developed terminal shape and then carrying out bending into a three-dimensional terminal shape including the box section 620 being a hollow quadrangular prismatic body and the butt pressure-bonding section 630 taking an almost O shape as seen from a rear side and welding the long length direction weld portion W1 of the butt pressure-bonding section 630. In the present embodiment, a surface of a copper alloy strip having a plate thickness of 0.25 mm is used for tin plating (Sn plating), and the butt pressure-bonding section 630 is configured like a cylinder having an inside diameter of ϕ3 mm.

The box section 620 is configured from an inverted hollow quadrangular prismatic body and includes an elastic contact piece 621 which is bent rearward in the long length direction X and comes in contact with an insertion tab (not shown) of a male connector to be inserted.

Moreover, the box section 620 taking the shape of the hollow quadrangular prismatic body is configured to take an almost rectangular shape as seen from a tip side in the long length direction X in a state in which side surface portions 623 linked to both side parts in the width direction Y that is orthogonal to the long length direction X of a bottom face portion 622 are bent.

The butt pressure-bonding section 630 in a pre-pressure-bonding state is formed in an almost O shape as seen from a rear side by rounding a pressure-bonding bottom face 31 and the barrel component piece 632 extended to both sides in the width direction Y of the pressure-bonding bottom face 31 and butting and welding the opposed ends 632*a* as shown in FIG. 28(*a*).

A length in the long length direction of the barrel component piece 632 is set to be greater than an exposure length in the long length direction X of the wire exposing portion 201*a* exposed in the forward part of the long length direction X from the insulated tip 202*a* being a tip on the forward side in the long length direction X of the insulating cover 202.

The butt pressure-bonding section 630 integrally configures a cover pressure-bonding range 630*a* for pressure-bonding the insulating cover 202 and a wire pressure-bonding range 630*b* for pressure-bonding the wire exposing portion 201*a* of the aluminum core wire 201, and furthermore, configures a sealing portion 630*c* (see FIG. 29(*a*)) in which an end farther forward than the wire pressure-bonding range 630*b* is deformed to be flattened into an almost flat plate and is welded in the width direction Y.

Welding for forming the butt pressure-bonding section 630 thus configured will be described with reference to FIG. 30.

As described above, the butt pressure-bonding section 630 formed to take the almost O shape as seen from a rear side by rounding the pressure-bonding bottom face 31 and the barrel component piece 632 and butting and welding the opposed ends 632*a* of the barrel component piece 632 is configured by welding the long length direction weld portion W1 in the long length direction X where the opposed ends 632*a* of the barrel component piece 632 are butted each other and a width direction weld portion W2 in the width direction Y for perfectly sealing the forward part of the butt pressure-bonding section 630 in the sealing portion 630*c* as shown in FIG. 30.

This will be described in more detail. The pressure-bonding bottom face 31 and the barrel component piece 632 in the butt pressure-bonding section 630 are rounded and formed cylindrically in such a manner that the opposed ends 632*a* are butted each other at the bottom face side, and cylindrical forward portions are pushed against the bottom face side from an upper surface side and are thus deformed like an almost flat plate. Then, the long length direction weld portion W1 in the long length direction X where the cylindrical opposed ends 632*a* are butted each other is welded (see FIG. 29(*a*)). Thereafter, the width direction weld portion W2 in the width direction Y is welded so that the butt pressure-bonding section 630 is finished.

At this time, the long length direction weld portion W1 and the width direction weld portion W2 are disposed on almost the same plane in a virtual plane P shown in FIG. 30. Therefore, it is possible to weld them by laser welding on a single focal point.

The welding for the long length direction weld portion W1 and the width direction weld portion W2 is carried out through fiber laser welding by a fiber laser welding device Fw. The fiber laser welding uses a fiber laser beam having a wavelength of about 1.06 to 1.08 μm. The fiber laser beam is an ideal Gaussian beam and can be condensed up to a diffraction limit. In other words, the fiber laser has high light condensing performance. Therefore, it is possible to constitute a light condensing spot diameter of 30 μm or less which is hard to obtain by a YAG laser or a CO2 laser. Accordingly, it is possible to easily realize welding at a high energy density.

In the present embodiment, a fiber laser beam having a wavelength of about 1.08 μm is focused to have a light condensing spot diameter of 20 μm. Thus, fiber laser welding having an output density of 380 MW/cm2 is carried out at a sweep rate of 90 to 300 mm/sec.

Moreover, the output density and the sweep rate are not restricted to the values. For example, the output density and the sweep rate are closely related to each other. When the output density is increased, for example, the sweep rate can also be raised.

Furthermore, an oscillation mode of the fiber laser beam in the fiber laser welding includes a continuous oscillation laser for carrying out continuous oscillation (hereinafter referred to as a CW laser), a pulse oscillation laser for carrying out pulse oscillation or a laser for pulse controlling the CW laser which performs continuous oscillation. Although the welding may be carried out by any oscillation mode, it is more preferable to perform the welding by the CW laser having high sealing performance.

As the welding for the long length direction weld portion W1 and the width direction weld portion W2 using the fiber laser beam, there is performed penetration welding for penetrating through the barrel component piece 632 configuring the butt press-bonding section 630 as shown in FIG. 31(*a*). Consequently, a welding bead V (Va, Vb) is formed through the welding on both a surface and a back face of the weld portion W (W1, W2) in the butt pressure-bonding section 630.

The welding bead V is preferably formed on both the surface and the back face of the long length direction weld portion W1 in at least a wire pressure-bonding range 630*b* to be pressure-bonded and deformed in order to pressure-bond and connect the aluminum core wire 201 through the butt pressure-bonding section 630. As a matter of course, however, the welding bead V may be formed in the cover pressure-bonding range 630*a* or the sealing portion 630*c*.

Furthermore, the width direction weld portion W2 in the sealing portion 630*c* is subjected to the laser welding in the post-pressure-bonding state and does not need to be resistant to pressure-bonding stress. If superposition portions in the sealing portion 630*c* are welded continuously by non-penetration welding, hermetic sealing performance is satisfied. For this reason, the penetration welding is not always required. In contrast to the penetration welding by which the welding bead V is formed on both the surface and the back face of the weld portion, however, the non-penetration welding tends to cause a welding defect and corrosion might occur due to water intrusion from a gap in a non-weld portion. Moreover, it is hard to decide from an outer appearance whether the superposition portions in the sealing portion 630*c* are welded continuously. Accordingly, it is preferable that the width direction weld portion W2 to be welded in the width direction Y in the sealing portion 630*c* should also be subjected to the penetration welding by which the welding bead V is formed on both the surface and the back face.

Furthermore, the long length direction weld portion W1 is welded in a sweeping direction S from a rear part toward a front part in the long length direction X of the butt pressure-bonding section 630. Moreover, the long length direction weld portion W1 including the box section 620 and the butt pressure-bonding section 630 is welded continuously. This will be described in more detail. As shown in FIG. 32(*a*), a butt portion in which the opposed ends 632*a* of the barrel component piece 632 are butted each other acts as the long length direction weld portion W1 in the long length direction X and a fiber laser beam irradiated from the fiber laser welding device Fw is focused onto the butt portion of the opposed ends 632*a*. As shown in FIG. 32(*b*), the welding is linearly carried out from the rear part toward the front part in the long length direction X along the long length direction weld portion W1.

The sweeping direction S of the fiber laser welding device Fw is not restricted to a direction from the rear part toward the front part if it is a single direction along the long length direction X, and may be a sweeping direction from the front part toward the rear part.

In addition, even if the sweeping direction is the single direction along the long length direction X, it is possible to employ various sweeping methods as shown in FIGS. 32(*a*) to 32(*f*).

This will be described in more detail. Although the butt portion of the opposed ends 632*a*, that is, the long length direction weld portion W1 may be swept in the long length direction X (which will be hereinafter referred to as basic sweep S1) as shown in FIG. 32(*b*), a sweeping axis may be slightly shifted from the long length direction weld portion W1 to carry out the two-time sweep so as to interpose the long length direction weld portion W1 (which will be hereinafter referred to as two-time sweep S2) as shown in FIG. 32(*c*). Although the two-time sweep S2 may be carried out in a single direction from the rear part toward the front part in the long length direction X for both of two sweeping operations as shown in FIG. 32(*c*), second sweep may be performed in a reverse direction with U turn after first sweep.

Moreover, the one-time sweep may be rectangular sweep S3 for alternately repeating sweep in the width direction Y and sweep in the long length direction X over the long length direction weld portion W1 to wholly carry out the sweep in the long length direction X (see FIG. 32(*d*)), triangular sweep S4 for carrying out sweep zigzag in an oblique direction to the long length direction X and the width direction Y to wholly perform the sweep in the long length direction X (see FIG. 32(*e*)) or spiral sweep S5 for carrying out sweep forward in a sweeping direction while drawing an almost circular shape at a rearward side in the sweeping direction (see FIG. 32(*f*)).

In contrast to the basic sweep S1 for sweeping the long length direction weld portion W1, thus, the two-time sweep S2, the rectangular sweep S3, the triangular sweep S4 or the spiral sweep S5 also performs the sweep in the width direction Y. Therefore, it is possible to form the welding bead V having a width in the width direction Y increased. Consequently, even in the case in which there is made such an error as to oscillate the butt portion in the width direction Y with respect to the long length direction X, for example, the welding bead V having a predetermined width in the width direction Y can be formed. Therefore, it is possible to reliably weld the long length direction weld portion W1, thereby setting a hermetic sealing state.

Next, a female crimp terminal 710 having a superposition pressure-bonding section 730 and a pressure-bonding connection structural body 701*a* using the female crimp terminal 710 will be described with reference to FIGS. 33 to 38.

FIGS. 33(*a*) to 33(*d*) are views for explaining the female crimp terminal 710 having the superposition pressure-bonding section 730 for pressure-bonding and connecting the insulated wire 200 and FIGS. 34(*a*) and 34(*b*) are views for explaining superposition welding in the superposition pressure-bonding section 730.

Moreover, FIG. 35 is a perspective view showing a superposition welding situation, FIGS. 36(*a*) to 36(*c*) are views for explaining a component piece end 732*a* of a barrel component piece 732 configuring the superposition pressure-bonding section 730, and FIGS. 37(*a*) to 37(*f*) are views for explaining a sweeping method in the superposition welding.

FIG. 33(*a*) is a longitudinal sectional perspective view showing the female crimp terminal 710 which is divided on a center in a width direction, FIG. 33(*b*) is a perspective view showing a pre-pressure-bonding state of the female crimp terminal 710 and an insulated wire 200, FIG. 33(*c*) is a perspective view showing a pressure-bonding connection structural body 601 in a pressure-bonding state in which the insulated wire 200 is pressure-bonded by the superposition pressure-bonding section 730, and FIG. 33(*d*) is a perspective view showing a pre-pressure-bonding state of the female crimp terminal 710 in which the sealing portion 630*c* is not formed and the insulated wire 200.

FIG. 34(*a*) is a schematic perspective view showing a bottom face side of the female crimp terminal 710 in which the box section 620 is set into a transmissive state, FIG. 34(*b*) is an enlarged view showing a part "a" in FIG. 34(*a*), and FIG. 34(*c*) is a view for explaining a welding situation through A-A line sectional view in FIG. 34(*b*).

FIG. 36(*a*) is a sectional view showing the superposition pressure-bonding section 730 in which the superposition welding is completed, FIG. 36(*b*) is an enlarged sectional view showing a long length direction weld portion W1*a* in the superposition pressure-bonding section 730 in which the superposition welding is completed, and FIG. 36(*c*) is an enlarged sectional view showing the long length direction weld portion W1*a* in which the superposition welding is incomplete.

Moreover, FIG. 37(*a*) is an enlarged plan view showing the long length direction weld portion W1*a* in the superposition pressure-bonding section 730 in which the superposition welding is to be performed, FIG. 37(*b*) is an enlarged plan view showing one-time sweep in the superposition welding with respect to the long length direction weld portion W1*a*, FIG. 37(*c*) is an enlarged plan view showing two-time sweep in the superposition welding with respect to the long length direction weld portion W1*a*, FIG. 37(*d*) is an enlarged plan view showing rectangular sweep in the superposition welding with respect to the long length direction weld portion W1*a*, FIG. 37(*e*) is an enlarged plan view showing triangular sweep in the superposition welding with respect to the long length direction weld portion W1*a*, and FIG. 37(*f*) is an enlarged plan view showing spiral sweep in the superposition welding with respect to the long length direction weld portion W1*a*.

In the following description, in the present embodiment, the same structures as those of the embodiments have the same reference numerals and detailed explanation will be omitted.

The pressure-bonding connection structural body 701*a* according to the present embodiment is configured with the insulated wire 200 connected to the female crimp terminal 710 in the same manner as the pressure-bonding connection structural body 601. In other words, a wire exposing portion 201*a* of an aluminum core wire 201 which is exposed from an insulated tip 202*a* of an insulating cover 202 in the insulated wire 200 is pressure-bonded and connected to the superposition pressure-bonding section 730 of the female crimp terminal 710.

The female crimp terminal 710 is obtained by integrally configuring the box section 620 and the superposition pressure-bonding section 730 disposed with the transition section 640 interposed therebetween, from a front part being a tip side in the long length direction X toward a rear part.

Also in the present embodiment, the female crimp terminal 710 is employed. However, it is also possible to employ a male crimp terminal in the same manner as for the female crimp terminal 610 if the crimp terminal has the superposition pressure-bonding section 730, or employ only the superposition pressure-bonding section 730.

In the same manner as the female crimp terminal 610, moreover, the female crimp terminal 710 is also a closed barrel type terminal which is configured by punching a copper alloy strip (not shown) such as brass having a surface tin plated (Sn plated) with a plate thickness of 0.4 mm or less into a two-dimensional developed terminal shape and then carrying out bending into a three-dimensional terminal shape including the box section 620 being a hollow quadrangular prismatic body and the superposition pressure-bonding section 730 taking an almost O shape as seen from a rear side and welding the superposition pressure-bonding section 730. Also in the present embodiment, a surface of a copper alloy strip having a plate thickness of 0.25 mm is used for tin plating (Sn plating), and the superposition pressure-bonding section 730 is configured like a cylinder having an inside diameter of ϕ3 mm in the same manner as the female crimp terminal 610.

The superposition pressure-bonding section 730 in a pre-pressure-bonding state is formed in an almost O shape as seen from a rear side by rounding a pressure-bonding bottom face 731 and a barrel component piece 732 extended to both sides in the width direction Y of the pressure-bonding bottom face 731 and superposing and welding the component piece ends 732*a* as shown in FIG. 33(*b*).

A length in the long length direction of the barrel component piece 732 is set to be greater than an exposure length in the long length direction X of the wire exposing portion 201*a* exposed in the forward part of the long length direction X from the insulated tip 202*a* being a tip on the forward side in the long length direction X of the insulating cover 202.

The superposition pressure-bonding section 730 integrally configures a cover pressure-bonding range 730*a* for pressure-bonding the insulating cover 202 and a wire pressure-bonding range 730*b* for pressure-bonding the wire exposing portion 201*a* of the aluminum core wire 201, and furthermore, configures a sealing portion 730*c* (see FIGS. 34(*a*) and 34(*b*)) in which an end farther forward than the wire pressure-bonding range 730*b* is deformed to be flattened into an almost flat plate and is welded in the width direction Y.

Welding for forming the superposition pressure-bonding section 730 thus configured will be described with reference to FIG. 35.

As described above, the superposition pressure-bonding section 730 formed to take the almost O shape as seen from a rear side by rounding the pressure-bonding bottom face 731 and the barrel component piece 732 and superposing and welding the component piece ends 732*a* of the barrel component piece 732 is configured by welding the long length direction weld portion W1*a* in the long length direction X where the component piece ends 732*a* of the barrel component piece 732 are superposed on each other and the width direction weld portion W2*a* in the width direction Y for perfectly sealing the forward part of the superposition pressure-bonding section 730 in the sealing portion 730*c* as shown in FIG. 35.

This will be described in more detail. The pressure-bonding bottom face 731 and the barrel component piece 732 in the superposition pressure-bonding section 730 are rounded and formed cylindrically in such a manner that the component piece ends 732*a* overlap with each other at the bottom face side, and cylindrical forward portions are pushed against a bottom face side from an upper surface side and are thus deformed like an almost flat plate. Then, the long length direction weld portion W1*a* in the long length direction X where the cylindrical component piece ends 732*a* are superposed on each other is welded (see FIG. 34(*a*)). Thereafter, the width direction weld portion W2*a* in the width direction Y is welded so that the superposition pressure-bonding section 730 is finished.

At this time, the long length direction weld portion W1*a* and the width direction weld portion W2*a* are disposed on almost the same plane in a virtual plane P shown in FIG. 35. Therefore, it is possible to weld them by laser welding on a single focal point.

The welding for the long length direction weld portion W1*a* and the width direction weld portion W2*a* is carried out as follows. A fiber laser beam having a wavelength of about 1.08 μm is focused by the fiber laser welding device Fw in such a manner that a light condensing spot diameter is 20 μm. Thus, fiber laser welding having an output density of 240 MW/cm2 is carried out at a sweeping rate of 100 to 400 mm/sec.

An introduction of the laser beam or the like according to the present embodiment is the same as that of the laser beam in the weld of the female crimp terminal 610 and an oscillation mode is also the same. Also in the fiber laser welding according to the present embodiment, furthermore, penetration welding is carried out to form a welding bead V (Va,Vb)

through the welding on both a surface and a back face of the weld portion Wa (W1*a*, W2*a*) in the superposition pressure-bonding section 730.

The welding bead V is preferably formed on both the surface and the back face of the long length direction weld portion W1*a* in at least a wire pressure-bonding range 730*b* to be pressure-bonded and deformed in order to pressure-bond and connect the aluminum core wire 201 through the superposition pressure-bonding section 730. As a matter of course, however, the welding bead V may be formed in the cover pressure-bonding range 730*a* or the sealing portion 730*c*.

Furthermore, the width direction weld portion W2*a* in the sealing portion 730*c* is subjected to the laser welding after pressure-bonding and does not need to be resistant to pressure-bonding stress. If superposition portions in the sealing portion 730*c* are welded continuously by non-penetration welding, hermetic sealing performance is satisfied. For this reason, the penetration welding is not always required. In contrast to the penetration welding by which the welding bead V is formed on both the surface and the back face of the weld portion, however, the non-penetration welding tends to cause a welding defect and corrosion might occur due to water intrusion from a gap in a non-weld portion. Moreover, it is hard to decide from an outer appearance whether the superposition portions in the sealing portion 730*c* are welded continuously. Accordingly, it is preferable that the width direction weld portion W2 to be welded in the width direction Y in the sealing portion 730*c* should be subjected to the penetration welding by which the welding bead V is formed on both the surface and the back face.

Moreover, the sweeping direction S and the sweeping method according to the present embodiment are the same as shown in FIGS. 37(*a*) to 37(*f*). This will be described in more detail. It is also possible to employ the basic sweep S1, the two-time sweep S2, the rectangular sweep S3, the triangular sweep S4 and the spiral sweep S5.

In contrast to the basic sweep S1 for sweeping the long length direction weld portion W1*a*, thus, the two-time sweep S2, the rectangular sweep S3, the triangular sweep S4 or the spiral sweep S5 also performs the sweep in the width direction Y. Therefore, it is possible to form the welding bead V having a width in the width direction Y increased. Consequently, a welding area in the superposition portion having the component piece ends 732*a* of the barrel component piece 732 superposed is increased so that reliable welding with high hermetic sealing performance can be carried out.

Since the superposition portion in which the component piece ends 732*a* of the barrel component piece 732 are superposed on each other has an asymmetrical sectional structure, moreover, it takes such a shape as to be twisted in a tube axial direction in the pressure-bonding so that shearing stress easily acts on the long length direction weld portion W1*a*. By carrying out the welding through the two-time sweep S2, the rectangular sweep S3, the triangular sweep S4 or the spiral sweep S5, however, it is possible to relieve pressure-bonding stress per unit area which acts on the long length direction weld portion W1*a*.

With reference to FIG. 38, next, description will be given to an example in which a pressure-bonding connection structural body 601 (701*a*) using the female crimp terminal 610 (710) and a pressure-bonding connection structural body 701*b* using a male crimp terminal (not shown) are attached to a pair of connector housings Hc, respectively.

The pressure-bonding connection structural body 601 (701*a*) is a connection structural body using the female crimp terminal 610 (710) and the pressure-bonding connection structural body 701*b* is a connection structural body using the male crimp terminal.

By attaching the pressure-bonding connection structural body 601 (701*a*, 701*b*) to each of the connector housings Hc respectively, it is possible to configure a female connector Ca and a male connector Cb which have reliable conductivity.

In the following, description will be given to an example in which both the female connector Ca and the male connector Cb serve as connectors for a wire harness H (Ha, Hb). However, one of them may be the connector for the wire harness and the other may be an auxiliary connector for a substrate, a component or the like.

This will be described in more detail. As shown in FIG. 38, the pressure-bonding connection structural body 601 (701*a*) formed by the female crimp terminal 610 (710) is attached to the female connector housing He to configure a wire harness 301*a* including the female connector Ca.

Moreover, the pressure-bonding connection structural body 701*b* formed by the male crimp terminal is attached to the male connector housing He to configure a wire harness 301*b* including the male connector Cb.

By fitting the female connector Ca and the male connector Cb which are configured as described above, it is possible to connect the wire harness 301*a* to the wire harness 301*b*.

In other words, the connector C (Ca, Cb) having the female crimp terminal 610 (710) of the pressure-bonding connection structural body 601 (701*a*) attached to the connector housing He can realize the connection of the wire harness 301 having reliability conductivity.

Moreover, the female crimp terminal 610 (710) of the pressure-bonding connection structural body 601 (701*a*) and the male crimp terminal of the pressure-bonding connection structural body have a sealing structure in which the conductor tip 201*a* of the aluminum core wire 201 in the insulated wire 200 is integrally covered with the butt pressure-bonding section 630 (the superposition pressure-bonding section 730) and is not exposed to an outside.

For this reason, regardless of exposure to outside air in the connector housing Hc, it is possible to maintain an electrical connection state of the aluminum core wire 201 in the butt pressure-bonding section 630 (the superposition pressure-bonding section 730) and the female crimp terminal 610 (710) without reducing the conductivity due to galvanic corrosion. Thus, it is possible to ensure a connection state having reliable conductivity.

As a method of manufacturing the female crimp terminal 610 (710) including at least the butt pressure-bonding section 630 (the superposition pressure-bonding section 730) for permitting pressure-bonding and connection to the aluminum core wire 201 of the insulated wire 200, thus, the plate material is bent to take a hollow sectional shape, the opposed ends 632*a* (732*a*) of the plate material taking the hollow sectional shape is welded in the long length direction X to configure the butt pressure-bonding section 630 (the superposition pressure-bonding section 730) where the welding bead V (Va, Vb) through the welding is formed on at least both of the surface and back face sides of the wire pressure-bonding range 630*b* (730*b*) to be pressure-bonded and deformed for the pressure-bonding and connection to the aluminum core wire 201 in the long length direction weld portion W1(W1*a*), and the welding in the long length direction X is set to be the sweeping direction S from a rear part toward a front part in the long length direction X. Consequently, the aluminum core wire 201 is reliably pressure-bonded through the butt pressure-bonding section 630 (the superposition pressure-bonding section 730). Thus, it is possible to configure the female crimp terminal 610 (710) capable of obtaining stable conductivity.

This will be described in more detail. The formation of the welding bead V (Va, Vb) through the welding on both of the surface and back face sides of the wire pressure-bonding range 630*b* (730*b*) implies that at least most of a section in a front/back direction of the weld portion is welded. Accordingly, the plate material is bent in the width direction to take the hollow sectional shape, and the weld portion of the butt pressure-bonding section 630 (the superposition pressure-bonding section 730) where the opposed ends 632*a* (732*a*) are welded in the long length direction X has sufficient proof strength to pressure-bonding force for pressure-bonding the aluminum core wire 201 through the butt pressure-bonding section 630 (the superposition pressure-bonding section 730) and is not broken by pressure-bonding and deformation. Therefore, it is possible to reliably pressure-bond the aluminum core wire 201 of the insulated wire 200 through the butt pressure-bonding section 630 (the superposition pressure-bonding section 730), thereby obtaining stable conductivity. In other words, it is possible to ensure a stable electrical connection state.

Moreover, the welding bead V (Va, Vb) is formed on both of front and back sides by the penetration welding so that the welding is carried out in a whole sectional area in the front/back direction of the weld portion. Therefore, more sufficient proof strength can be possessed against the pressure-bonding force for pressure-bonding the aluminum core wire 201 through the butt pressure-bonding section 630 (the superposition pressure-bonding section 730), and furthermore, it is possible to configure the long length direction weld portion W1 having no crack starting point or the long length direction weld portion W1*a* where stress does not concentrate.

This will be described in more detail. In the section of the long length direction weld portion W1 (W1*a*), in the case of non-penetration welding in which a welded portion and a base material are present, a difference in a hardness between the welded portion and the base material or a local difference in bending workability against the pressure-bonding or the like is made in the front/back direction. For this reason, stress is added to the weld portion in application of pressure-bonding force so that breakage tends to occur. However, the continuous long length direction weld portion W1 (W1*a*) is formed in the front/back direction through the penetration welding. Therefore, it is possible to form the long length direction weld portion W1 (W1*a*) which is hard to break and has sufficient proof strength.

By setting the welding in the long length direction X into welding having a predetermined width in the width direction Y which intersects with the long length direction X, moreover, it is possible to form a welding bead having the predetermined width. Accordingly, it is possible to form a welding bead having sufficient proof strength and hermetic sealing performance which is not broken even if stress concentrates in the pressure-bonding. Therefore, even in the case in which the long length direction weld portion W1 has an error in the width direction, for example, the welding can reliably be carried out.

This will be described in more detail. By setting, as the welding having the predetermined width, two-time sweep S2 for making a shift in the width direction to carry out two-time sweep, rectangular sweep S3 for alternately repeating sweep in the width direction and sweep in the long length direction X to carry out the welding in a sweeping direction S, triangular sweep S4 for carrying out sweep in an oblique direction to the width direction Y and the long length direction X, thereby performing the welding zigzag or spiral sweep S5 for carrying out sweep in the long length direction X to perform the welding with rotation in the width direction, it is possible to form a welding bead having a predetermined width with advance in the long length direction X.

Accordingly, even in the case in which the long length direction weld portion W1*a* of the pressure-bonding connection structural body 601 where the opposed ends 632*a* are butted each other has an error in the width direction Y, for example, it is possible to reliably carry out the welding.

Even if there is a fear that a local non-weld portion might be generated by a gap between the superposed component piece ends 732*a* in the long length direction weld portion W1 of the pressure-bonding connection structural body 701*a* where the component piece ends 732*a* are superposed on each other, moreover, it is possible to reliably ensure the hermetic sealing performance by increasing a welding area.

Moreover, shape processing is carried out to take a sealing shape for sealing the forward side in the long length direction X in the hollow sectional shape, and the forward side subjected to the shape processing into the sealing shape is welded in a direction intersecting with the long length direction X to configure the sealing portion 630*c* (730*c*). By simply pressure-bonding the butt pressure-bonding section 630 (the superposition pressure-bonding section 730) in which the aluminum core wire 201 is inserted, consequently, it is possible to prevent the aluminum core wire 201 of the insulated wire 200 or the aluminum core wire 201 from being exposed to the outside of the butt pressure-bonding section 630 (the superposition pressure-bonding section 730), thereby performing the pressure-bonding into a wrapping state with water-blocking performance.

This will be described in more detail. Even if the butt pressure-bonding section 630 (the superposition pressure-bonding section 730) is pressure-bonded and deformed in order to pressure-bond the aluminum core wire 201, the welding bead V (Va, Vb) is formed by the welding at least on both of the surface and back sides of the wire pressure-bonding range 630*b* (730*b*) to be pressure-bonded and deformed for the pressure-bonding and connection to the aluminum core wire 201 in the long length direction weld portion W1 (W1*a*), the long length direction weld portion W1 (W1*a*) is not broken by the pressure-bonding and deformation, the forward side in the long length direction X in the hollow sectional shape is caused to take the sealing shape for sealing and the welding is performed in the direction intersecting with the long length direction X at the forward side in the long length direction X which is formed to take the hollow sectional shape for sealing. Therefore, portions other than an insertion portion for inserting the aluminum core wire 201 into the butt pressure-bonding section 630 (the superposition pressure-bonding section 730) taking the hollow sectional shape are sealed, it is possible to prevent water intrusion into an inner part without exposing the aluminum core wire 201 in the butt pressure-bonding section 630 (the superposition pressure-bonding section 730) to the outside air, and it is possible to inhibit degradation or aged deterioration from being caused. Therefore, corrosion does not occur in the aluminum core wire 201 and it is also possible to prevent a rise in electric resistance from being caused by the corrosion. Consequently, stable conductivity can be obtained.

In order to previously cause the forward side in the long length direction X in the hollow sectional shape to take a sealing shape for sealing and to perform the welding in a direction intersecting with the long length direction X at the forward side in the long length direction X which is formed into the sealing shape for sealing, there are sealed portions other than an insertion portion for inserting the aluminum core wire 201 into the butt pressure-bonding section 630 (the superposition pressure-bonding section 730) taking the hollow sectional shape. By simply pressure-bonding the butt pressure-bonding section 630 (the superposition pressure-bonding section 730) in which the aluminum core wire 201 is inserted, it is possible to carry out the pressure-bonding in a wrapping state with water-blocking performance without exposing the aluminum core wire 201 of the insulated wire 200 or the aluminum core wire 201 to the outside of the butt pressure-bonding section 630 (the superposition pressure-bonding section 730). In order to ensure the water-blocking performance, accordingly, it is possible to reliably prevent the aluminum core wire 201 pressure-bonded to the butt pressure-bonding section 630 (the superposition pressure-bonding section 730) from being exposed to the outside air without using a cap configured by a separate component or the like in the aluminum core wire 201.

By setting the long length direction weld portion W1 (W1*a*) and the width direction weld portion W2 (W2*a*) on almost the same plane, moreover, it is possible to reliably carry out the welding by readily moving the fiber laser welding device Fw. This will be described in more detail. A distance between the fiber laser welding device Fw and the long length direction weld portion W1 (W1*a*) and width direction weld portion W2 (W2*a*) is constant. Therefore, it is possible to carry out the welding in a stable welding state. Thus, the welding can reliably be performed.

Furthermore, the welding is carried out by using a fiber laser beam to be a high energy density beam. Therefore, it is possible to perform the welding at a high output density. This will be described in more detail. The fiber laser is excellent in beam quality and has high light condensing performance. Therefore, it is possible to realize high output density processing. Accordingly, it is possible to efficiently bring a reliable welding state without giving extra thermal effects by deep penetration welding having a high aspect ratio. Therefore, it is possible to easily carry out the deep penetration welding.

Moreover, the female crimp terminal 610 (710) is configured by a copper alloy strip having a surface Sn plated. For this reason, the Sn plating on the surface functions as a light absorption material in the execution of the fiber laser welding. Consequently, absorption of a laser beam is increased so that the welding can be carried out efficiently.

In the case in which the long length direction weld portion is connected by brazing, furthermore, a plate thickness is 0.7 mm or the like, for example. Since the long length direction weld portion is subjected to the fiber laser welding, however, it is possible to use a copper alloy strip having a small plate thickness of 0.25 mm or the like, for example.

By the butt pressure-bonding section 630 (the superposition pressure-bonding section 730) in the female crimp terminal 610 (710) manufactured by the method of manufacturing the female crimp terminal 610 (710), the insulated wire 200 and the female crimp terminal 610 (710) are connected to configure the pressure-bonding connection structural body 601 (701*a*). By simply performing surrounding and pressure-bonding through the butt pressure-bonding section 630 (the superposition pressure-bonding section 730) of the female crimp terminal 610 (710), consequently, it is possible to configure the pressure-bonding connection structural body 601 (701*a*) capable of ensuring reliable water-blocking performance. Accordingly, stable conductivity can be ensured.

The aluminum core wire 201 formed by an aluminum based material is used. Therefore, it is possible to reduce a weight as compared with the insulated wire formed by a copper based material and to prevent so-called galvanic corrosion, thereby ensuring a sufficient conductive function through the reliable water-blocking performance.

Furthermore, the connector C having the female crimp terminal 610 (710) in the pressure-bonding connection structural body 601 (701*a*) disposed in the connector housing He can connect the female crimp terminal 610 (710) while ensuring stable conductivity.

This will be described in more detail. For example, when fitting the female connector C and the male connector C each other to connect the female crimp terminals 610 (710) disposed in the connector housings Hc of the respective connectors C, it is possible to connect the female crimp terminals 610 (710) of the connectors C to each other while ensuring the water-blocking performance. As a result, it is possible to ensure a connection state having reliable conductivity.

In correspondence of the structure according to the present invention and the embodiment, the conductor portion according to the present invention corresponds to the aluminum core wire 201,
similarly to the foregoing,
the crimp terminal corresponds to the female crimp terminal 610, 710,
the end corresponds to the opposed end 632*a*, 732*a*,
the weld portion in the long length direction corresponds to the long length direction weld portion W1, W1*a*,
the direction intersecting with the long length direction corresponds to the width direction Y,
the portion to be pressure-bonded and deformed corresponds to the wire pressure-bonding range 630*b*, 730*b*,
the weld portion in the intersecting direction corresponds to the width direction weld portion W2, W2*a* and
the connection structural body corresponds to the pressure-bonding connection structural body 601, 701*a*.

However, the present invention is not restricted to only the structure according to the embodiment but can be applied based on technical ideas described in claims and many embodiments can be obtained.

Although the above description has been given to the female crimp terminal 610 in which the box section 620, the transition section 640 and the butt pressure-bonding section 630 are disposed in this order, it is also possible to employ a crimp terminal configured from only the butt pressure-bonding section 630.

Although there is carried out the fiber laser welding for irradiating a fiber laser beam from the fiber laser welding device Fw, it is also possible to perform the welding by irradiating an electron beam.

The butt of the opposed ends 632*a* in the width direction Y of the plate material or the superposition of the component piece ends 732*a* may be butt of inclined side surfaces obtained by inclining side surfaces of the opposed ends 632*a* of the plate material or side surfaces each configuring a surface having a height which is equal to or greater than the thickness of the plate material.

As shown in FIG. 39(*a*) which is a view for explaining a further embodiment of the pressure-bonding sections 630 and 730, in the butt pressure-bonding section 630 formed cylindrically by butting the opposed ends 632*a* of the barrel component piece 632 to perform fiber laser welding over the long length direction weld portion W1, it is also possible to butt the opposed ends 632*a*, if not with close contact, with a gap therebetween if the gap is equal to or smaller than a spot diameter in the fiber laser welding, thereby performing the fiber laser welding in the long length direction X to form the welding bead V.

As shown in FIGS. 39(*b*) to 39(*d*), moreover, it is also possible to butt and weld the opposed ends 632*a* having a great thickness which are protruded in radial inward/output direction. By the increase in the thickness of the opposed end 632*a*, thus, the thickness of the welding bead V to be formed in the butt portion is increased so that the strength of the weld portion can be enhanced.

As shown in FIG. 39(*e*), furthermore, the component piece end 732*a* of the plate material forming the superposition portion is configured more thinly than the other portions of the plate material and the superposition portion is formed more thickly than the other portions of the plate material. Consequently, it is possible to reduce a fear that the welding cannot be sufficiently performed due to an excessively great superposition thickness and to reliably carry out the welding, thereby ensuring the water-blocking performance. In addition, even in the case in which the superposition portion is thinned due to the welding, the long length direction weld portion W1 has sufficient strength. For this reason, even if the long length direction weld portion W1 is deformed by the pressure-bonding of the aluminum core wire 201 or the like, for example, it is possible to ensure sufficient welding strength, that is, sufficient water-blocking performance.

As shown in FIGS. 28(*d*) and 33(*d*), furthermore, the aluminum core wire 201 may be inserted into the cylindrical pressure-bonding section 630 or 730 and a forward part of the pressure-bonding section 630 or 730 may be caused to take a sealing shape, thereby forming the sealing portion 630*c* or 730*c* in the pressure-bonding. Moreover, the width direction weld portion W2 may be only weld to configure the sealing portion 630*c*, and furthermore, the forward part of the pressure-bonding section 630 or 730 may be formed to take the sealing shape without the width direction weld portion W2 welded or a sealing material such as a resin may be provided in the sealing portion 630*c* to carry out sealing.

In the above description, as shown in FIGS. 29(*a*) and 29(*b*), the almost cylindrical barrel portion 630 having an opening in a rear part in the long length direction X is formed by rounding the copper alloy strip punched into the terminal shape, butting and welding the ends 632*a* along the weld portion W1 in the long length direction X to form an almost O shape as seen from a rear side, then flattening a front end portion in the long length direction X, carrying out welding and sealing along the weld portion W2 in the width direction Y, and sealing the front end in the long length direction X with the sealing portion 630*c*. As shown in FIGS. 40(*a*) to 40(*c*) which are views for explaining another welding method in the barrel portion 630, however, it is also possible to take the shape of the barrel portion 130 and to weld a weld portion, thereby forming the barrel portion 130.

This will be described in more detail. As shown in FIG. 40(*a*), the copper alloy strip punched into the terminal shape is rounded and the front end portion in the long length direction X is flattened and formed previously into the shape of the barrel portion 130 including a sealing portion 133.

Then, ends 130*a* rounded and butted each other are welded along a weld portion W3 in the long length direction X and is welded and sealed along a weld portion W4 in the width direction Yin the sealing portion 133 to finish the barrel portion 130.

Moreover, the ends 632*a* may be butted and welded at a bottom face side of the barrel portion 630 as shown in FIGS. 29(*a*) and 29(*b*) or the ends 130*a* may be butted and welded at an upper surface side of the barrel portion 130 as shown in FIGS. 40(*a*) and 40(*b*).

As shown in FIG. 40(*c*), furthermore, a cover pressure-bonding section 131 of the barrel portion 130 may be pressure-bonded in a circular shape as seen on a front surface to an insulating cover 202 of an insulated wire 200 and a core wire pressure-bonding section 132 may be pressure-bonded in an almost U shape as seen on a front surface to the aluminum core wire in a pressure-bonding state.

As shown in FIGS. 40(*a*) to 40(*c*), moreover, after the barrel portion 130 is welded with a band-shaped carrier K attached, a crimp terminal 100 may be separated from the carrier K when the insulated wire 200 is to be then pressure-bonded and connected or after the insulated wire 200 is pressure-bonded and connected. However, the crimp terminal 100 may be formed in a separating state from the carrier K to pressure-bond and connect the insulated wire 200.

In the present embodiment, the description has been given to the example in which the pressure-bonging section 30 of the female crimp terminal 10 is pressure-bonded and connected to the aluminum core wire 201 formed of a less noble metal such as aluminum or an aluminum alloy. However, the pressure-bonding section 30 may be pressure-bonded and connected to a conductor portion formed by a nobler metal material such as copper or a copper alloy in addition to the less noble metal, and it is possible to achieve almost equivalent functions and effects to those in the embodiments.

This will be described in more detail. The pressure-bonding section 30 having the structure can prevent water intrusion in the pressure-bonding state. For this reason, it is also possible to connect an insulated wire configured by a core wire such as copper or a copper alloy which is required to be sealed after the pressure-bonding in order to obtain water blocking between wires.

Fifth Embodiment

FIG. 41(*a*) is a perspective view showing a wire tip 200*a* of a wire 801 having a crimp terminal according to the present embodiment and a rear portion thereof, and FIG. 41(*b*) is a perspective view showing a female crimp terminal 810 and the wire tip 200*a* according to the present embodiment, illustrating a state brought immediately before the wire tip 200*a* is inserted into the female crimp terminal 810.

FIG. 42(*a*) is a sectional view taken along A-A line in FIG. 41(*a*), that is, a longitudinal sectional view showing the wire tip 200*a* of the wire 801 having the crimp terminal according to the present embodiment and a peripheral part which are cut in an intermediate part in a width direction, and FIG. 42(*b*) is an enlarged view showing a part "a" in FIG. 42(*a*).

The wire 801 having a crimp terminal according to the present embodiment is configured with an insulated wire 200 connected to the female crimp terminal 810 as shown in FIGS. 41(*a*) and 42. In other words, the wire tip 200*a* in the insulated wire 200 is pressure-bonded and connected to a pressure-bonding section 830 of the female pressure-bonding terminal 810.

The insulated wire 200 to be pressure-bonded and connected to the female crimp terminal 810 is configured by covering the aluminum core wire 201 obtained by bundling an aluminum raw wire 201*aa* with the insulating cover 202 formed by an insulating resin. This will be described in more detail. The aluminum core wire 201 is configured by twisting aluminum alloy wires so as to have a section of 0.75 mm2.

The wire tip 200*a* includes an insulated tip 202*a* and a conductor tip 201*a* toward a tip side serially in this order in the tip portion of the insulated wire 200.

The conductor tip 201*a* is a portion obtained by peeling off the insulating cover 202 at the forward side of the insulated wire 200, thereby exposing the aluminum core wire 201. The insulated tip 202*a* is a tip portion of the insulated wire 200, that is, a rear side portion from the insulated tip 202*a* which is obtained by covering the aluminum core wire 201 with the insulating cover 202.

The female crimp terminal 810 will be described below in more detail.

The female crimp terminal 810 is obtained by integrally configuring a box section 820 and a pressure-bonding section 830. The box section 820 permits insertion of an insertion tab in a male terminal which is not shown from a front part being a tip side in a long length direction X toward a rear part and the pressure-bonding section 830 is disposed behind the box section 820 with a transition section 840 having a predetermined length interposed therebetween.

In the present embodiment, as described above, there is employed the female crimp terminal 810 configured from the box section 820 and the pressure-bonding section 830. However, it is also possible to employ any crimp terminal having the pressure-bonding section 830, for example, a male crimp terminal configured from the insertion tab to be inserted and connected to the box section 820 in the female crimp terminal 810 and the pressure-bonding section 830. Moreover, it is also possible to employ a crimp terminal configured from only the pressure-bonding section 830 and serving to bundle and connect the aluminum core wires 201 of the insulated wires 200.

Furthermore, the long length direction X is coincident with a long length direction of the insulated wire 200 for pressure-bonding and connecting the pressure-bonding section 830 as shown in FIG. 41(*b*), and a width direction Y corresponds to a width direction of the female crimp terminal 810 which intersects with the long length direction X in a planar direction. Moreover, a side of the box section 820 with respect to the pressure-bonding section 830 is set to be a forward part (a tip side), and reversely, a side of the pressure-bonding section 830 with respect to the box section 820 is set to be a rearward part (a base end side).

The box section 820 is configured from an inverted hollow quadrangular prismatic body and includes an elastic contact piece 821 which is bent rearward in the long length direction X and comes in contact with an insertion tab (not shown) of a male connector to be inserted.

Moreover, the box section 820 taking the shape of the hollow quadrangular prismatic body is configured to take an almost rectangular shape as seen from the tip side in the long length direction X in a state in which side surface portions 823 linked to both side portions in the width direction Y that is orthogonal to the long length direction X of a bottom face portion 822 are bent to overlap with each other.

The pressure-bonding section 830 has a wire pressure-bonding section 831 and a sealing portion 832 provided from the rear part to the forward side in this order and is integrally formed in a continuous shape in a whole peripheral direction.

The sealing portion 832 is deformed to flatten a forward end from the wire pressure-bonding section 831 like an almost flat plate, thereby taking a flat shape in which plate-shaped terminal base materials 890 configuring the female crimp terminal 810 are superposed on each other.

The wire pressure-bonding section 831 has a base end side diameter enlarging portion 831*z*, a cover pressure-bonding section 831*a* and a conductor pressure-bonding section 831*b* provided continuously and serially in this order from the rearward part to the forward side.

The wire pressure-bonding section 831 has only a rearward side opened in order to enable insertion of the wire tip 200*a* from the base end side diameter enlarging portion 831*z* to the conductor pressure-bonding section 831*b*, and a tip side and a whole peripheral surface portion are configured in a hollow shape (cylindrically) which is not opened.

The cover pressure-bonding section 831*a* corresponds to the insulated tip 202*a* in the long length direction X of the wire pressure-bonding section 831 in a state in which the wire tip 200*a* is inserted into the wire pressure-bonding section 831, and is formed to take a hollow shape capable of surrounding the insulated tip 202*a*.

The conductor pressure-bonding section 831*b* corresponds to the conductor tip 201*a* in the long length direction X of the wire pressure-bonding section 831 in a state in which the wire tip 200*a* is inserted into the wire pressure-bonding section 831, and is formed to take a hollow shape capable of surrounding the conductor tip 201*a*.

The cover pressure-bonding section 831*a* and the conductor pressure-bonding section 831*b* are formed cylindrically with almost equal diameters to each other in a pre-pressure-bonding state.

The base end side diameter enlarging portion 831*z* corresponds to an open edge portion of an insertion hole 835 possessed in the wire pressure-bonding section 831 and is formed like a skirt (a fan) in which a diameter is gradually enlarged from the forward side to the rearward side in such a manner that an outer peripheral part and an inner peripheral part have larger diameters than the cover pressure-bonding section 831*a* and the conductor pressure-bonding section 831*b*.

The base end side diameter enlarging portion 831*z* is formed in an equal thickness to thicknesses of portions other than the base end side diameter enlarging portion 831*z* in the long length direction X of the wire pressure-bonding section 831 (see FIG. 42(*a*)).

Subsequently, a method of manufacturing the female crimp terminal 810 will be described with reference to FIG. 43.

FIG. 43 is a view for explaining welding in the pressure-bonding section 830. This will be described in more detail. FIG. 43(*a*) is a view for explaining action, illustrating a situation in which fiber laser welding is carried out by a fiber laser welding device Fw, and FIG. 43(*b*) is an enlarged view showing a part "a" in FIG. 43(*a*).

The female crimp terminal 810 is of a closed barrel type which is configured by bending a terminal base material 890 into a three-dimensional terminal shape including the box section 820 being a hollow quadrangular prismatic body and the pressure-bonding section 830 taking an almost O shape as seen from a rear side and welding the pressure-bonding section 830 through a laser L.

The terminal base material 890 is a plate-shaped base material having a plate thickness of 0.1 to 0.6 mm in order to configure the female crimp terminal 810, and a plate member obtained by punching a copper alloy strip (not shown) such as brass having a surface tin plated (Sn plated) into a two-dimensional developed terminal shape and is formed to include a pressure-bonding surface and a barrel component piece extended from both sides in the width direction Y of the pressure-bonding surface in a corresponding portion to the pressure-bonding section 830 in a pre-pressure-bonding state.

This will be described in more detail. The female crimp terminal 810 is configured cylindrically by rounding the terminal base material 890 in a direction with a long length direction set to be a central axis to butt ends 832*a* each other at a bottom face side. Then, a pair of the opposed ends 832*a* is welded while the laser irradiation device Fw is slid in the long length direction X with the opposed ends 832*a* of the terminal base material 890 butted each other. Thus, a long length direction weld portion W1 is formed.

Thereafter, the front part of the pressure-bonding section 830 is welded to form a width direction weld portion W2 while the laser irradiation device Fw is slid in the long length direction X at the forward side of the pressure-bonding section 830.

Subsequently, a procedure for pressure-bonding and connecting the female crimp terminal 810 to a wire tip 200*a* will be described with reference to FIGS. 44(*a*), 44(*b*), 44(*c*) and 44(*d*).

FIG. 44 is a view for explaining action, illustrating, in a section, a situation of a step of pressure-bonding the wire 801 having a crimp terminal according to the present embodiment. This will be described in more detail. FIG. 44 (*a*) is a longitudinal sectional view showing a state brought immediately before the wire tip 200*a* is pressure-bonded through the female crimp terminal 810, and FIG. 44(*b*) is a longitudinal sectional view showing a state brought immediately after the wire tip 200*a* is pressure-bonded through the female crimp terminal 810. FIG. 44(*c*) is an enlarged view showing a part "a" in FIG. 44(*b*). FIG. 44(*d*) is a sectional view taken along A-A line in FIG. 44(*b*).

As shown in FIG. 44(*a*), first of all, the wire tip 200*a* is inserted into the wire pressure-bonding section 831 in the pressure-bonding section 830. At this time, as shown in FIG. 44(*a*), the insulated tip 202*a* of the wire tip 200*a* is inserted into the cover pressure-bonding section 831*a*, and the conductor tip 201*a* of the wire tip 200*a* is inserted into the conductor pressure-bonding section 831*b*.

In this state, the wire pressure-bonding section 831 is pressure-bonded to a wire tip pressure-bonding section 830A by means of a pressure-bonding tool 900 such as a crimper.

In that case, as shown in FIG. 44(*a*), a pressing piece 901 and the other pressing piece 902 which make a pair and are opposed to each other in the pressure-bonding tool 900 are disposed opposite to each other with the pressure-bonding section 830 interposed therebetween in a portion excluding the base end 838 of the wire pressure-bonding section 831 in a long length direction.

In this state, the pressure-bonding section 830 is interposed by the pair of pressing blades 901 and 902 at both sides. As shown in FIGS. 44(*b*) and 44(*d*), consequently, the wire pressure-bonding section 831 is pressure-bonded to the wire tip.

As shown in FIGS. 42(*a*) and 42(*b*), consequently, the female crimp terminal 810 can be pressure-bonded and connected to the wire tip 200*a*.

By the pressure-bonding, moreover, the portion excluding the base end 838 in the wire pressure-bonding section 831 is pressure-bonded (see FIGS. 44(*a*) and 44(*b*)), and the base end 838 which is not pressure-bonded through the pressure-bonding tool has a whole outer periphery enlarged in a diameter and deformed as shown in FIG. 44(*c*) by reaction generated through the compression and deformation of the pressure-bonding section due to the pressure-bonding.

Thus, the base end side diameter enlarging portion 831*z* can be formed on the base end 838 of the wire pressure-bonding section 831.

The functions and effects realized by the wire 801 having the crimp terminal will be described.

As described above, in the wire 801 having the crimp terminal, the base end side diameter enlarging portion 831*z* having a diameter enlarged with respect to the forward part from the base end 838 is formed on the base end 838 in the long length direction X of the pressure-bonding section 830.

According to the structure, the base end 838 of the cover pressure-bonding section 831*a* strongly pressure-bonds the insulating cover 202 in a state in which the wire tip 200*a* is pressure-bonded by the pressure-bonding section 830. Consequently, it is possible to prevent the insulating cover 202 from being broken. For this reason, it is possible to ensure excellent water-blocking performance in the wire tip 200*a*.

This will be described in more detail. As shown in FIG. 48 illustrating, in a section, a conventional wire 850 having a crimp terminal, referring to an ordinary crimp terminal 851 used conventionally, a base end 852 of a cover pressure-bonding section 853 is a free end which is protruded toward a rear side (in a base end direction) (see a partial enlarged view in FIG. 48). In the case in which pressure-bonding force for pressure-bonding the insulated tip 202*a* in the wire tip 200*a* by a base end 859 of a cover pressure-bonding section 853 is excessively great when the pressure-bonding section 852 is to be pressure-bonded to the wire tip 200*a*, therefore, there is a fear that the insulating cover 202 in the insulated tip 202*a* might be extended by the base end 859 of the cover pressure-bonding section 853 or the base end 859 of the cover pressure-bonding section 853 might cut into the insulated tip 202*a*, resulting in breakage.

Consequently, there is a problem in that water intrudes an inner part of the insulating cover 202 from a broken part of the insulating cover 202 and the intruding water sticks to an aluminum core wire 201 so that the aluminum core wire 201 is corroded.

On the other hand, referring to the wire 801 having a crimp terminal according to the fifth embodiment, the base end side diameter enlarging portion 831*z* is formed on the base end 838 in the long length direction X of the pressure-bonding section 830 as described above. When the cover pressure-bonding section 831*a* is pressure-bonded to the insulated tip 202*a*, consequently, a base end in a contact part where the cover pressure-bonding section 831*a* comes in contact with the insulating cover 202 (which will be hereinafter referred to as a "terminal contact base end 839" (see FIG. 42(*b*)) corresponds to a boundary part between the base end 838 of the cover pressure-bonding section 831*a* and the insulated tip 202*a* provided on a forward side thereof. Consequently, it is possible to prevent the terminal contact base end 839 from being a protruded free end.

When the pressure-bonding section 830 is to be pressure-bonded to the wire tip 200*a*, accordingly, the pressure-bonding can be performed without a fear that the terminal contact base end 839 to be the contact part where the insulating cover 202 comes in contact with the cover pressure-bonding section 831*a* might cut into the insulating cover 202, resulting in the breakage.

In the state in which the wire tip 200*a* is pressure-bonded by the pressure-bonding section 830, accordingly, it is possible to prevent water from intruding the inside of the insulating cover 202 via the broken part of the insulating cover 202, resulting in corrosion of the aluminum core wire 201 at the inside of the insulating cover 202.

Furthermore, the base end side diameter enlarging portion 831*z* is formed to have a diameter enlarged gradually from the forward side to the rearward side in the long length direction X in the base end 838 in the long length direction X of the pressure-bonding section 830 as described above (see FIG. 42(*b*)).

By the structure described above, it is possible to ensure a thickness in the base end side diameter enlarging portion 831*z* as compared with the case in which a diameter of only an inner peripheral part is enlarged with a thickness reduced gradually toward a rear side in the long length direction X in the base end 838 in the long length direction X of the pressure-bonding section 830, for example. Therefore, it is possible to ensure great strength in the base end side diameter enlarging portion 831*z*.

Furthermore, it is not necessary to take a great time and labor, for example, to previously process the base end 838 in the long length direction X of the pressure-bonding section 830 to be thinned by cutting as in the case in which the diameter of only the inner peripheral part is enlarged with the thickness reduced gradually toward the rear side in the long length direction X in the base end 838 in the long length direction X of the pressure-bonding section 830. Therefore, it is possible to easily carry out formation by simply performing the increase in the diameter and deformation.

As shown in FIG. 44, when the wire pressure-bonding section 831 is to be pressure-bonded to the wire tip pressure-bonding section 830A by means of the pressure-bonding tool 900, the portion excluding the base end 838 of the wire pressure-bonding section 831 is interposed between the pressing blades 901 and 902 making the pair to perform the pressure-bonding so that the wire pressure-bonding section 831 can be pressure-bonded to the wire tip 200*a*, and reaction force generated by the pressure-bonding is utilized to carry out plastic deformation over the terminal base material 890 so that it is possible to enlarge the diameter of the base end 838 of the pressure-bonding section 830 formed almost cylindrically in the long length direction X.

Consequently, the base end side diameter enlarging portion 831*z* can be formed on the base end 838, and it is possible to simultaneously carry out pressure-bonding to the wire tip 200*a* of the wire pressure-bonding section 831 and formation of the base end side diameter enlarging portion 831*z* through a single step of pressure-bonding the wire pressure-bonding section 831 to the wire tip 200*a*.

By carrying out the pressure-bonding step of the wire 801 having a crimp terminal, accordingly, it is possible to reduce the bending steps for forming the base end side diameter enlarging portion 831*z*. Thus, it is possible to efficiently manufacture the wire 801 having a crimp terminal.

Wires 801Pa and 801Pb having crimp terminals according to a further embodiment will be described below.

In the structures of the wires 801Pa and 801Pb having crimp terminals which will be described below, the same structures as those of the wire 801 having a crimp terminal according to the fifth embodiment have the same reference numerals and explanation thereof will be omitted.

Sixth Embodiment

FIG. 45(*a*) is a sectional view showing a female crimp terminal 810Pa and a wire 801Pa having a crimp terminal according to a sixth embodiment.

As shown in FIG. 45(*a*), in the female crimp terminal 810Pa according to the sixth embodiment, a base end side thinned portion 831*t* which is thinned to cause an inner peripheral surface to approach an outer peripheral surface of a base end 838 in a long length direction X of a pressure-bonding section 830 is formed on at least the base end 838.

This will be described in more detail. The base end side thinned portion 831*t* is formed cylindrically along a total length in the long length direction X including the base end 838 of the wire pressure-bonding section 831 in an outer peripheral part of a wire pressure-bonding section 831, while it is formed in such a manner that an inner peripheral part of the wire pressure-bonding section 831 is gradually thinned toward a rear side at the base end 838 of the wire pressure-bonding section 831 (see a partial enlarged view of FIG. 45(*a*)).

In other words, the base end side thinned portion 831*t* is formed in such a manner that the diameter of the inner peripheral part is enlarged to gradually separate from an outer peripheral part of an insulating cover 202 toward the rear side at the base end 838 of the wire pressure-bonding section 831.

By the structure described above, in a state in which the wire pressure-bonding section 831 is pressure-bonded to a wire tip 200*a*, the base end side thinned portion 831*t* can have a greater inside diameter than inside diameters of portions other than at least the base end 838 in the long length direction X of a cover pressure-bonding section 831*b*.

Consequently, it is possible to prevent a terminal contact base end 839 from being a protruded free end. In a state in which the pressure-bonding section 830 is pressure-bonded to the wire tip 200*a*, therefore, it is possible to prevent the terminal contact base end 839 from being locally pressure-welded to the insulating cover 202.

Accordingly, it is possible to inhibit the insulating cover 202 from being broken and to prevent water intrusion into an inside of the insulating cover 202 via the broken part of the insulating cover 202 to corrode the aluminum core wire 201 at an inside of the insulating cover 202.

By forming the base end side thinned portion 831*t* on the base end 838 of the wire pressure-bonding section 831, furthermore, it is possible to form the outer peripheral part of the pressure-bonding section 830 including the base end 838 in the long length direction X of the wire pressure-bonding section 831 so as not to be protruded in a radial direction. For this reason, when the wire pressure-bonding section 831 is to be inserted into a terminal insertion hole of a connector housing which is not shown, for example, the base end 838 of the wire pressure-bonding section 831 does not interfere with the connector housing. As a result, it is possible to realize space saving in the connector housing.

Seventh Embodiment

FIG. 46 is a sectional view showing a female crimp terminal 810Pb and a wire 801Pb having a crimp terminal according to a seventh embodiment.

As shown in FIG. 46, the female crimp terminal 810Pb according to the seventh embodiment has a wire pressure-bonding section 831 configured from a closed barrel type pressure-bonding section 831*c* formed cylindrically and an open barrel type pressure-bonding section 831*s* provided continuously at a base end side of the wire pressure-bonding section 831.

The closed barrel type pressure-bonding section 831*c* is configured from a conductor pressure-bonding section 831*b* and a cover pressure-bonding section 831*a* which are disposed from a forward side to a rearward side in a long length direction X.

The open barrel type pressure-bonding section 831*s* is configured from a barrel bottom face portion 831*sa* and a barrel protrusion piece 831*sb* protruded from the barrel bottom face portion 831*sa* toward a side in a width direction in a circumferential direction.

The closed barrel type pressure-bonding section 831*c* and the open barrel type pressure-bonding section 831*s* are integrally provided continuously in the long length direction X in the barrel bottom face portion 831*sa*.

When the wire pressure-bonding section 831 is to be pressure-bonded to a wire tip 200*a*, first of all, a conductor tip 201*a* is disposed in the conductor pressure-bonding section 831*b* in the closed barrel type pressure-bonding section 831*c* and an insulated tip 202*a* is disposed in the cover pressure-bonding section 831*a* in the closed barrel type pressure-bonding section 831*c* and the open barrel type pressure-bonding section 831*s*.

In this state, by using a pressure-bonding tool, the closed barrel type pressure-bonding section 831*c* and the open barrel type pressure-bonding section 831*s* are interposed and attached in a lump to pressure-bond and connect the wire pressure-bonding section 831 to the wire tip 200*a* so that the wire 801Pb having a crimp terminal can be configured.

The wire 801Pb having a crimp terminal can pressure-bond the insulated tip 202*a* by both the cover pressure-bonding section 831*a* in the closed barrel type pressure-bonding section 831*c* and the open barrel type pressure-bonding section 831*s*.

As compared with the case in which the pressure-bonding is carried out by only the closed barrel type pressure-bonding section 831*c*, consequently, pressure-bonding force for pressure-bonding the cover pressure-bonding section 831*a* can be distributed into the cover pressure-bonding section 831*a* and the open barrel type pressure-bonding section 831*s*.

By strongly pressure-bonding the insulating cover 202 through the base end 838 of the cover pressure-bonding section 831*a*, accordingly, it is possible to prevent the insulating cover 202 from being broken. Therefore, it is possible to ensure excellent water-blocking performance in the wire tip 200*a*.

Furthermore, the closed barrel type pressure-bonding section 831*c* and the open barrel type pressure-bonding section 831*s* can be set into respective suitable pressure-bonding states by independent pressure-bonding force. For example, in particular, when the insulated wire 200 is bent at a rear side from the wire tip 200*a*, the insulating cover 202 easily cuts into the base end of the open barrel type pressure-bonding section 831*s*. By relieving the pressure-bonding force to the insulating cover 202 in comparison of the open barrel type pressure-bonding section 831*s* with the closed barrel type pressure-bonding section 831*c*, consequently, it is possible to prevent a situation in which the insulating cover 202 cuts into the open barrel type pressure-bonding section 831*s* as described above.

On the other hand, in comparison of the closed barrel type pressure-bonding section 831*c* with the open barrel type pressure-bonding section 831*s*, the pressure-bonding force to the insulating cover 202 is set to be great. Consequently, it is possible to obtain a firm pressure-bonding state to the wire tip 200*a* of the female crimp terminal 810.

In correspondence of the structure according to the present invention and the embodiment, the pressure-bonding connection structural body according to the present invention corresponds to the wires 801, 801Pa and 801Pb having crimp terminals according to the embodiment, similarly to the foregoing, the crimp terminal corresponds to the female crimp terminal 810, 810Pa and 810Pb, the conductor corresponds to the aluminum core wire 201, the tip side in the long length direction X corresponds to the forward side in the long length direction X, and the base end side in the long length direction X corresponds to the rearward side in the long length direction X.

However, the present invention is not restricted to only the structures according to the embodiments but can be applied based on technical ideas described in claims and many embodiments can be obtained.

For example, the methods of manufacturing and pressure-bonding the wire 801 having a crimp terminal according to the fifth embodiment are not restricted to the manufacturing and pressure-bonding methods.

Specifically, it is also possible to previously form a diameter enlarging portion 831*z*1 obtained by enlarging the diameter of the base end 838 in the wire pressure-bonding section 831 before pressure-bonding the wire pressure-bonding section 831 to the wire tip 200*a*.

FIG. 47(*a*) is a longitudinal sectional view showing a state brought immediately before the wire tip 200*a* is pressure-bonded through the female crimp terminal 810 and FIG. 47(*b*) is a longitudinal sectional view showing a state brought immediately after the wire tip 200*a* is pressure-bonded through the female crimp terminal 810. FIG. 47(*c*) is an enlarged view showing a part "a" part in FIG. 47(*b*).

In this case, as shown in FIG. 47(*a*), the wire tip 200*a* is inserted into the wire pressure-bonding section 831 and a portion excluding the base end 838 of the wire pressure-bonding section 831 is pressure-bonded in that state, and reaction force generated by the pressure-bonding is utilized to perform plastic deformation in such a manner that the diameter enlarging portion 831*z*1 provided in the base end 838 of the wire pressure-bonding section 831 jumps up in a radial outward direction as shown in FIG. 47(*b*). Thus, a base end side diameter enlarging portion 831*z*' can be formed in the base end 838 of the wire pressure-bonding section 831.

According to the manufacturing method described above, as shown in FIG. 47(*c*), it is possible to reliably form the base end side diameter enlarging portion 831*z*' which is inclined at a higher inclination angle to the insulated wire than the base end side diameter enlarging portion 831*z* formed in the wire pressure-bonding section 831 according to the fifth embodiment in a state in which the female crimp terminal is pressure-bonded to the wire tip 200*a*.

Moreover, the base end side thinned portion is not always formed with the inner peripheral part having the shape described above but may take a shape of another inner peripheral part. For example, there is not restricted the structure inclined linearly seen in a section as in the base end side thinned portion 831*t* shown in FIG. 45(*a*) but the structure may be formed thinly with curving toward the rear side seen in a section in order to increase a thinning degree from the forward side to the rearward side in the long length direction X as in a base end side thinned portion 831*t*' shown in FIG. 45(*b*).

In the above description, as shown in FIGS. 43(*a*) and 43(*b*), a copper alloy strip punched into a terminal shape is rounded and the ends 832*a* are butted and welded along a weld portion W1 in the long length direction X to take an almost O shape as seen from a rear side, and then, the front end portion in the long length direction X is flattened and is welded and sealed along a weld portion W2 in the width direction Y, and the front end in the long length direction X is sealed with the sealing portion 832 to form the almost cylindrical barrel portion 830 having the opening on the rear part in the long length direction X. As shown in FIG. 49 which is a view for explaining another welding method in the barrel portion 830, however, it is also possible to weld the weld portion, thereby forming the barrel portion 130 after forming the shape of the barrel portion 130.

This will be described in more detail. As shown in FIG. 49(*a*), the copper alloy strip punched into the terminal shape is rounded and the front end portion in the long length direction X is flattened to previously take the shape of the barrel portion 130 including the sealing portion 133.

Thereafter, the ends 130*a* to be butted by rounding are welded along a weld portion W3 in the long length direction X and are welded and sealed along a weld portion W4 in the width direction Yin the sealing portion 133 so that the barrel portion 130 is finished.

Moreover, the ends 832*a* may be butted and welded at the bottom face side of the barrel portion 830 as shown in FIG. 43 or the ends 130*a* may be butted and welded at the upper surface side of the barrel portion 130 as shown in FIGS. 49(*a*) and 49(*b*).

As shown in FIG. 49(*c*), in the pressure-bonding state, the cover pressure-bonding section 131 of the barrel portion 130 may be pressure-bonded to the insulating cover 202 of the insulated wire 200 to take the circular shape as seen from a front surface and the core wire pressure-bonding section 132 may be pressure-bonded to the aluminum core wire to take the almost U shape as seen from a front surface.

As shown in FIGS. 49(*a*) to 49(*c*), moreover, after the barrel portion 130 is welded with a band-shaped carrier K attached, the crimp terminal 100 may be separated from the carrier K when the insulated wire 200 is to be then pressure-bonded and connected or after the insulated wire 200 is pressure-bonded and connected. However, the crimp terminal 100 may be formed in the separating state from the carrier K to pressure-bond and connect the insulated wire 200.

Although the description has been given to the example in which the pressure-bonding section 30 of the female crimp terminal 10 is pressure-bonded and connected to the aluminum core wire 201 formed of a less noble metal such as aluminum or an aluminum alloy in the present embodiment, it may be pressure-bonded and connected to a conductor portion formed by a nobler metal material such as copper or a copper alloy in addition to the less noble metal. Thus, it is possible to achieve almost equivalent functions and effects to those in the embodiments.

This will be described in more detail. The pressure-bonding section 30 having the structure described above can prevent water intrusion in the pressure-bonding state. Therefore, it is also possible to connect an insulated wire configured by a core wire such as copper or a copper alloy which is required to be sealed after the pressure-bonding in order to obtain water-blocking performance between wires, for example.

DESCRIPTION OF REFERENCE SIGNS

1: Pressure-bonding connection structural body
10: Female crimp terminal
30: Pressure-bonding section
31: Pressure-bonding surface
32: Barrel component piece
32*a*: Opposed end
32*c*: Hook-shaped end surface
32*d*: Opposed abutting surface portion
34: Hollow convex portion
200: Insulated wire
201: Aluminum core wire
202: Insulating cover
200*a*: Wire tip
201*a*: Conductor tip
202*a*: Insulated tip
401: Pressure-bonding connection structural body
410: Female crimp terminal
430: Butt pressure-bonding section
430*b*: Wire pressure-bonding range
432*a*: Opposed end
501: Pressure-bonding connection structural body
510: Female crimp terminal
530: Superposition pressure-bonding section
530*b*: Wire pressure-bonding range
532*a*: Component piece end
601, 701*a*: Pressure-bonding connection structural body
610, 710: Female crimp terminal
630: Butt pressure-bonding section
630*b*, 730*b*: Wire pressure-bonding range
630*c*, 730*c*: Sealing portion
632*a*: Opposed end
730: Superposition pressure-bonding section
732*a*: Component piece end
801, 801Pa, 801Pb: Wire having crimp terminal
810, 810Pa, 310Pb: Female crimp terminal
830: Pressure-bonding section
831*a*: Conductor pressure-bonding section
831*b*: Cover pressure-bonding section
831*c*: Closed barrel type pressure-bonding section
831*s*: Open barrel type pressure-bonding section
831*t*: Base end side thinned portion
831*z*: Base end side diameter enlarging portion
838: Base end of wire pressure-bonding section
C: Connector
Hc: Connector housing
S: Sweeping direction
V, Va, Vb: Welding bead
W1, W1*a*: Long length direction weld portion
W2, W2*a*: Width direction weld portion
X: Long length direction
Y: Width direction
P: Virtual plane

The invention claimed is:

1. A crimp terminal including at least a pressure-bonding section for permitting pressure-bonding and connection to a conductor portion of an insulated wire, wherein the pressure-bonding section is configured from a plate material having a hollow sectional shape, and has a first welding bead formed from one end side to the other end side in a long length direction of the pressure-bonding section, the first welding bead penetrating the plate material from a surface side to a back face side, a sealing portion for carrying out sealing to superpose the plate material and is provided on the one end side in the long length direction of the pressure-bonding section in the hollow sectional shape, an opening portion into which the insulated wire can be inserted is provided on the other end side in the long direction of the pressure-bonding section in the hollow sectional shape, and a second welding bead is formed in a direction intersecting with the first welding bead formed in the long length direction between both ends in the long length direction of the sealing portion in a region where the plate material s superposed like a plane.

2. The crimp terminal according to claim 1, wherein the weld portion in the long length direction is changed in a height direction.

3. The crimp terminal according to claim 1, wherein the pressure-bonding section is configured from a pressure-bonding surface and an extended pressure-bonding piece extended from both sides in a width direction of the pressure-bonding surface, and the extended pressure-bonding piece is bent and configured to have a ring-shaped section, and opposed ends of the extended pressure-bonding piece are butted each other and a butt portion is welded in the long length direction.

4. The crimp terminal according to claim 1, wherein the conductor portion is constituted by an aluminum based material, and at least the pressure-bonding section is constituted by a copper based material.

5. A connection structural body, wherein the insulated wire and the crimp terminal are connected to each other through the pressure-bonding section in the crimp terminal according to claim 1.

6. A connector having the crimp terminal in the connection structural body according to claim 5 disposed in a connector housing.

* * * * *